US010175012B2

(12) United States Patent
Anderson et al.

(10) Patent No.: US 10,175,012 B2
(45) Date of Patent: Jan. 8, 2019

(54) FIREARM WITH PIVOTING BARREL-RECEIVER ASSEMBLY

(71) Applicant: Sturm, Ruger & Company, Inc., Southport, CT (US)

(72) Inventors: David Anderson, Prescott Valley, AZ (US); Joseph J. Cramer, Prescott Valley, AZ (US); Dwight Potter, Chino Valley, AZ (US)

(73) Assignee: STURM, RUGER & COMPANY, INC.

( * ) Notice: Subject to any disclaimer, the term of this patent is extended or adjusted under 35 U.S.C. 154(b) by 0 days.

(21) Appl. No.: 15/727,025

(22) Filed: Oct. 6, 2017

(65) Prior Publication Data

US 2018/0045475 A1 Feb. 15, 2018

Related U.S. Application Data

(62) Division of application No. 15/093,966, filed on Apr. 8, 2016, now Pat. No. 9,791,223.

(Continued)

(51) Int. Cl.
*F41A 3/58* (2006.01)
*F41A 3/66* (2006.01)

(Continued)

(52) U.S. Cl.
CPC ..... *F41A 3/58* (2013.01); *F41A 3/66* (2013.01); *F41A 17/56* (2013.01); *F41A 21/488* (2013.01)

(58) Field of Classification Search
CPC .... F41A 3/58; F41A 3/66; F41A 17/56; F41A 21/488

(Continued)

(56) References Cited

U.S. PATENT DOCUMENTS 733,681 A 7/1903 Schouboe
889,279 A 6/1908 Warnant (Continued)

FOREIGN PATENT DOCUMENTS

GB 621417 4/1949

OTHER PUBLICATIONS

Ed Buffaloe, The Schouboe Pistol, http://unblinkingeye.com/Guns/Schouboe/schouboe.html[Apr. 4, 2016 12:09:20 PM].

*Primary Examiner* — Samir Abdosh
(74) *Attorney, Agent, or Firm* — The Belles Group, P.C.

(57) ABSTRACT

A firearm with tilting barrel-receiver assembly includes a frame and a barrel-receiver assembly pivotably mounted to the frame. The barrel-receiver assembly is movable between an open position and a closed position. A latching mechanism includes a latch that selectively engages the barrel-receiver assembly. The latching mechanism may be disposed in the frame in one embodiment. The latching mechanism is movable between a locked position wherein the barrel-receiver assembly is held in the closed position and an unlocked position wherein the barrel-receiver assembly is movable to the tilted open position. The latch may be spring biased into the locked position. The barrel-receiver assembly may be configured for complete removal from the pistol in some embodiments. An interlock mechanism formed by a movable safety may be provided which prevents the barrel-receiver assembly from being unlocked when the firearm is in a ready-to-fire condition.

24 Claims, 67 Drawing Sheets

Related U.S. Application Data

(60) Provisional application No. 62/145,085, filed on Apr. 9, 2015.

(51) Int. Cl.
*F41A 21/48* (2006.01)
*F41A 17/56* (2006.01)

(58) Field of Classification Search
USPC ..... 42/40, 75.04
See application file for complete search history.

(56) References Cited

U.S. PATENT DOCUMENTS 970,307 A 9/1910 Clement
1,338,381 A 4/1920 Lewis
1,578,638 A * 3/1926 Browning ..... F41A 3/58 42/42.01
1,588,887 A 6/1926 Lassen
2,683,947 A * 7/1954 Holt ..... F41A 3/58 42/42.02
2,744,448 A 5/1956 Allen
2,961,792 A * 11/1960 Sefried, II ..... F41A 3/58 42/41
3,131,499 A * 5/1964 Arsenault ..... F41A 19/21 42/42.01
3,143,818 A * 8/1964 Vartanian ..... F41A 17/56 42/21
3,153,874 A * 10/1964 Merrill ..... F41A 3/58 42/41
3,229,400 A 1/1966 Del Pozo, Jr.
3,276,158 A * 10/1966 Johnston ..... F41A 3/58 42/41
3,561,149 A * 2/1971 Center ..... F41A 3/58 42/41
4,156,980 A 6/1979 Aspenwall
4,467,544 A 8/1984 Gerwig
4,489,515 A 12/1984 Numbers
4,597,212 A 7/1986 Jennie
4,646,458 A 3/1987 Stevens
4,662,097 A 5/1987 Walker
4,914,845 A 4/1990 Reese et al.
5,225,610 A * 7/1993 Uria ..... F41A 11/02 42/40
5,421,114 A 6/1995 Bond et al.
5,717,156 A 2/1998 Lenkarski
6,415,538 B1 7/2002 Brice
6,578,565 B2 6/2003 Casas Salva
6,766,793 B2 7/2004 Sullivan
7,739,821 B1 6/2010 Hamme
7,908,781 B2 3/2011 Laney et al.
7,941,956 B2 5/2011 Carr et al.
8,495,831 B1 7/2013 Kohout
8,683,990 B2 4/2014 Macy
8,782,938 B2 7/2014 Teach, Jr. et al.
8,950,311 B2 2/2015 Emde et al.
8,950,387 B2 2/2015 Stevens
9,291,411 B2 3/2016 Zonshine
2012/0279105 A1 11/2012 Emde et al.
2013/0145669 A1 6/2013 Zonshine
2013/0205632 A1 8/2013 Kohout
2015/0247688 A1 9/2015 Zonshine

* cited by examiner

FIREARM WITH PIVOTING BARREL-RECEIVER ASSEMBLY

CROSS-REFERENCE TO RELATED APPLICATIONS

The present application is a divisional of U.S. patent application Ser. No. 15/093,966 filed Apr. 8, 2016, which claims the benefit of U.S. Provisional Patent Application No. 62/145,085 filed Apr. 9, 2015; the entireties of which are incorporated herein by reference.

BACKGROUND OF THE INVENTION

The present disclosure generally relates to firearms, and more particularly to a pistol with a tilting barrel-receiver assembly.

Semi-automatic pistols generally include a grip frame having a grip portion for grasping by the user, barrel defining a chamber for holding a cartridge, trigger-actuated firing mechanism for cocking and releasing a striker or hammer to detonate the cartridge, and an axially reciprocating breech block. The breach block defines a breech face for forming an openable and closeable breech with the rear of the chamber for firing the pistol and ejecting spent cartridge casings in a manner well known in the art. Portions of the frame below the barrel and breech block generally house components of the firing mechanism.

Ready access to foregoing components of the pistol is desired for periodic inspection and maintenance.

SUMMARY OF THE INVENTION

A firearm which may be in the form of a pistol according to non-limiting embodiments of the present disclosure provides a pivoting and tilting barrel-receiver assembly with latching mechanism. This advantageously allows the assembly to be pivotably moved between a closed and open position for quick access to components for inspection and maintenance. The latching mechanism is movable between locked and unlocked positions to prevent movement of the barrel-receiver assembly from the closed position or alternatively to allow the barrel-receiver assembly to be opened. In one embodiment, the latching mechanism includes a slide plate mounted in the barrel-receiver assembly which axially engages or disengages a portion of the pistol grip frame to lock or unlock the barrel-receiver assembly respectively.

In another embodiment, the latching mechanism includes a slideably movable latch mounted instead in the frame which axially engages or disengages a portion of the barrel-receiver assembly to lock or unlock the barrel-receiver assembly, as further described herein. The barrel-receiver assembly may be pivotably mounted to the frame by an arcuate pivot surface formed by a transverse pivot pin or pivot protuberance(s) in various embodiments. In one embodiment, the barrel-receiver assembly may be configured to require removal of the pin from the frame and barrel-receiver assembly prior to completely removing the barrel-receiver assembly. In another embodiment, the barrel-receiver assembly may be configured to allow complete removal of the barrel-receiver assembly via a hook and slot arrangement in the barrel-receiver assembly which advantageously allows the barrel-receiver assembly to be removed via a tilting action and upward motion without tools and removing the pin from the frame. The barrel-receiver assembly may be removed from the same in a similar manner without tools if a pivot protuberance(s) is/are provided in lieu of a pivot pin.

According to one aspect of the foregoing frame mounted latch arrangement, a firearm with tilting barrel-receiver assembly includes a longitudinal axis; a frame; a barrel-receiver assembly pivotably mounted to a front end of the frame, the barrel-receiver assembly angularly movable between a tilted open position and a closed position; and a latching mechanism disposed in the frame. The latching mechanism includes a latch including a latch hook configured and operable to selectively engage or disengage the barrel-receiver assembly. The latch is slideably movable in an axial direction between a locked position in which the barrel-receiver assembly is retained in the closed position, and an unlocked position in which the barrel-receiver assembly is movable to the open position.

According to another aspect, a firearm with tilting barrel-receiver assembly includes a longitudinal axis; a frame; a barrel-receiver assembly pivotably mounted to a front end of the frame, the barrel-receiver assembly angularly movable between a tilted open position and a closed position; a safety pivotably mounted to the frame, the safety selectively movable between safe and firing positions; and a latching mechanism disposed in the frame and including a latch having a hook configured and operable to selectively engage or disengage the barrel-receiver assembly. The latch is slideably movable between a locked position in which the barrel-receiver assembly is retained in the closed position, and an unlocked position in which the barrel-receiver assembly is movable to the open position. When the safety is in the firing position, the latch is prevented from moving to the unlocked position by the safety.

A method for dismounting a barrel-receiver assembly from a firearm is provided. The method includes: providing a firearm having a longitudinal axis and a frame supporting a barrel-receiver assembly, the frame including a transversely elongated arcuate pivot surface engaging a downwardly open mounting slot in the barrel-receiver assembly that pivotably mounts the barrel-receiver assembly to the frame, the barrel-receiver assembly being pivotable between horizontal closed and tilted open positions with respect to the frame; pivoting the barrel-receiver assembly in a first rotational direction from the horizontal closed position to the tilted open position; and disengaging the slot of the barrel-receiver assembly from the pivot surface by vertically lifting the barrel-receiver assembly off the frame while the barrel-receiver assembly is in the tilted open position.

BRIEF DESCRIPTION OF THE DRAWINGS

The features of the example ("exemplary") embodiments will be described with reference to the following drawings where like elements are labeled similarly, and in which:

FIGS. 43A-B are side views showing the latch being pushed forward to the unlocked position and safety in the safe position without the frame visible, in which FIG. 43A shows the barrel-receiver assembly still engaged with the frame and FIG. 43B shows the barrel-receiver assembly titled counter-clockwise upward and completely disengaged from the latch;

Figure 1:
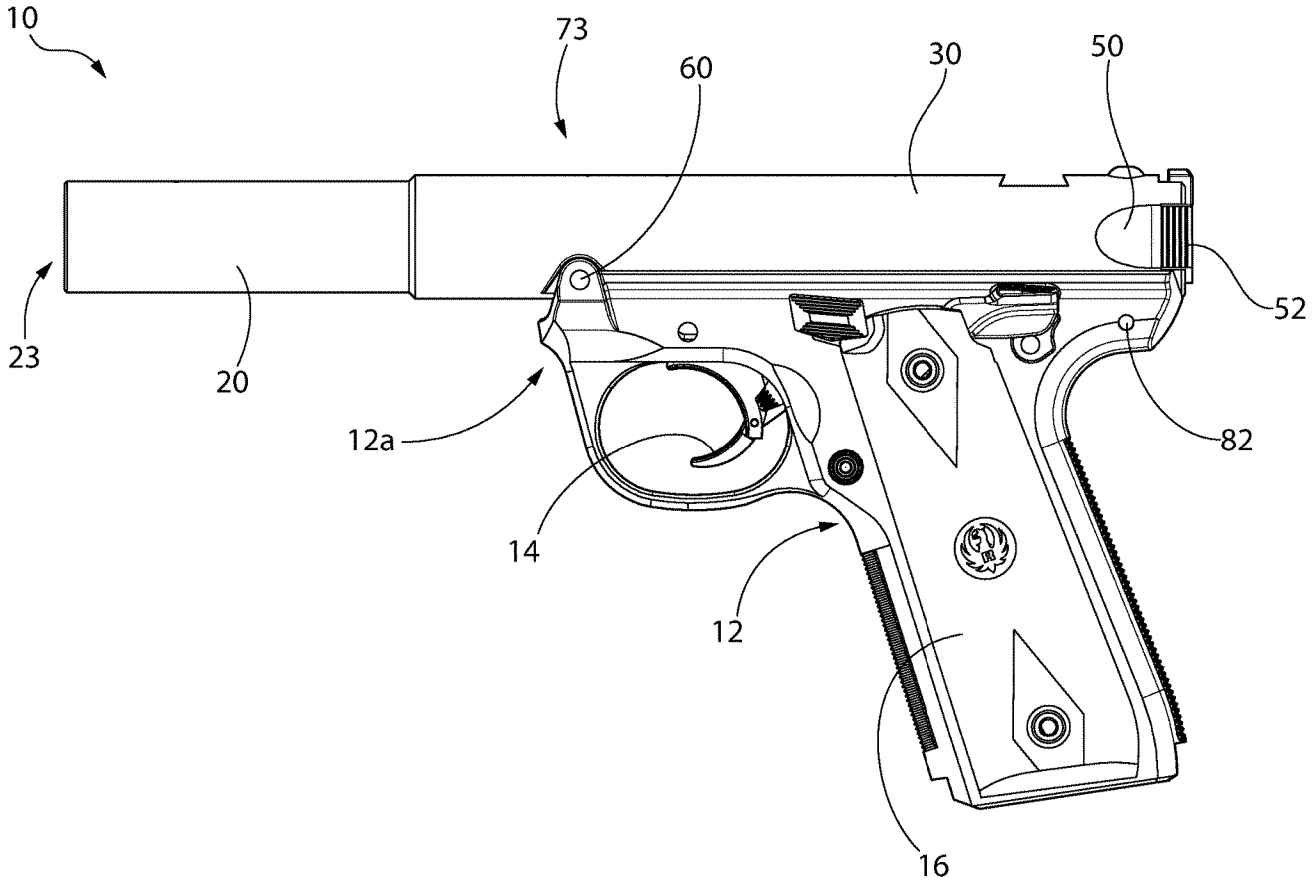
FIG. 1 is a side view of an exemplary pistol with tilting barrel-receiver assembly in a closed position according to the present disclosure.

All drawings are schematic and not necessarily to scale. A reference to a figure number herein comprised of multiple figures sharing the same figure number but with different alphabetic suffixes shall be construed as a reference to all those figures unless expressly noted otherwise.

DETAILED DESCRIPTION

The features and benefits of the invention are illustrated and described herein by reference to example ("exemplary") embodiments. This description of example embodiments is intended to be read in connection with the accompanying drawings, which are to be considered part of the entire written description. Accordingly, the disclosure expressly should not be limited to such embodiments illustrating some possible non-limiting combination of features that may exist alone or in other combinations of features.

In the description of embodiments disclosed herein, any reference to direction or orientation is merely intended for convenience of description and is not intended in any way to limit the scope of the present invention. Relative terms such as "lower," "upper," "horizontal," "vertical,", "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation. Terms such as "attached," "affixed," "connected," and "interconnected," refer to a relationship wherein structures are secured or attached to one another either directly or indirectly through intervening structures, as well as both movable or rigid attachments or relationships, unless expressly described otherwise.

Figure 2:
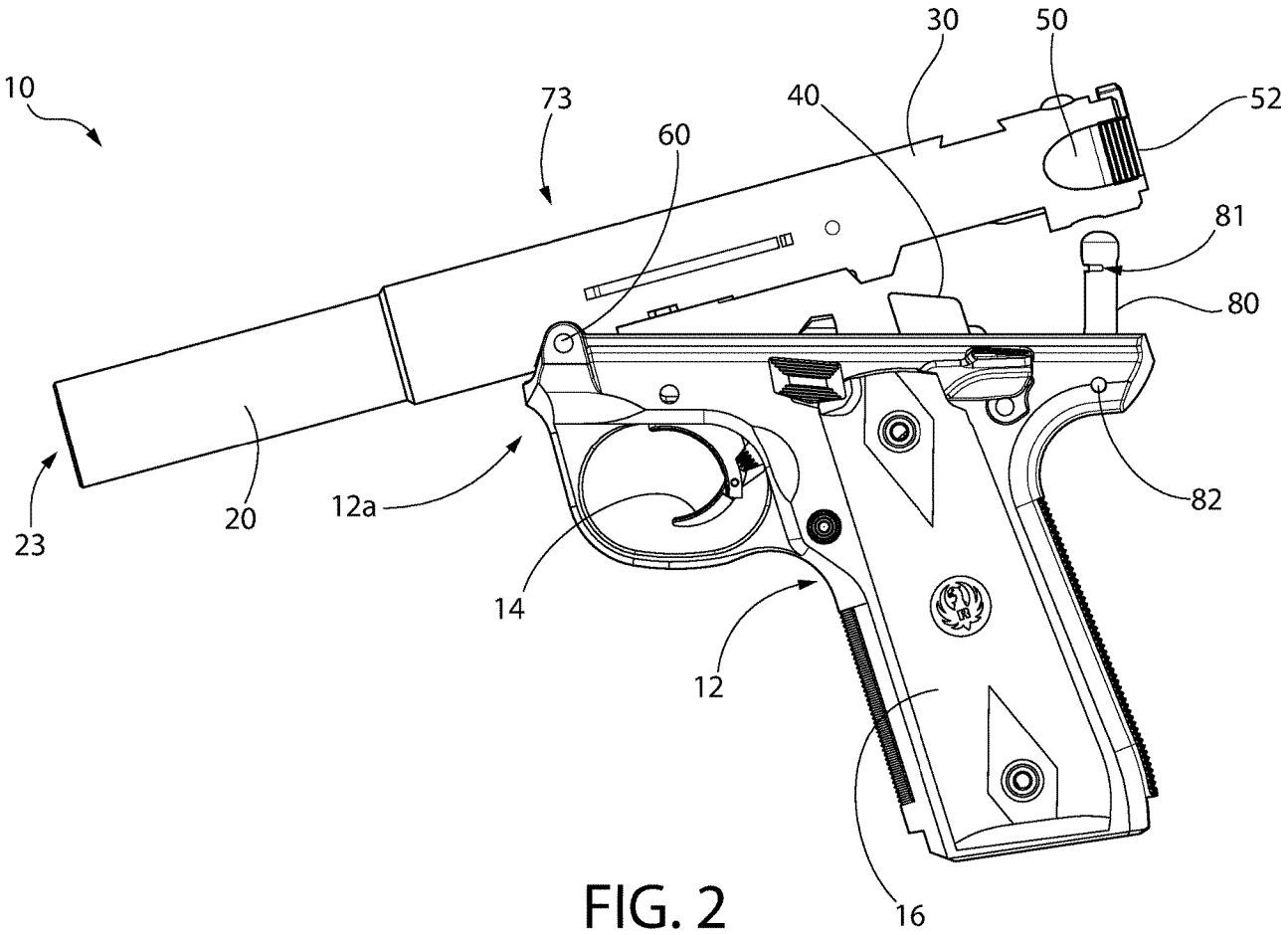
FIG. 2 is a view thereof in an open position.

FIGS. 1 and 2 depict an exemplary embodiment of a semi-automatic firearm in the non-limiting form of a pistol having a pivotable and tilting barrel-receiver assembly according to the present disclosure. It will be appreciated that the present invention is not limited to application in pistols, but may instead be broadly used in other types of firearms including without limitation rifles, shotguns, etc. in which a tilting barrel-receiver assembly is desirable.

Pistol 10 defines a longitudinal axis LA and includes a grip frame 12 having a front trigger guard portion 12*a* and a barrel-receiver assembly including a barrel 20 and receiver 30. In one embodiment, the barrel-receiver assembly 20/30 is formed as a single unitary structure with the barrel being integral with the receiver. In other embodiments, the barrel 20 may be a separate component which is permanently or removably coupled to the front of the receiver 30. The rear of the frame 12 defines an elongated grip 16 for holding pistol 10. The frame 12 includes an at least partially open interior space 11 extending longitudinally and vertically for housing the firing mechanism components (see, e.g. FIGS. 5 and 6). A portion of interior space 11 in grip 16 further defines a magazine well 13 configured to hold a removably insertable magazine (not shown) that contains a plurality of cartridges. Frame 12 may be made of any suitable material commonly used in the art including metal, polymer (e.g. glass reinforced or unreinforced nylon or other plastic), wood, composites, or combinations thereof.

Pistol 10 includes a trigger-actuated firing mechanism including a trigger 14 which is operable to cock and release a pivotable hammer 40 (see, e.g. FIGS. 5 and 6) in one embodiment. Other possible embodiments may instead comprise an axially reciprocating-cockable striker in lieu of a hammer which are well known to those skilled in the art without further elaboration. The hammer assembly may further include a hammer strut 41 and spring 42 operable to bias the hammer 40 in a forward direction towards an axially movable firing pin 43. The hammer strut and spring are secured to and guided at least in part in frame 12 by main spring housing 201 further described below. Trigger 14 is mechanically linked to hammer 40 and a rotatable sear 44 via trigger bar 45. The trigger bar is operable to cock hammer 40 into a rearward ready-to-fire position. Sear 44 operates to hold the hammer in the rearward cocked position. Pulling trigger 14 rotates the sear 44, which in turn releases the hammer 40 to strike the rear end of firing pin 43. The front end of the firing pin strikes a chambered cartridge and discharges the pistol 10.

Figure 5:
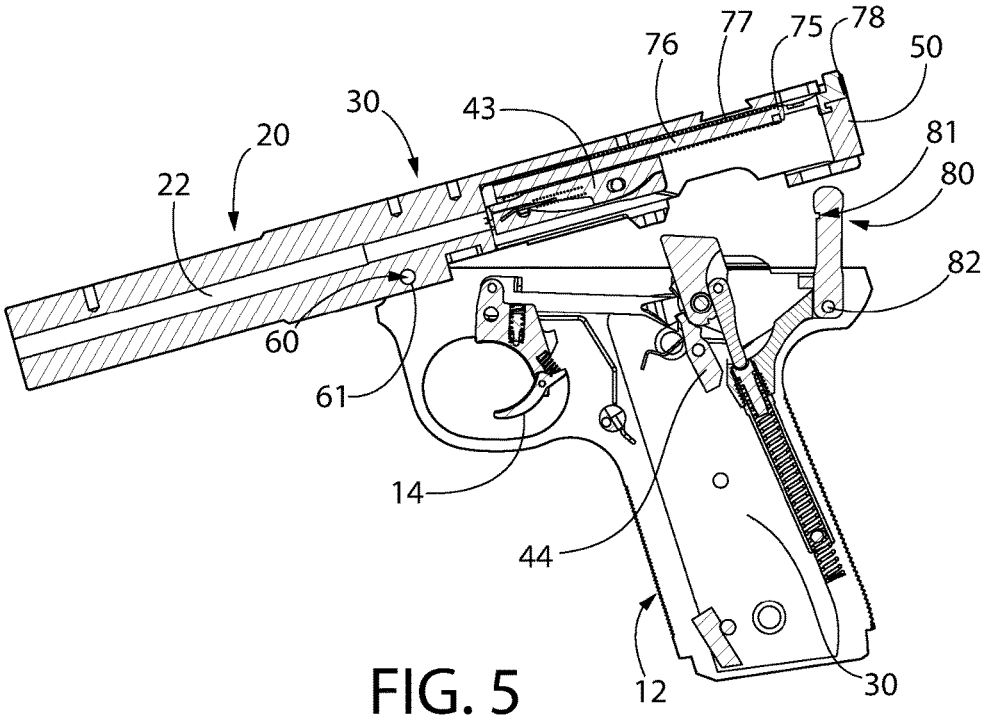
FIG. 5 is a side cross-sectional view of the grip frame and barrel-receiver assembly showing the barrel-receiver assembly in an open position.
Figure 6:
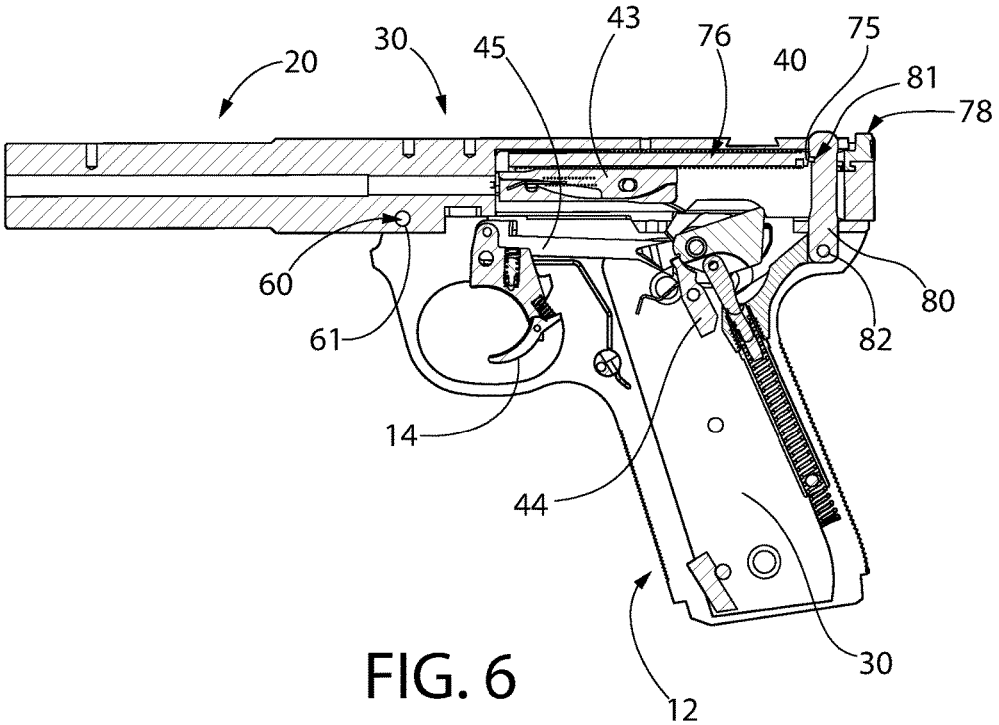
FIG. 6 is a side cross-sectional view thereof with the barrel-receiver assembly in a closed position.
Figure 7:
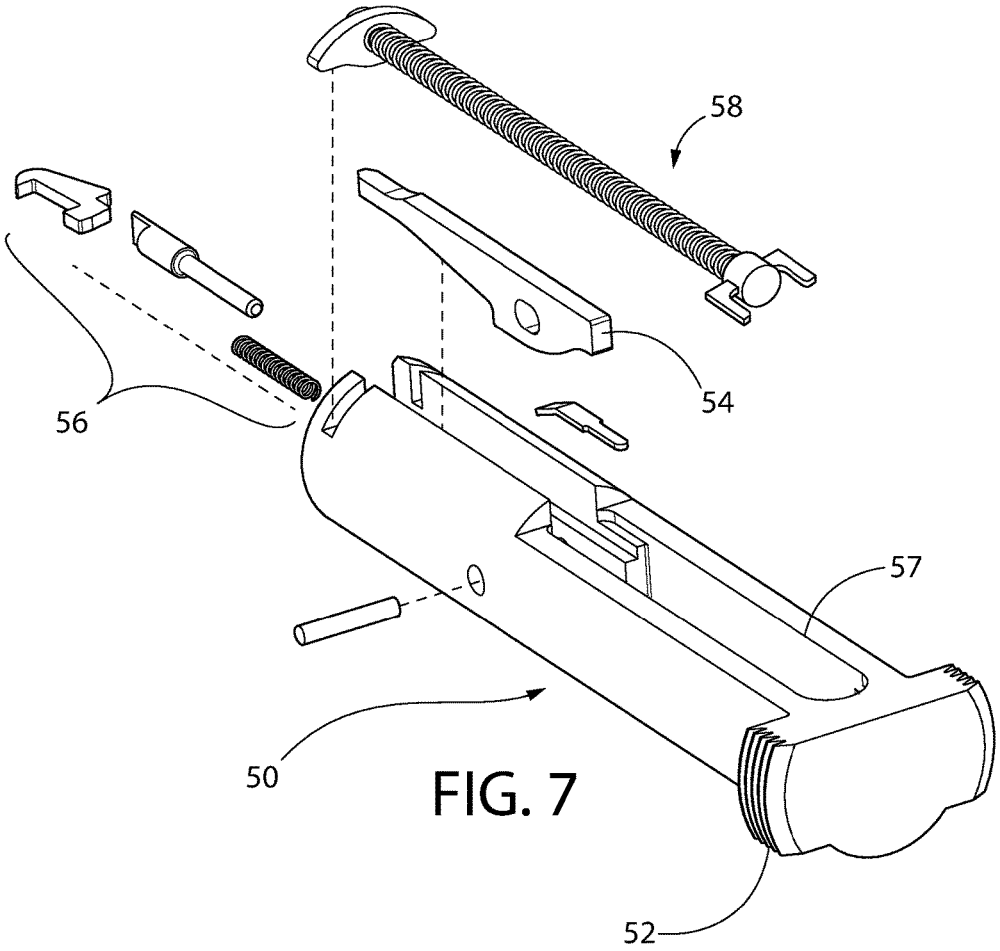
FIG. 7 is an exploded perspective view of an exemplary reciprocating bolt disposed in the barrel-receiver assembly of the pistol of FIG. 1.
Figure 8:
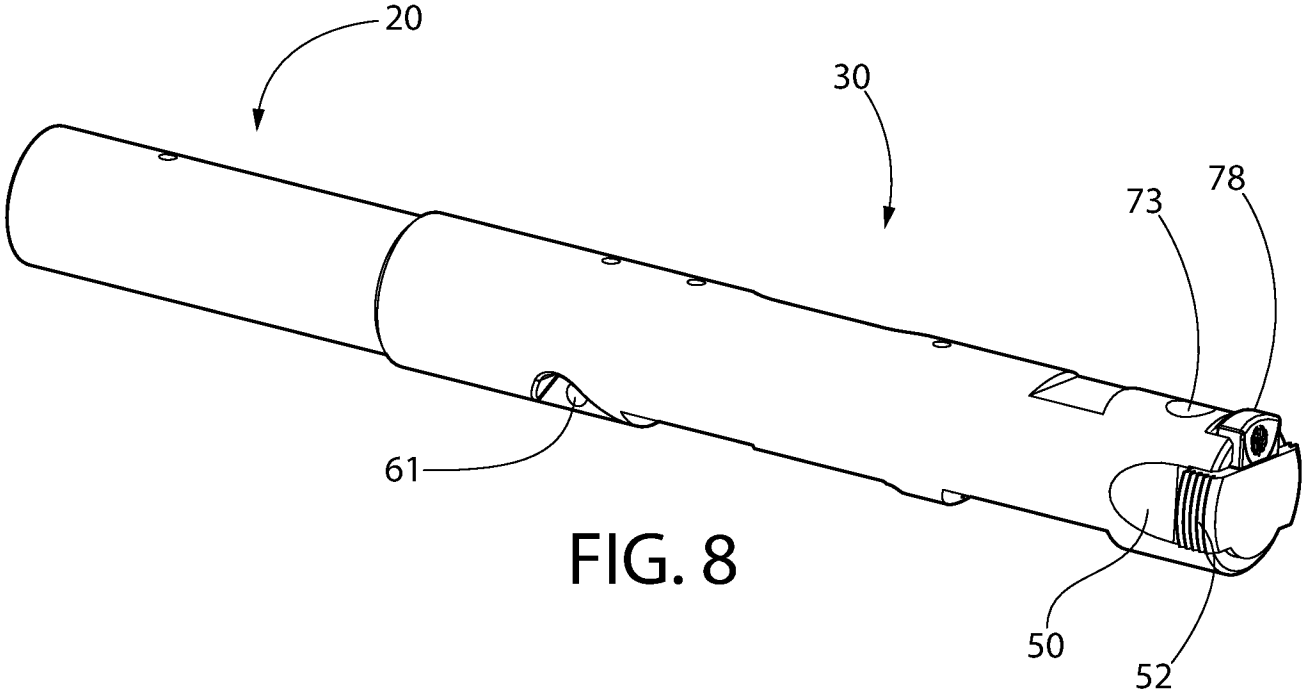
FIG. 8 is a perspective view of a barrel-receiver assembly and bolt slidably disposed therein.
Figure 9:
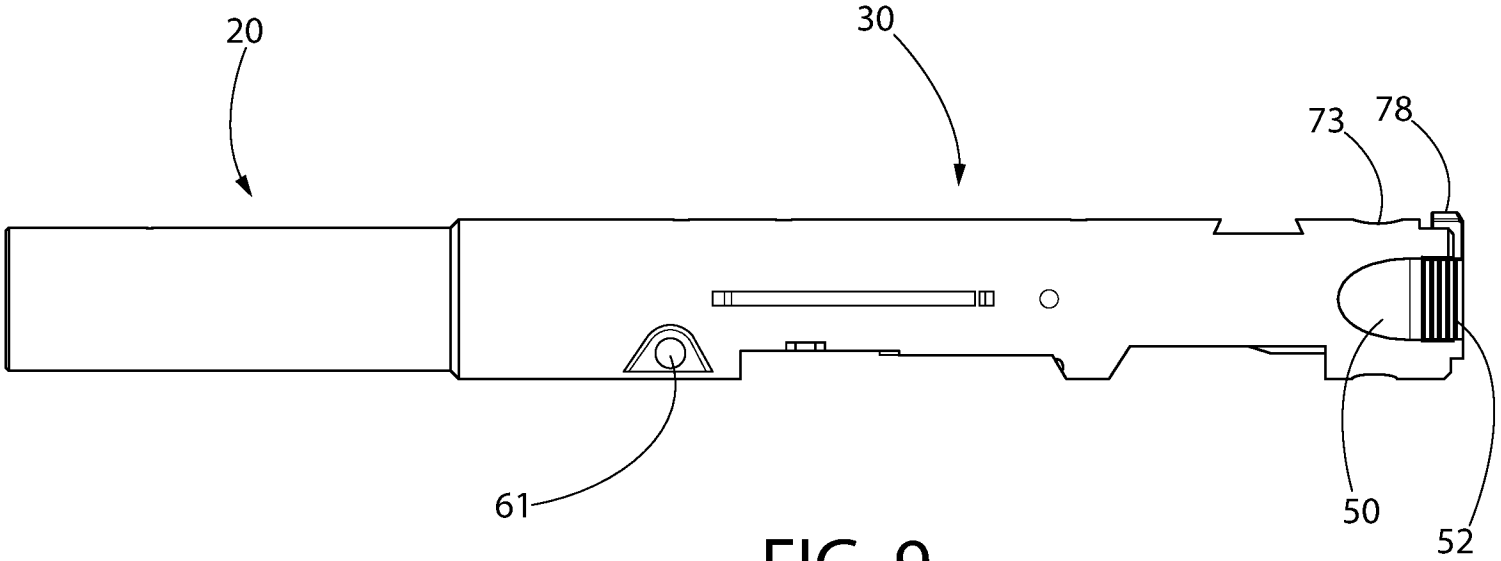
FIG. 9 is a side elevation view thereof.
Figure 10:
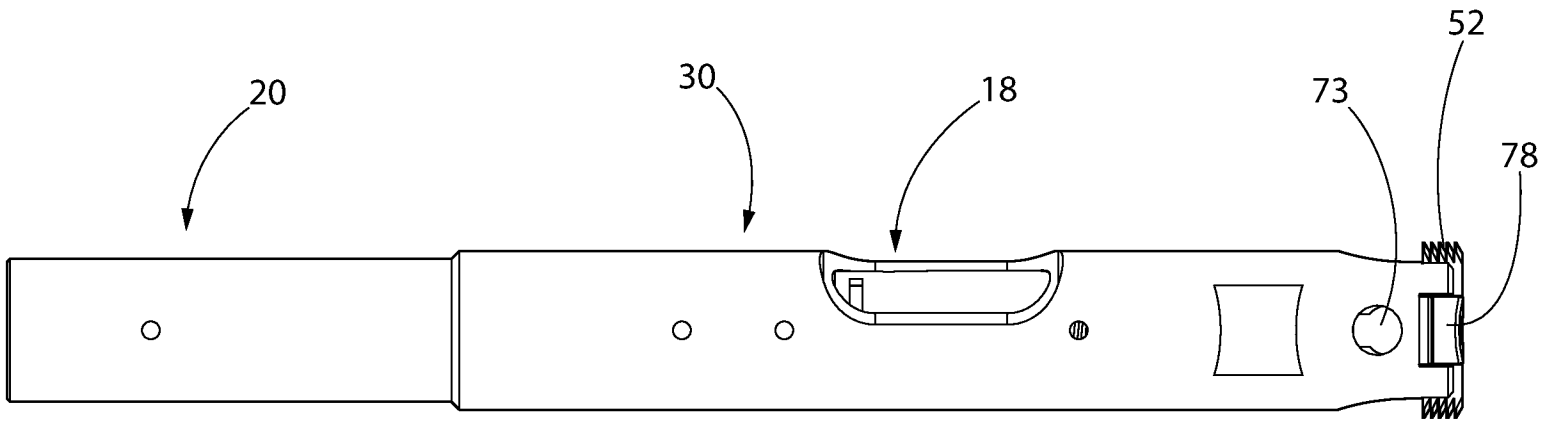
FIG. 10 is a top plan view thereof.
Figure 11:
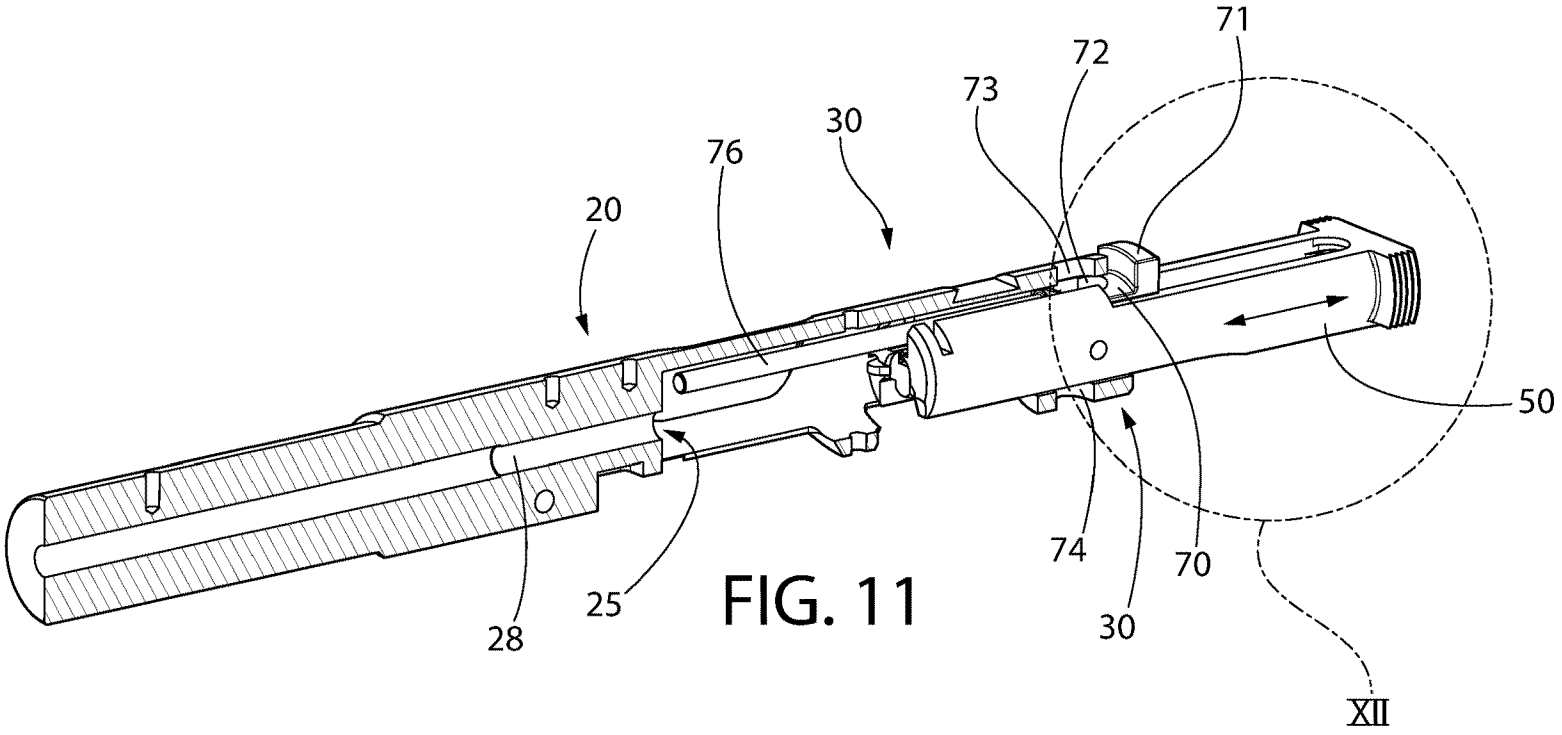
FIG. 11 is a side perspective cross-sectional view thereof.

A spring-biased reciprocating bolt 50 is provided having opposing laterally projecting bolt ears 52 at the rear for manually retracting the bolt (see, e.g. FIGS. 1-2 and 5-12). Bolt 50 is generally cylindrical in shape as best shown in FIG. 7 and slidably mounted inside receiver 30 for rearward and forward reciprocating movement in recoil upon discharging the pistol. The forward face of the bolt 50 defines the breech face. In some embodiments, bolt 50 is made of steel or an alloy thereof suitable for withstanding the combustion forces generated when detonating a cartridge while maintain a closed breech thereby supporting the rim area of the cartridge. Bolt 50 includes a firing pin assembly 54 for striking a chambered cartridge and a cartridge extractor assembly 56 as will be well known in the art (see, e.g. FIG. 7). In one embodiment, bolt 50 further includes an axially elongated slot 57 through which a bolt stop pin 80 projects (see FIGS. 6, 7, 11, and 15). This slot allows the bolt 50 to slide around and past the bolt stop pin 80 both forward/rearward during recoil or when manually opening the breech. The rear end of the slot 57 may be arcuately curved and serves as a bolt stop to limit the forward movement and position of the bolt 50 when the breech is closed.

In operation, pulling the trigger 14 releases the hammer which strikes and drives the firing pin forward to detonate the cartridge in the manner described above. This in turn drives the bolt 50 rearward (within the receiver 30 which remains axially fixed in position on grip frame 12) under the recoil forces to extract and eject the cartridge casing through an ejection port 18 in the side of the receiver 30. The bolt 50 is returned forward under the biasing force of a recoil spring 58. The foregoing type of bolt firing mechanism may be found, for example without limitation, in a Ruger Mark III pistol available from Sturm, Ruger & Company, Inc. of Southport, Conn. However, it will be noted that embodiments of a barrel system and bolt mechanism according to the present disclosure are expressly not limited in use to this particular pistol and may be applied with equal benefit to other type pistols and rifles.

FIGS. 1-12 show various views of the pistol, barrel-receiver assembly 20-30, and related components.

Barrel 20 includes an open front muzzle end 23 and an open rear end 25. Barrel 20 is axially elongated and defines a longitudinally-extending bore 22 extending therethrough that communicates with open ends 23, 25. Bore 22 may be rifled. The rear portion of barrel 20 defines a chamber 28 configured for holding a cartridge to properly support the cartridge casing when firing the pistol 10. In one non-limiting embodiment, the chamber 28 may be configured for holding rimfire type cartridges; however, in certain other embodiments the chamber may be configured for centerfire type cartridges. Both type cartridges are well known to those skilled in the art without further elaboration.

Receiver 30 may be an axially elongated and generally hollow cylindrical structure defining a longitudinally-extending internal cavity 38. Receiver 30 further includes an open front end 31, opposing open rear end 33, and an ejection port 18 (see FIGS. 1-12). Cavity 38 may be generally circular in cross section and may vary in diameter along the length of the receiver. Cavity 38 may extend axially completely through receiver 30 and communicate with open front and rear ends 31, 33 as shown. Open front end 31 of receiver 30 communicates with chamber 28 of the barrel 20 to load cartridges from a magazine (not shown for clarity) disposed in magazine well 13 of the grip frame 12 into the chamber and to extract spent cartridges for ejection through ejection port 18 of the receiver. Open rear end 33 allows the rear portion of reciprocating bolt 50 to alternatively project outwards from the receiver 30 under recoil and return at least partially back inside the receiver in a sliding axial motion. Receiver 30 further includes a bottom cartridge feed opening 38*c* that communicates with the magazine well for receiving cartridges from the magazine.

Barrel-receiver assembly 20/30 may be mounted in a pivotable and tilting manner to grip frame 12 via a suitable rotational coupling. The barrel-receiver assembly is angularly movable and pivotable between a closed operating (i.e. ready-to-fire) position (FIG. 1) and an open maintenance position (FIG. 2). In the closed position, the barrel-receiver assembly 20/30 and bore 22 of barrel 20 are coaxially aligned with the longitudinal axis LA of pistol 10. In the open position, the barrel-receiver assembly 20/30 and barrel bore 22 are disposed at an angle A1 to the longitudinal axis LA. Angle A1 may be between 0 and 90 degrees, and in some embodiments more than 90 degrees.

Advantageously, the tilting feature provides ready access to the pistol 10 components for inspection and maintenance without requiring the barrel-receiver assembly 20/30 and fasteners (e.g. screws, pins, etc.) to be dismounted from the grip frame 12 and then re-installed. In one embodiment, no tools are required to open and close the barrel-receiver assembly 20/30. This allows a user to readily open and inspect the pistol even in the field when ready access to tools (e.g. screwdriver, pin punch, hammer, pliers, etc.) may not be available.

In one arrangement, grip frame 12 includes an arcuately curved pivot surface which in one may be defined by a lateral pivot pin 60 which engages a transverse mounting hole 61 in barrel-receiver assembly 20/30 to rotationally couple the barrel-receiver assembly to the frame (see, e.g. FIGS. 1, 2, 5, and 6). In one embodiment, mounting hole 61 may be disposed proximate to the bottom of the barrel-receiver assembly. Pivot pin 60 defines a pivot axis for partially rotating and tilting barrel-receiver assembly 20/30. The pivot pin 60 may be positioned near the front top end of the trigger guard portion 12*a* of grip frame 12 so that the barrel-receiver assembly 20/30 may be pivoted or tilted without interference from the grip frame.

According to one aspect of the present invention, as shown in FIGS. 3-6, pistol 10 further includes a manually-operated latching mechanism 100 which is operable to lock and unlock the barrel-receiver assembly 20/30 to grip frame 12. In one embodiment, the latching mechanism may comprise an assembly of a spring-biased slide plate 70, spring 76, elongated spring guide rod 76, and actuator button 78. Rod 76 is longitudinally oriented and disposed in receiver 30. In one embodiment, without limitation, spring 77 may be a helical compression spring having coils disposed around the rod 76 which act on the front end of and biases a slide plate 70 axially rearwards towards engagement with bolt stop pin 80. Other suitable types of spring (e.g. torsion springs, etc.) may be used which provide similar operability.

The latching mechanism 100 is configured to selectively engage and disengage the grip frame 12 or an appurtenance thereof to (1) lock the pivoting barrel-receiver assembly 20/30 in the closed position on the grip frame during operation of the pistol (see, e.g. FIG. 1), and (2) to unlock the barrel-receiver assembly so that the assembly may be pivoted to the tilted open position (see, e.g. FIG. 2).

FIGS. 16-22 illustrate different views of a slide plate 70 with an integral actuator button 78.

Slide plate 70 is substantially horizontally oriented and may be laterally broadened with respect to adjoining portions of rod 76 as shown in one embodiment. Accordingly, slide plate 70 in some configurations may have a lateral width (measured transversely to longitudinal axis LA) which is larger than the diameter of rod 76. In one embodiment, slide plate 70 may have a slightly arcuately curved convex top surface 70*a* (best shown in FIG. 22) when viewed in lateral transverse cross-section to conform to the arcuately curved shape of the top of the tubular receiver 30. Other configurations of the slide plate are suitable and may be used such as a flat top surface for example.

Slide plate 70 is operated with and moved axially in a horizontal direction via actuator button 78, which may be located rearward of the plate in certain embodiments (see, e.g. FIGS. 1-6 and 8-12). In the embodiment shown, button 78 may be a unitary structural part of the slide plate disposed at the rear end of the slide plate. In other possible embodiments, the actuator button 78 may be a separate component rigidly coupled to the slide plate 70 by any suitable means (e.g. snap fit, shrink fit, welding/soldering, adhesives, fasteners, or other) so that sliding the button forward or rearward moves the slide plate 70 in unison therewith. Yet still in other embodiments, the button 78 may remain separate in construct from slide plate 70 and be slideably arranged in the receiver to engage the rear end of the slide plate.

Figure 3:
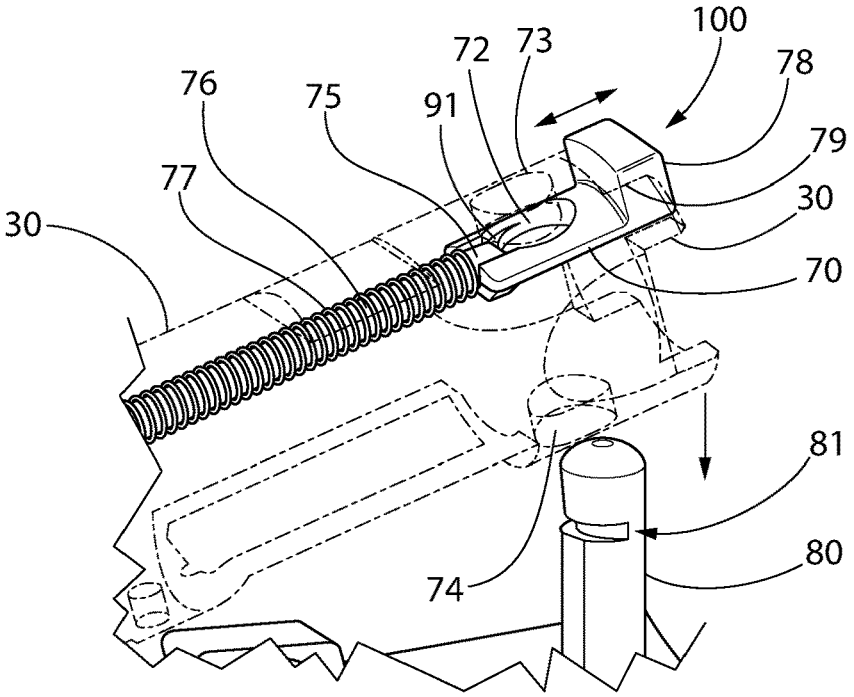
FIG. 3 is a close-up perspective view of a rear portion of the pistol in an open tilted position showing details of a latching mechanism, the receiver being shown in phantom lines.
Figure 4:
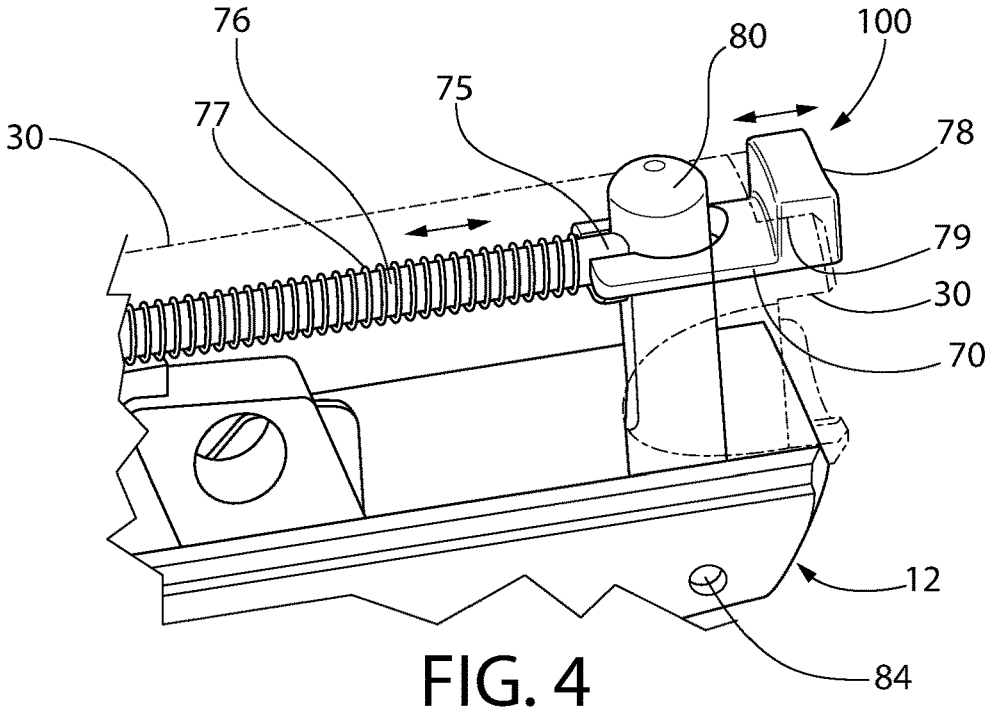
FIG. 4 is an perspective view thereof with the pistol in a closed position.
Figure 14:
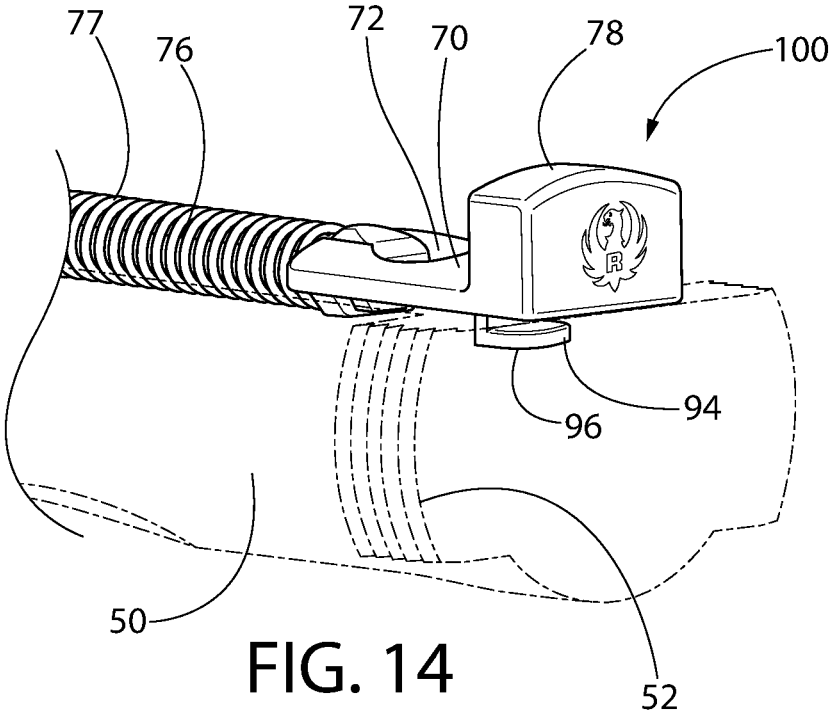
FIG. 14 is an enlarged perspective view of the slide plate with integral operating button and rear end of the bolt shown in phantom lines.
Figure 15:
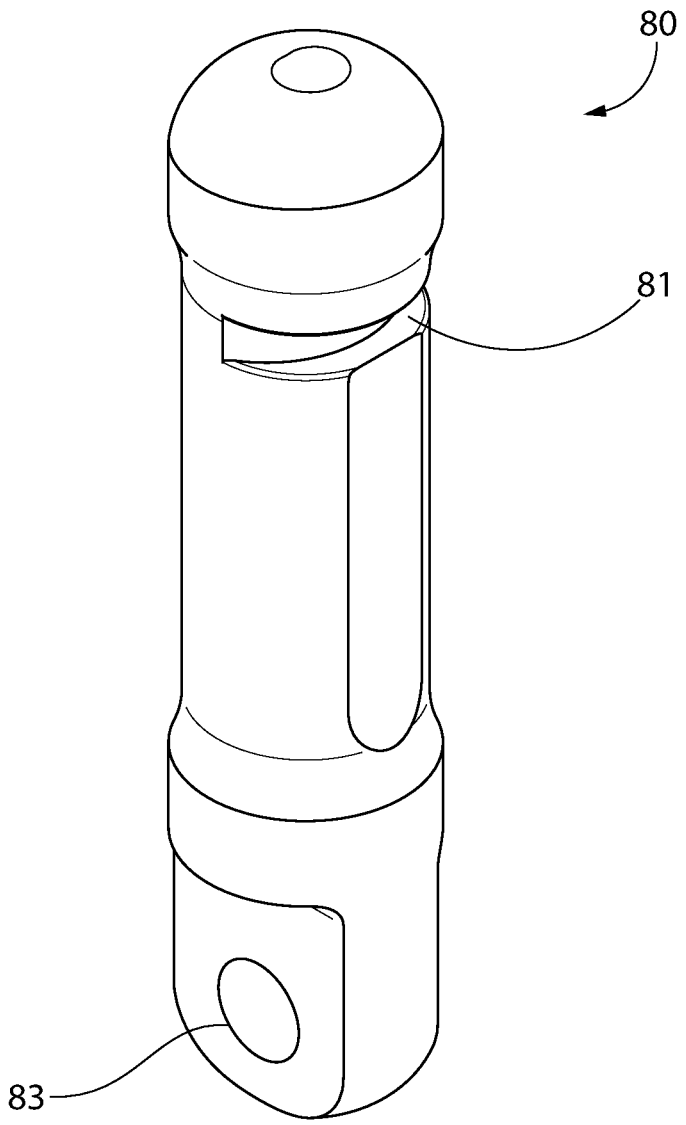
FIG. 15 is a perspective view of latch pin.
Figure 16:
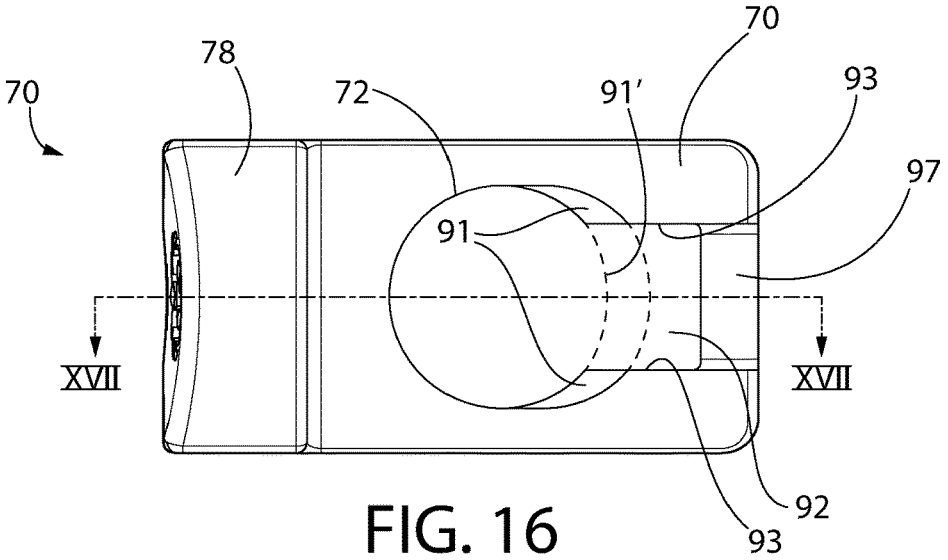
FIG. 16 is a top plan view of the slide plate with integral operating button.

FIGS. 23-27 illustrate different views of the spring guide rod 76. Referring to these figure and FIGS. 3-6, and 14, spring guide rod 76 includes a forward end 98 and opposing rear end 75 configured and arranged to engage the front end of slide plate 70. The rod 76 may be formed as ether an integral unitary structural part of slide plate 70 or alternatively may be a separate component attached to the slide plate. In the latter embodiment, rear end 75 of rod 76 in one configuration may detachably engage the front end of slide plate 70 via a generally snug, but non-permanent connection as shown in FIGS. 3-4 and 14. To create this type of connection, slide plate 70 may include a cross-bar 97 (see, e.g. FIGS. 16-22) spanning laterally across the front end of the actuator button 78 in a direction transverse to longitudinal axis LA when the latching mechanism 100 is mounted in the receiver 30. The rear end 75 of rod 76 may include a hook 99 configured to engage cross-bar 97. A downwardly open slot 101 is formed adjacent and forward of the hook which receives the cross-bar 97 at least partially therein when the hook 99 latches over the cross-bar. The spring 77 which engages the front end of the slide plate 70 keeps the hook 99 engaged with the cross-bar 97.

In other embodiments in which the spring guide rod 76 and slide plate 70 are separate components, the slide plate 70 may be affixed to the rear end 75 of the rod via other suitable mechanical attachment means including without limitation a snap fit, shrink fit, welding/soldering, adhesives, fasteners, or other suitable method.

The slide plate 70 with integral actuator button 78 assembly may be slidably supported by receiver 30 in a rearwardly open elongated channel 79 for rearward and forward axial movement when manually and selectively operated by a user. The actuator button 78 is biased in a rearward axial direction by the slide plate 70 which is urged in the same rearward direction by spring 77, as described herein. The slide plate 70 is axially movable via the actuator button 78 between a forward unlocked axial position of the slide plate disengaged from the grip frame 12 (see, e.g. FIG. 3) and a rearward locked axial position (see, e.g. FIG. 4) engaged with the grip frame. In one embodiment, slide plate 70 may disposed proximate to the rear end 33 of receiver 30 opposite the pivot axis of the barrel-receiver assembly 20/30 at the distal front end 31 of the receiver.

In a locked position shown in FIGS. 4 and 6, slide plate 70 is configured and operable to lockingly engage a forward facing locking slot 81 formed in the grip frame 12. Slot 81 may be formed in a protrusion on grip frame 12 such as without limitation a vertically oriented latch pin mounted to the frame. In the embodiment shown and described herein, the bolt stop pin 80 may also serve as the latch pin thereby combining the dual functions of a latch pin for latching the barrel-receiver assembly 20/30 in the closed position and also as a bolt travel stop for limiting the forward movement and position of the bolt 50 with respect to the barrel 20 and receiver 30. Advantageously, this conserves valuable space within the barrel-receiver assembly 20/30 allowing a more compact pistol platform to be offered. In other possible embodiments contemplated, however, a separate latch pin with locking slot and a bolt stop pin may be provided. The locking slot 81 may be horizontally oriented to engage the horizontally oriented slide plate 70.

Referring to FIGS. 1-6 and 15, bolt stop pin 80 may have a cylindrical body in one embodiment. Bolt stop pin 80 may be metal and affixed to the grip frame 12 of the pistol 10 by any suitable means. In one non-limiting embodiment, bolt stop pin 80 may be fixed to grip frame 12 via a lateral mounting pin 82 inserted through opposing holes 84 formed in the sides of the frame (see FIG. 4). The bolt stop pin 80 includes a pin hole 83 for inserting the mounting pin 82 therethrough. Hole 83 may be formed at any suitable location in the bolt stop pin, such as without limitation proximate to the bottom end of the bolt stop pin as shown. The frame 12 is configured to engage the bolt stop pin 80 to prevent the pin from rotating about mounting pin 82, thereby keeping the pin 80 in a stationary position with respect to the frame.

In preferred but non-limiting embodiments, the bolt stop pin 80 may be affixed to the grip frame 12 in a rigid manner which essentially forms a stiff upright post for securely anchoring the barrel-receiver assembly 20/30 in the closed locked position to the frame. This rigid attachment of the bolt stop pin 80 is also advantageous because the bolt stop pin may serve the dual function of both a barrel-receiver assembly 20/30 latch pin and a bolt travel stop which abuttingly engages and arrests the forward return movement of the bolt 50 under recoil after firing the pistol. When the slide plate 70 is in the locked position, the mutual engagement between the slide plate 70 and slotted bolt stop pin 80 prevents the barrel-receiver assembly 20/30 from being tilted upwards about the pivot axis near the front trigger guard portion 12*a* of the grip frame when operating the pistol in firing mode.

The locking slot 81 may be formed proximate to the top end of the bolt stop pin 80 to engage the slide plate 70 disposed in the upper portion of the receiver above the longitudinal cavity 38. The top end of the bolt stop pin 80 may be convexly rounded to facilitate reinsertion back through the locking aperture 72 of the slide plate 70 when closing the barrel-receiver assembly 20/30.

The locking aperture 72 in slide plate 70 in one configuration is configured and arranged to engage a portion of slide plate 70 that is immediately forward of the aperture with the slot 81 in bolt stop pin 80. The locking aperture 72 may be formed as a circular hole in one embodiment which extends vertically completely through slide plate 70 between its top and bottom surfaces. Accordingly, aperture 72 lies substantially in the horizontal plane. The bolt stop pin 80 is insertable vertically through aperture 72 of slide plate 70. When in the locked position as shown in FIGS. 4 and 6, a top end portion of bolt stop pin 80 may protrude upwards beyond the top surface of the slid plate 70 and in some embodiments beyond the top surface of the receiver 30. In one embodiment, receiver 30 may include a pair of vertically spaced apart holes 73 and 74 best shown in FIG. 3 which are concentrically alignable with aperture 72 of slide plate 70 when the barrel-receiver assembly 20/30 is in the locked position in which the bolt stop pin 80 extends vertically through the receiver 30 (see, e.g. FIG. 4). This helps anchor the receiver 30 in the closed locked position via the slide plate 70 which is in turn anchored to the receiver forming a slideably movable locking surface disposed in the receiver.

Figure 17:
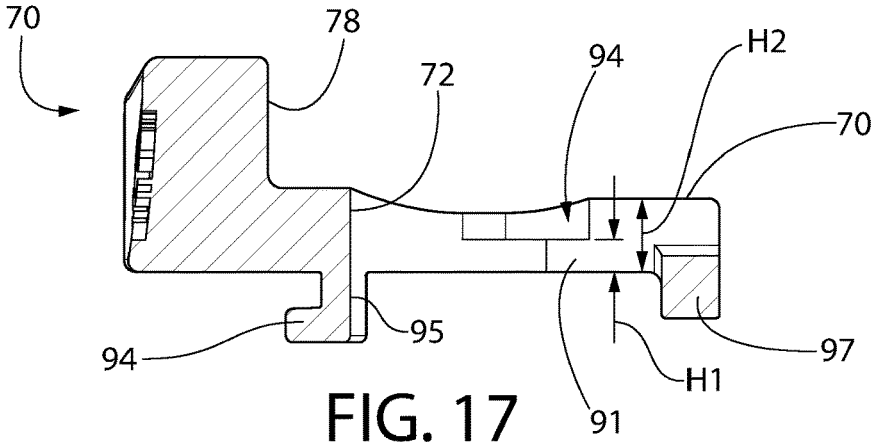
FIG. 17 is side cross-sectional view thereof taken along lines XVII-XVII in FIG. 16.
Figure 18:
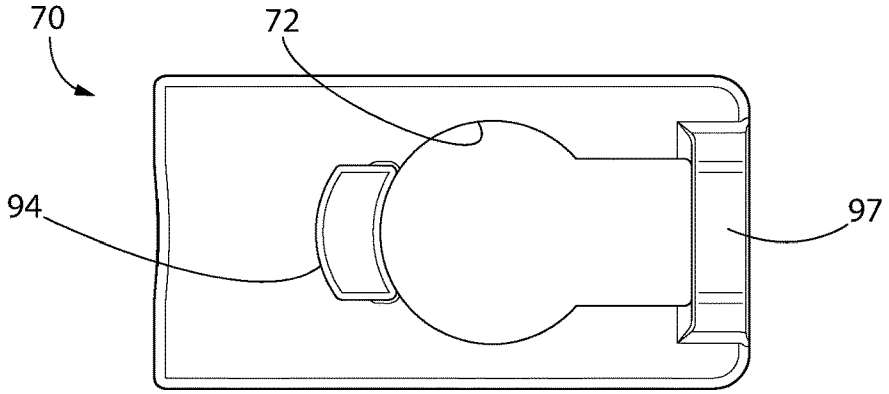
FIG. 18 is a bottom plan view thereof.
Figure 20:
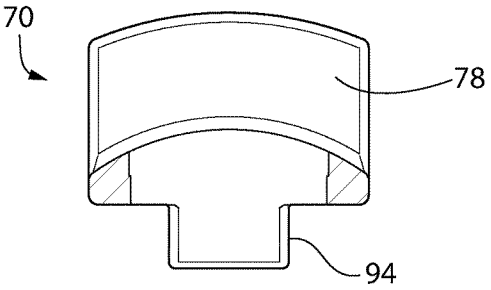
FIG. 20 is a cross-sectional view of taken along lines XX-XX in FIG. 19.
Figure 22:
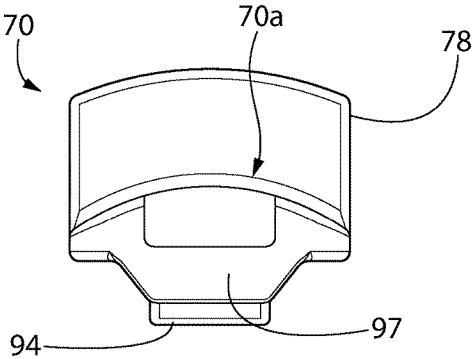
FIG. 22 is a front end view thereof.
Figure 19:
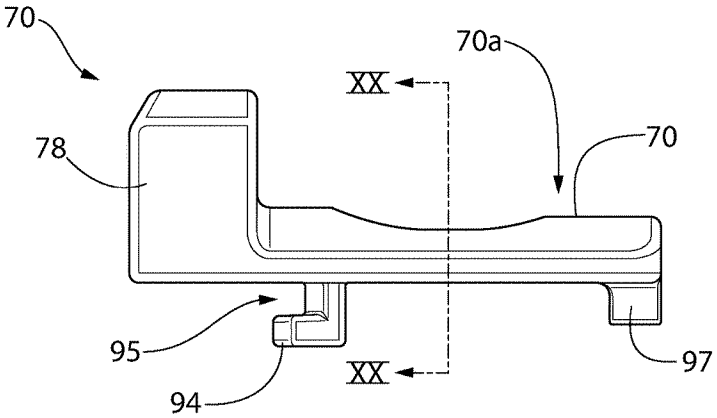
FIG. 19 is a side elevation view thereof.
Figure 21:
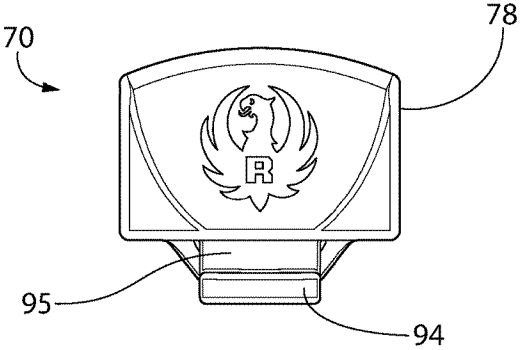
FIG. 21 is a rear end view thereof.
Figure 23:
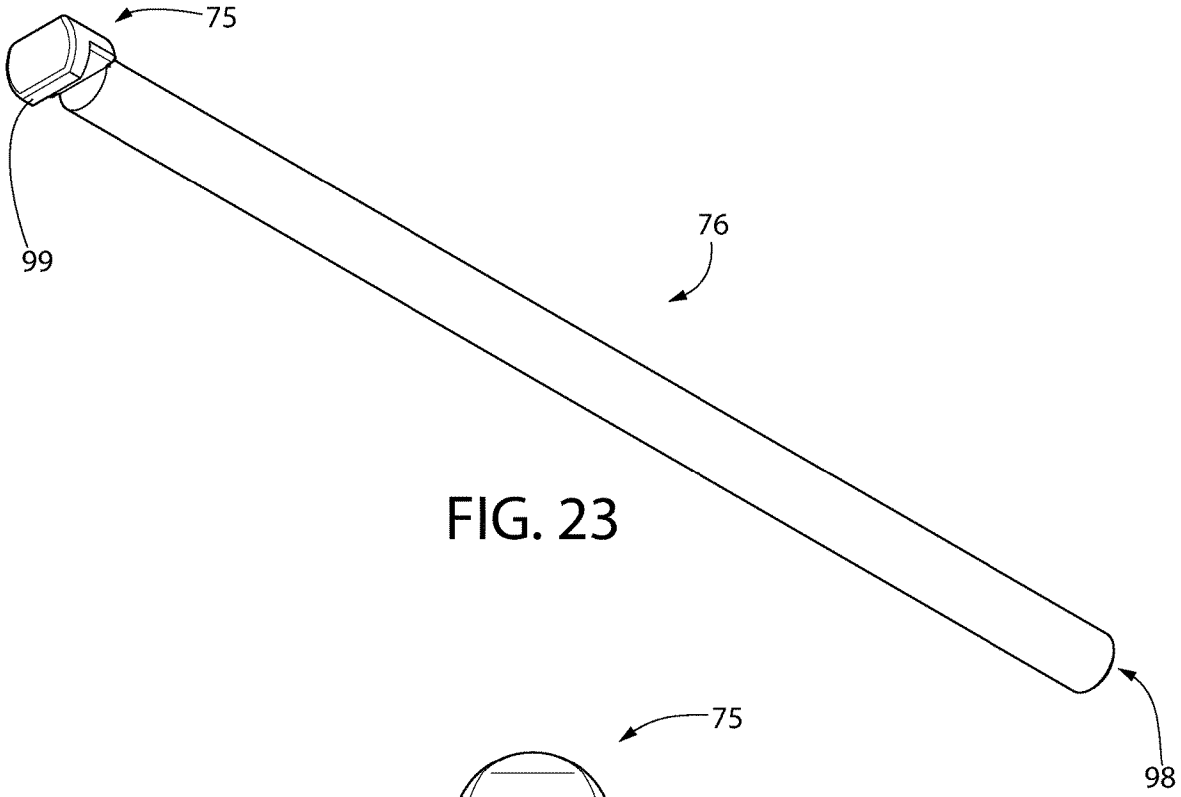
FIG. 23 is a bottom perspective view of a spring guide rod of the latching mechanism.
Figure 24:
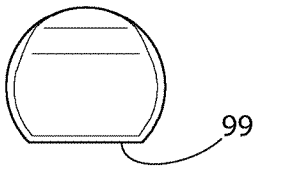
FIG. 24 is a rear end view thereof.
Figure 25:
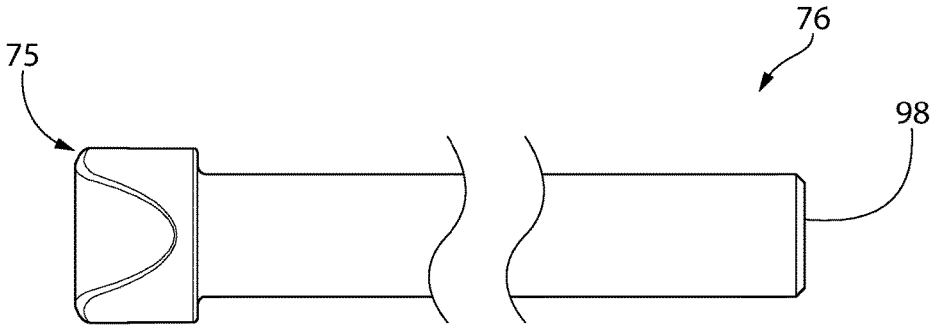
FIG. 25 is a top plan view thereof.
Figure 26:
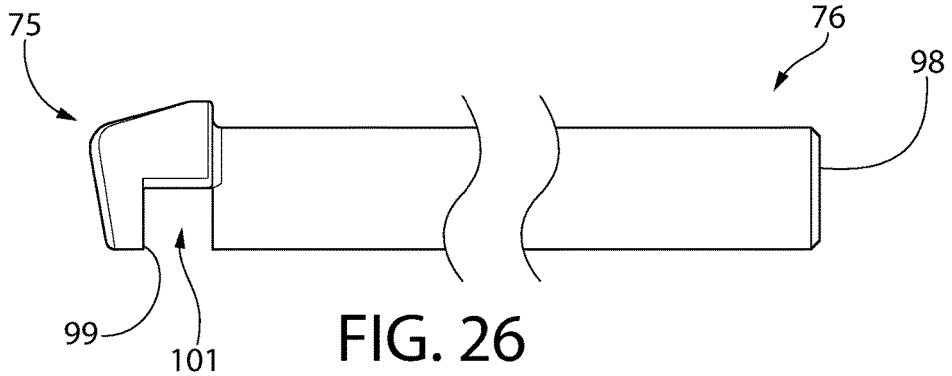
FIG. 26 is a side elevation view thereof.
Figure 27:
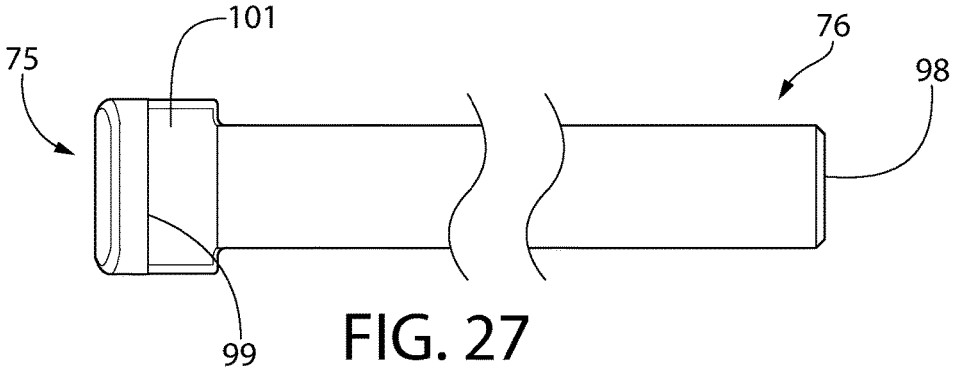
FIG. 27 is bottom plan view thereof.

Referring now to FIGS. 16-22, the locking portion of the slide plate 70 may be disposed forward of the actuator button 78 portion. The locking aperture 72 includes a pair of laterally spaced apart protruding locking ledges 91 which are configured and arranged to engage locking slot 81 of bolt stop pin 80 (see also FIG. 15). The ledges 91 project laterally inwards and rearward into locking aperture 72. Ledges 91 have a height H1 less than the height H2 of the slide plate 70 as best shown in FIG. 17. In this non-limiting embodiment, the ledges 91 have an arcuate shape and are spaced apart less than the diameter of the bolt stop pin 80 to engage the locking slot 81. In this arrangement, an open channel 92 is formed in slide plate 70 which is in communication with the forward portion of the locking aperture 72 to allow a part of the bolt stop pin 80 to enter the rear of the channel when the locking ledges 91 engage the locking slot 81. The channel 92 may be defined by opposing parallel straight sides 93 of the slide plate 70.

In an alternative embodiment, a single continuous arcuately shaped locking ledge 91' may be provided (represented in FIG. 16 by dashed lines) which is arranged to engage locking slot 81 of bolt stop pin 80. Such a ledge may be formed by simply joining the pair of ledges 91 with a central bridge piece having the same curvature to form a continuous arc in configuration. The channel 92 may optionally be omitted altogether in such an embodiment.

It will be appreciated that numerous other configurations of the slide plate 70 may be provided to selectively engage and disengage the locking slot 81 of bolt stop pin 80. It will further be appreciated that the latching mechanism may have other various configurations and is expressly not limited by the exemplary embodiments shown and described herein.

Figure 12:
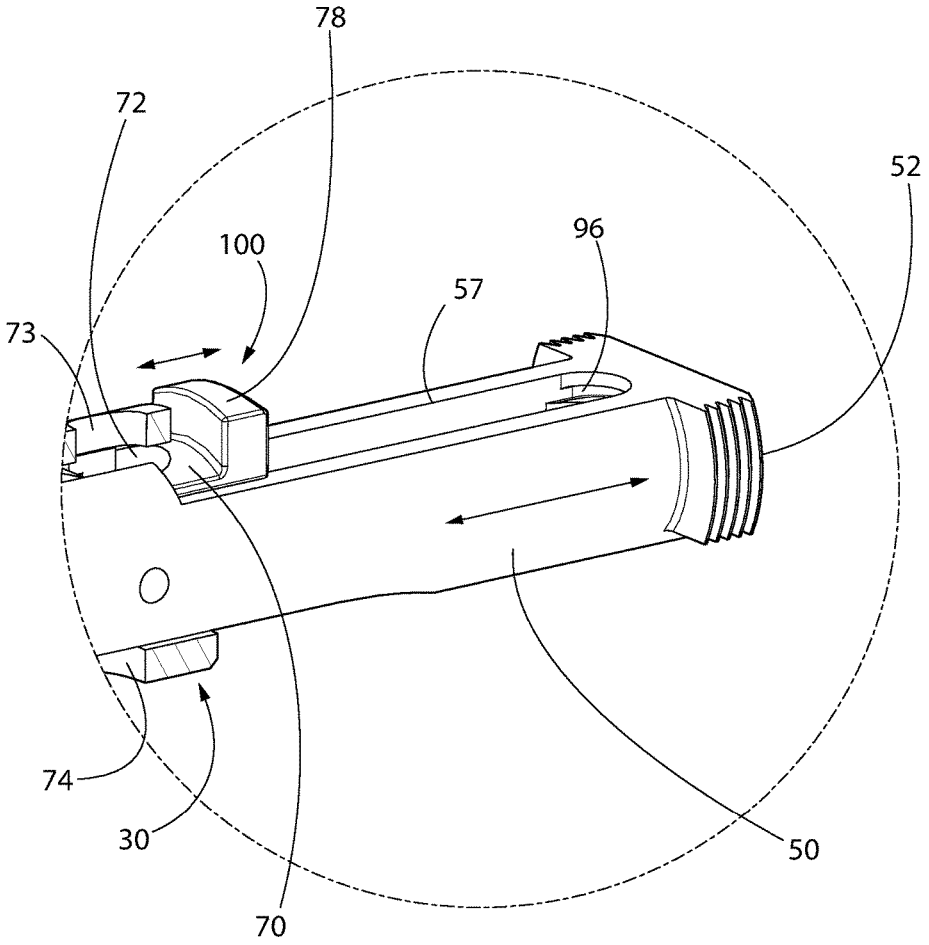
FIG. 12 is an enlarged perspective view of the rear end of the bolt and receiver thereof.
Figure 13:
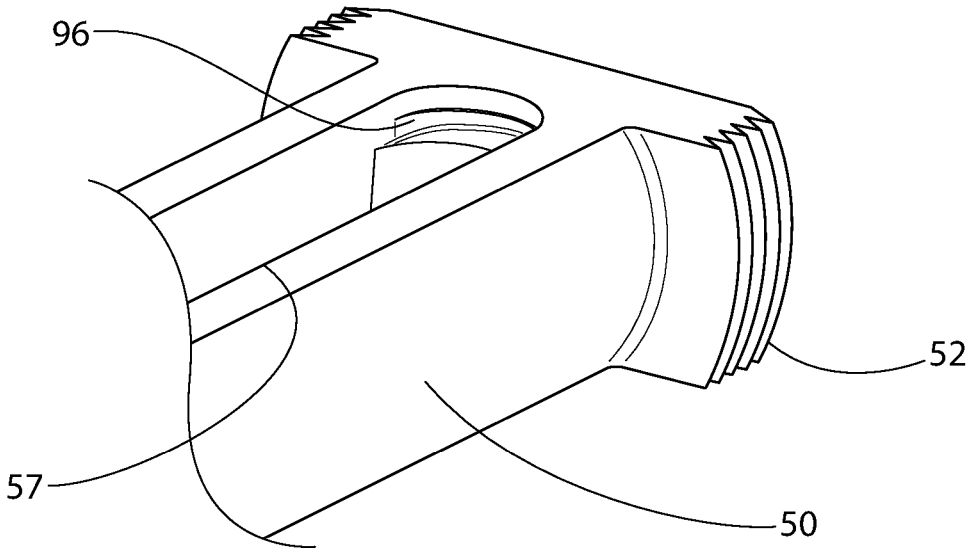
FIG. 13 is an enlarged perspective of the rear end of the bolt showing a socket.

With continuing reference to FIGS. 16-22 and further to FIGS. 12-14, slide plate 70 with actuator button 78 may include a tab 94 which is configured and arranged to engage a pocket 96 formed in the bolt 50. This arrangement helps maintain positive engagement between rear end of the slide plate 70 with the bolt 50 (when the bolt is locked during firing to form a closed breech) to prevent the rear end of the slide plate from popping up under the biasing action of the spring 77 on the slide plate and initial recoil forces. In one embodiment, the tab 94 projects rearward from and is an integral part of an L-shaped protrusion 95 projecting downwards from actuator button 78 behind the locking aperture 72. The pocket 96 is formed in the rear end of the bolt intermediate to the pair of bolt ears 52 behind slot 57. When the pistol 10 is fired, the bolt 50 travels rearward under recoil and the tab 94 leaves the pocket 96 as the breech is opened. The receiver interacts with the slide plate 70 to keep it in position during this time. When the bolt is eventually returned forward by recoil spring 58 (see FIG. 7), the tab 94 re-enters the pocket 96 and the breech is closed.

In some embodiments, without limitation, spring guide rod 76, slide plate 70, and bolt stop pin 80 may be made of a suitable metal and/or combination of metals such as without limitation steel including stainless steel, titanium, and or aluminum. In other possible embodiments, some or all of these components or portions thereof may be made of non-metallic materials such as without limitation unfilled or glass reinforced polymers.

In some illustrative embodiments, without limitation, barrel 20 may be made of a metal with suitable toughness and durability to withstand the combustion pressures and temperatures generated when firing the pistol. In some embodiments, without limitation, barrel 20 may be made of a suitable steel and alloys thereof. In configurations where the barrel-receiver assembly 20/30 is formed as a single monolithic and unitary structure, the receiver 30 is integral with the barrel 20 and formed of the same material. In other possible embodiments, where the barrel 20 and receiver 30 are formed as separate components which are mechanically joined together (e.g. threaded or interlocked connections, etc.), the receiver 30 may be made of a different material than the barrel such as relatively lighter-weight metal including aluminum, titanium, and alloys thereof to reduce the overall weight of the pistol 10. In one embodiment, receiver 30 may be made of 6061-T6 aluminum.

An exemplary method for opening and closing barrel-receiver assembly 20/30 of pistol 10 will now be described.

Referring to FIG. 1, barrel-receiver assembly 20/30 is shown in a downward closed and ready-to-fire operating position. Sliding plate 70 is in the rearward locked position engaged with locking slot 81 of bolt stop pin 80. To break open the barrel-receiver assembly for maintenance or other purposed, the slide plate actuator button 78 is first manually moved axially forward toward the muzzle end 23 of barrel 20. The actuator button 78, which acts on a rear end of the slide plate 70, pushes the slide plate in turn forward to the unlocked position. The slide plate 70 becomes disengaged from locking slot 81 of bolt stop pin 80 and frees the barrel-receiver assembly 20/30 to be moved pivotally with respect to the grip frame 12 of pistol 10 about pivot pin 60.

Next, the barrel-receiver assembly 20/30 is pivoted upwards and forward (counter-clockwise as shown in FIGS. 2, 3, and 5) about pivot pin 60. The rear end of the receiver 30 is displaced and vertically moved apart from the rear end of the grip frame 12. Barrel-receiver assembly is now in the upward angled open position. Barrel-receiver assembly 20/30 is tilted and angled with respect to the longitudinal axis of the pistol 10 in which bolt stop pin 80 is now disengaged completely from barrel-receiver assembly 23/30. The barrel-receiver assembly and portions of the grip frame 12 containing the firing mechanism and hammer assembly are now fully accessible to a user for inspection and maintenance.

To then close the barrel-receiver assembly 20, 30, the barrel-receiver assembly is pivoted downwards and rearward (clockwise as shown in FIGS. 1, 5, and 6) about pivot pin 60. The underside of slide plate 70 first engages the top of the bolt stop pin 80, which in one non-limiting embodiment may be rounded as shown. This automatically slides the slide plate 70 forward slightly against the biasing force of spring 77 so that the top portion of the bolt stop pin 80 may enter aperture 72 in the slide plate. Once the rear end of the slide plate 70 is axially aligned with locking slot 81 of bolt stop pin 80, the spring-biased slide plate will be free to move rearward and snap into the locking slot. Simultaneously, the bottom rear end of the receiver 30 abuttingly contacts and becomes fully seated on the top rear end of grip frame 12. Barrel-receiver assembly 20/30 is now returned to its closed and ready-to-fire operating position.

Latching System Alternative Embodiment

FIGS. 28-55 disclose an alternative embodiment of a latching system for a pistol including pivoting/tilting barrel-receiver assembly that provides ready access to the firing mechanism for maintenance or inspection. In one implementation, the latching system includes an interlock mechanism which prevents the barrel-receiver assembly from being opened when the pistol is in the ready-to-fire condition.

Figure 28:
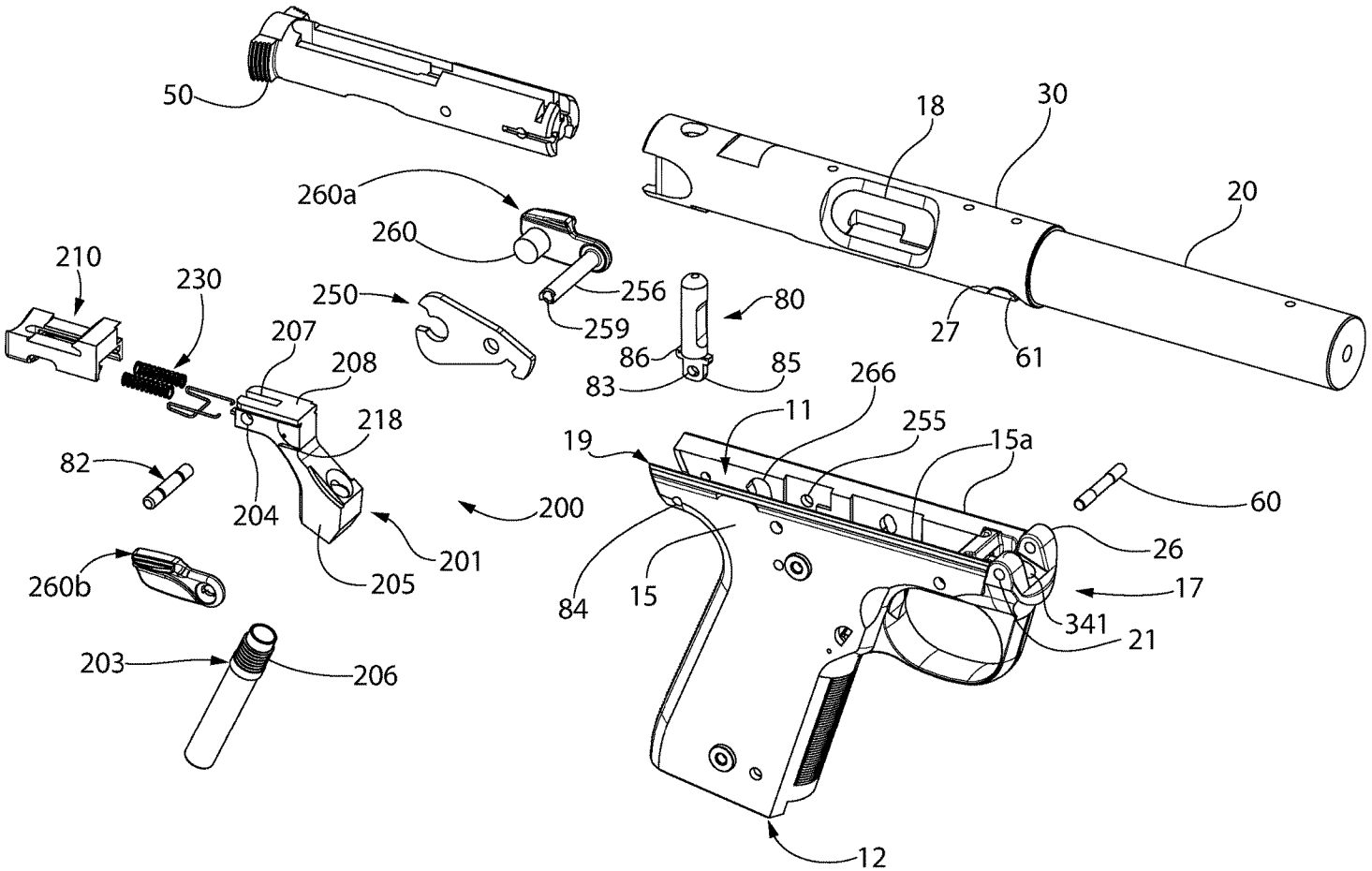
FIG. 28 is an exploded diagram of the pistol with an alternative embodiment of a latching system.
Figure 29A:
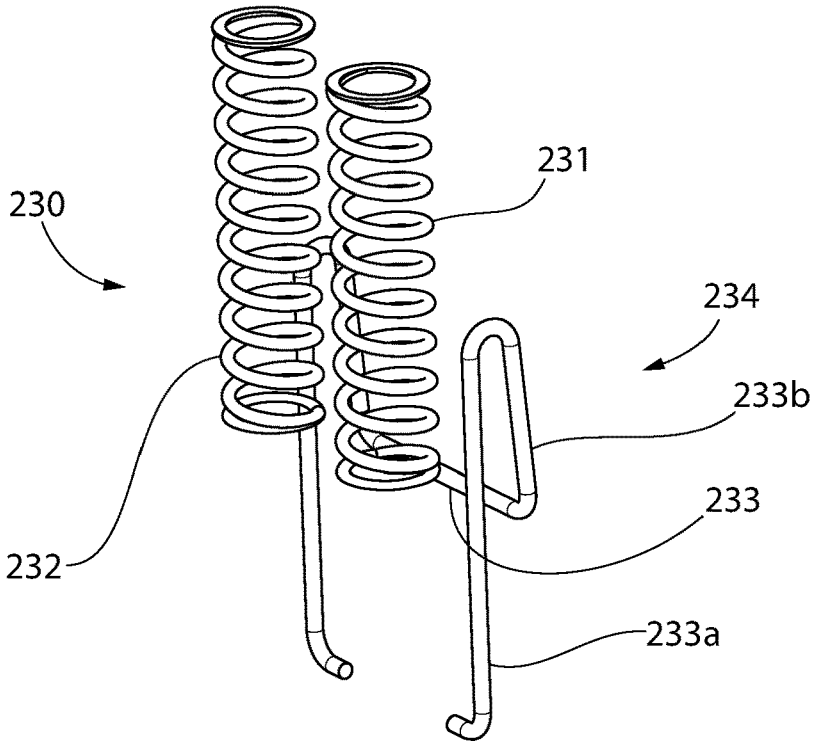
FIGS. 29A-D are various views of the latch spring thereof.
Figure 29B:
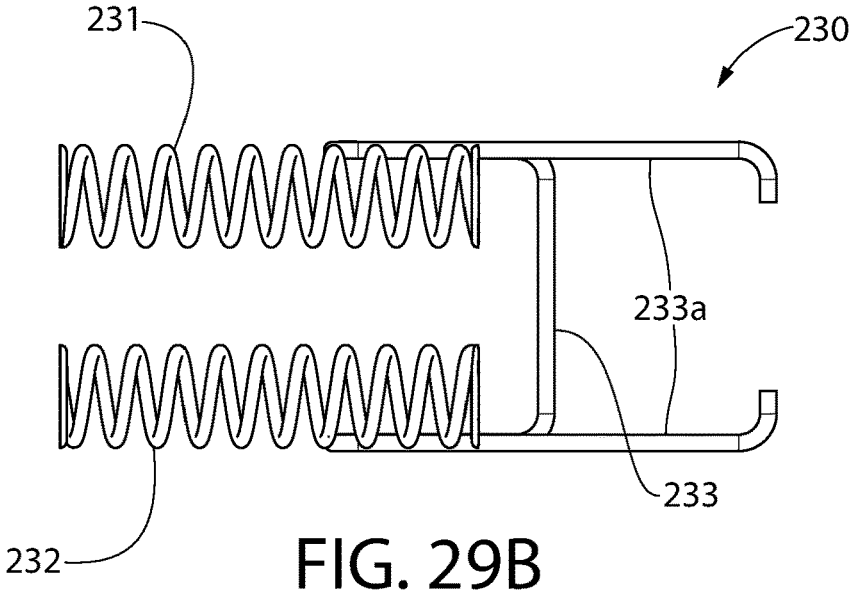
Figure 29C:
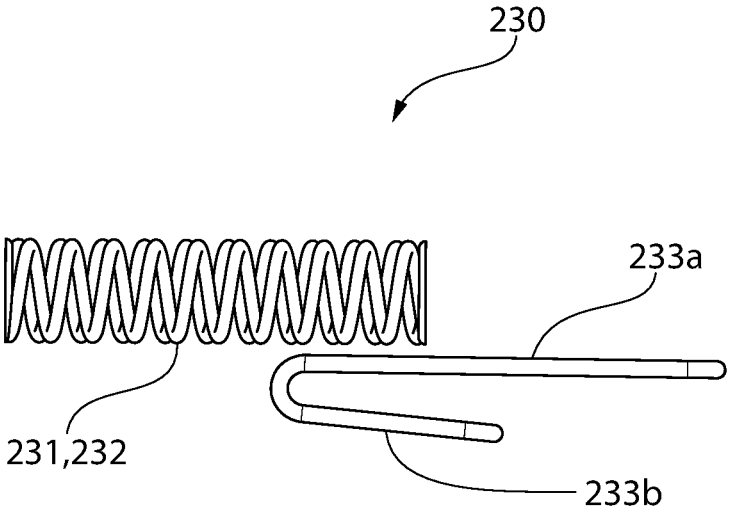
Figure 29D:
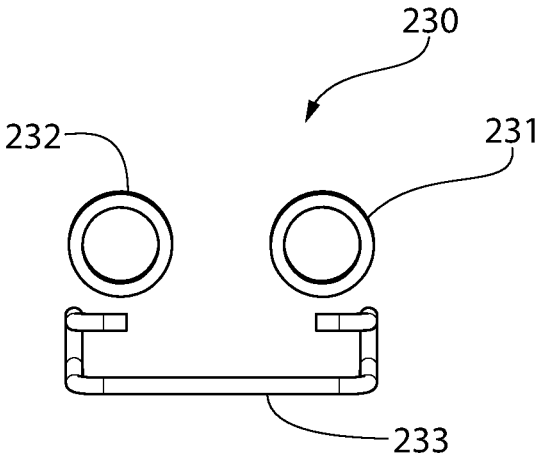
Figure 30A:
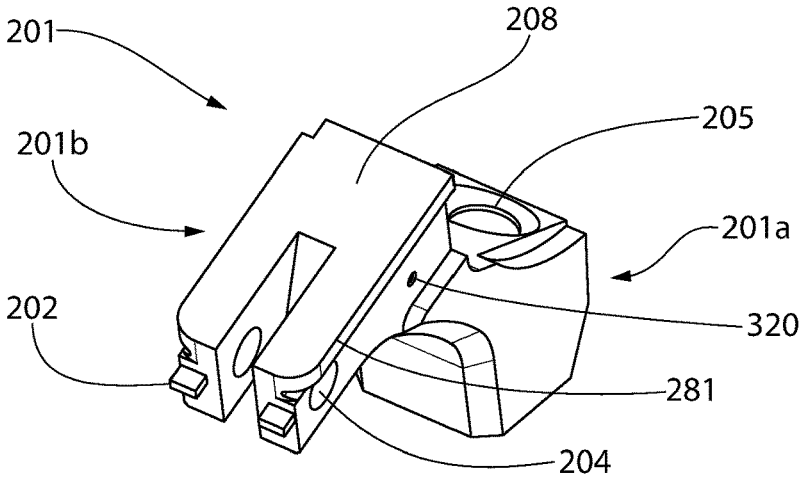
FIGS. 30A-K show various views of a main spring housing which interacts with the alternative latching system of FIG. 28.
Figure 30B:
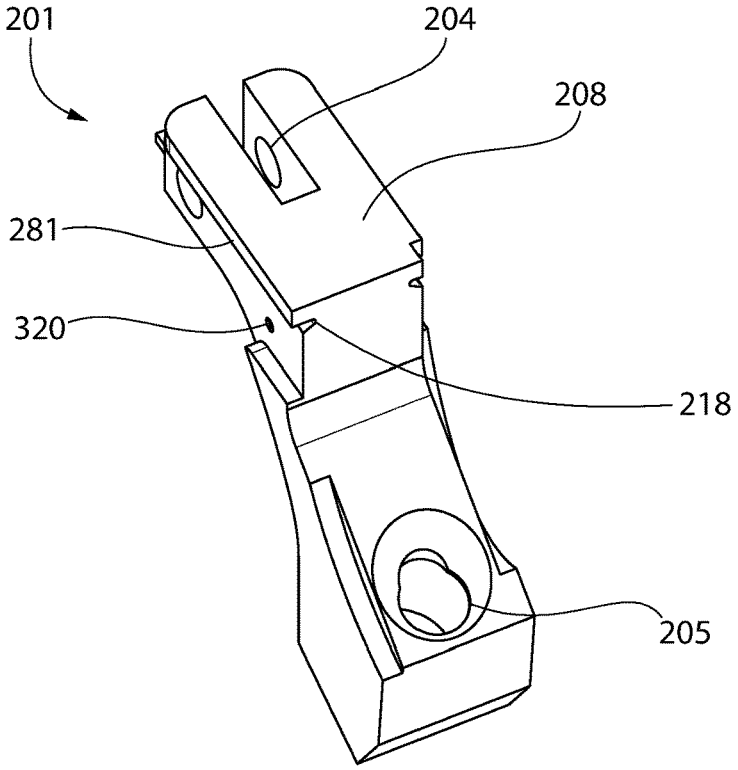
Figure 30C:
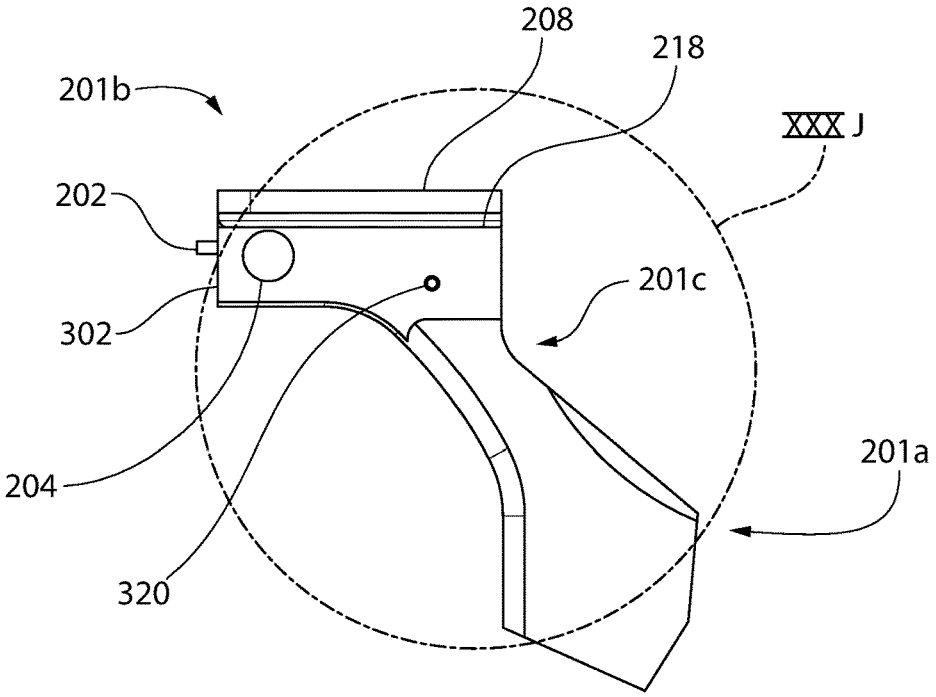
Figure 30D:
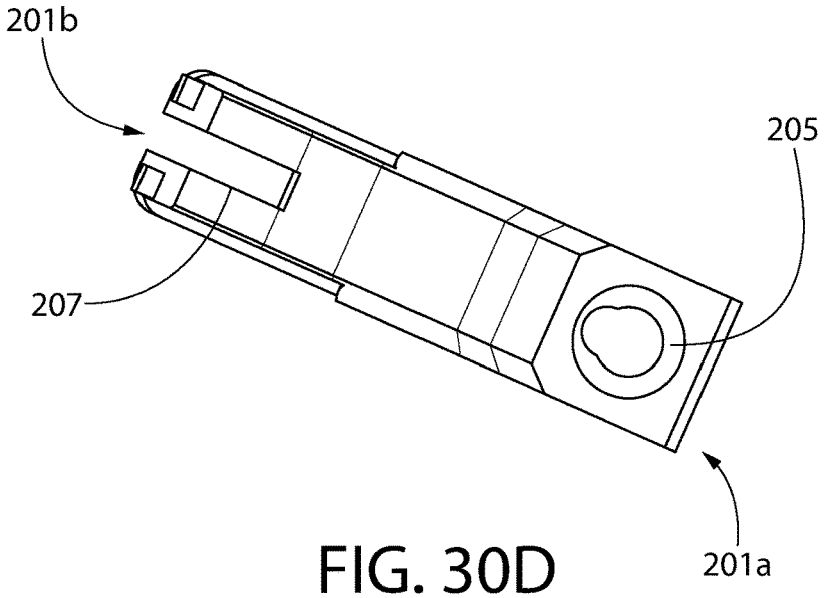
Figure 30E:
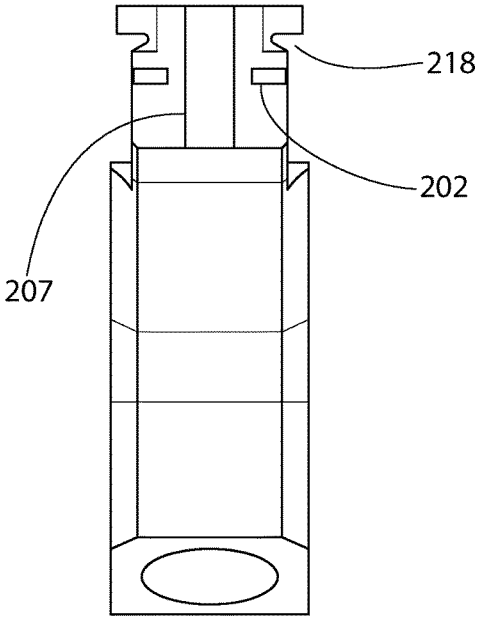
Figure 30F:
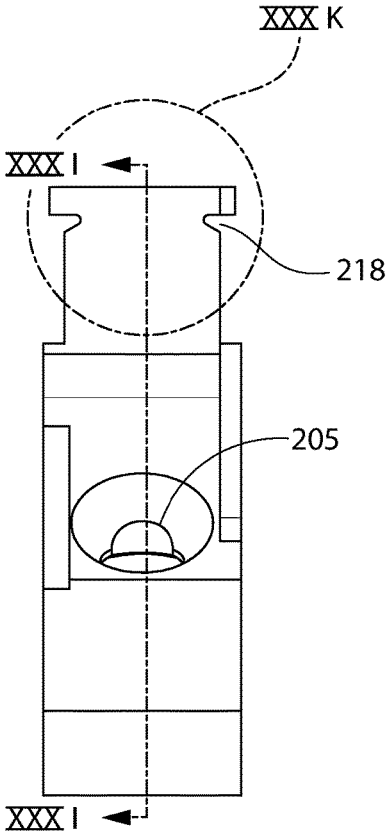
Figure 30G:
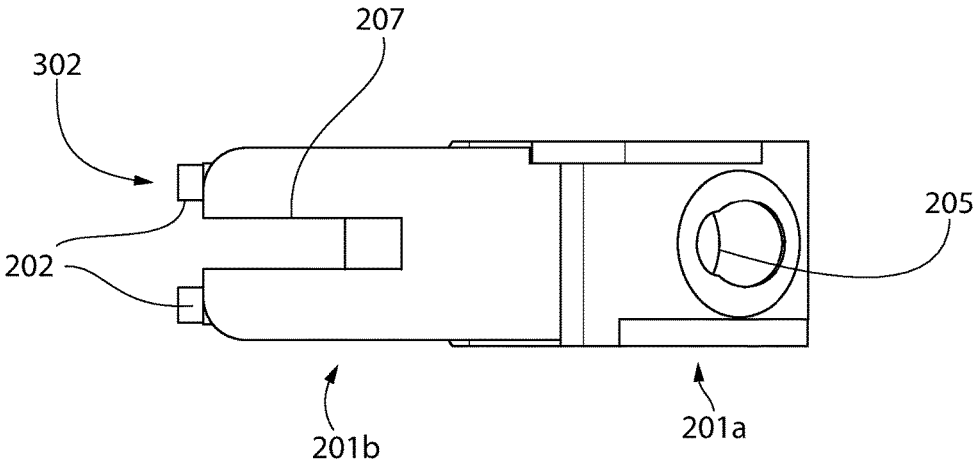
Figure 30H:
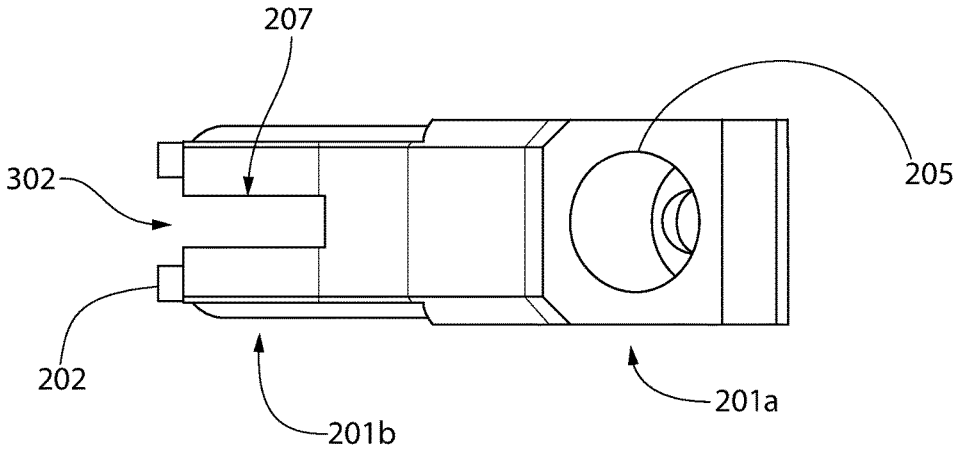
Figure 30I:
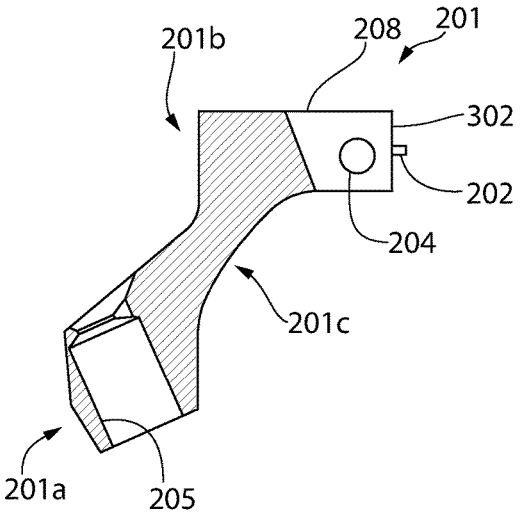
Figure 30J:
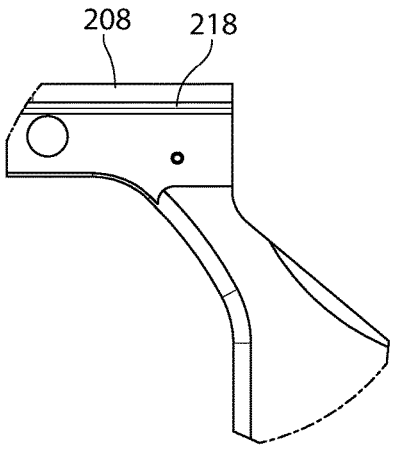
Figure 30K:
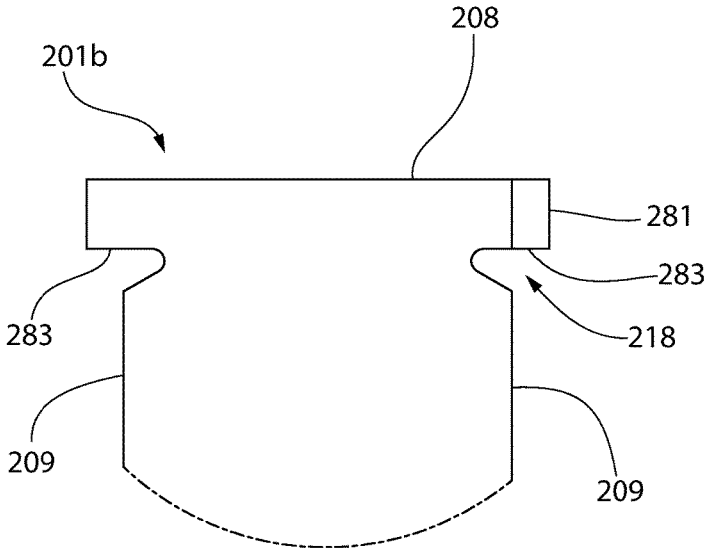
Figure 31A:
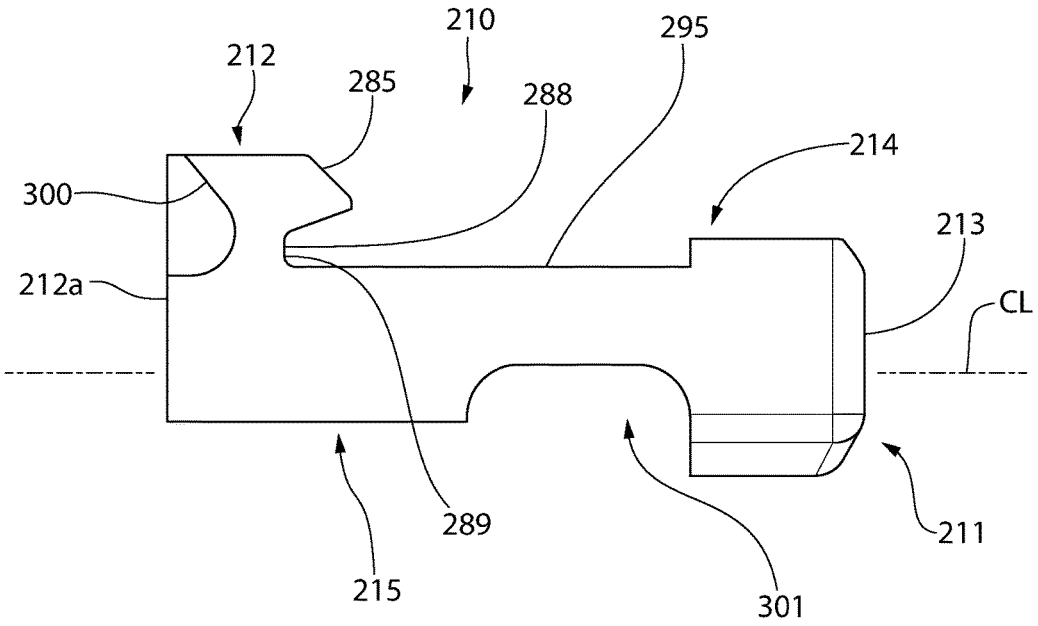
FIGS. 31A-I show various views of the latch of FIG. 28.
Figure 31B:
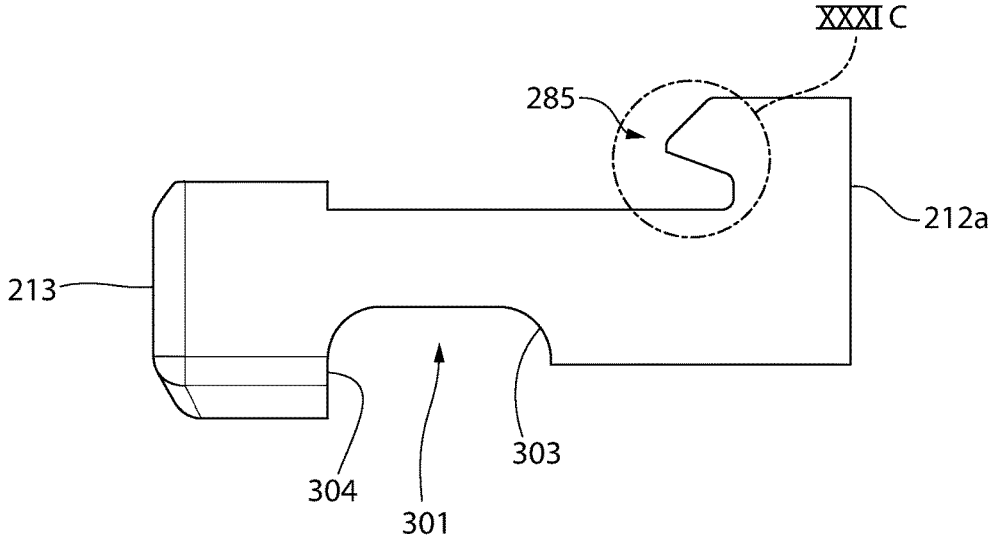
Figure 31C:
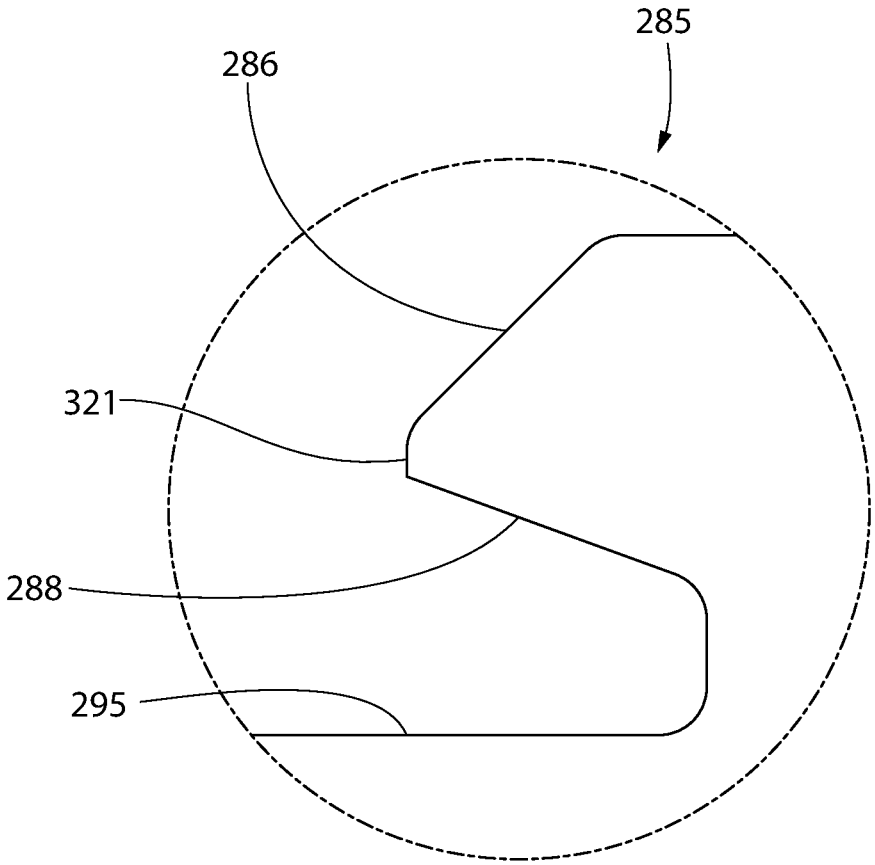
Figure 31D:
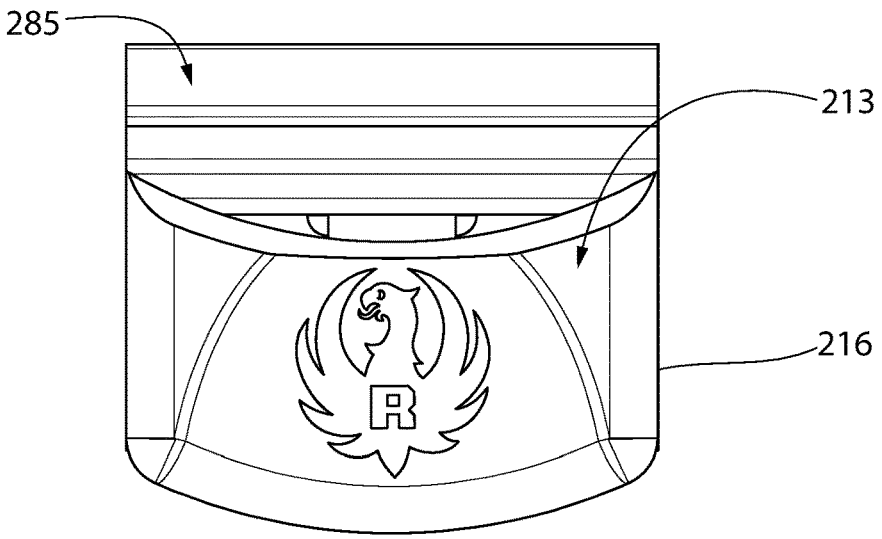
Figure 31E:
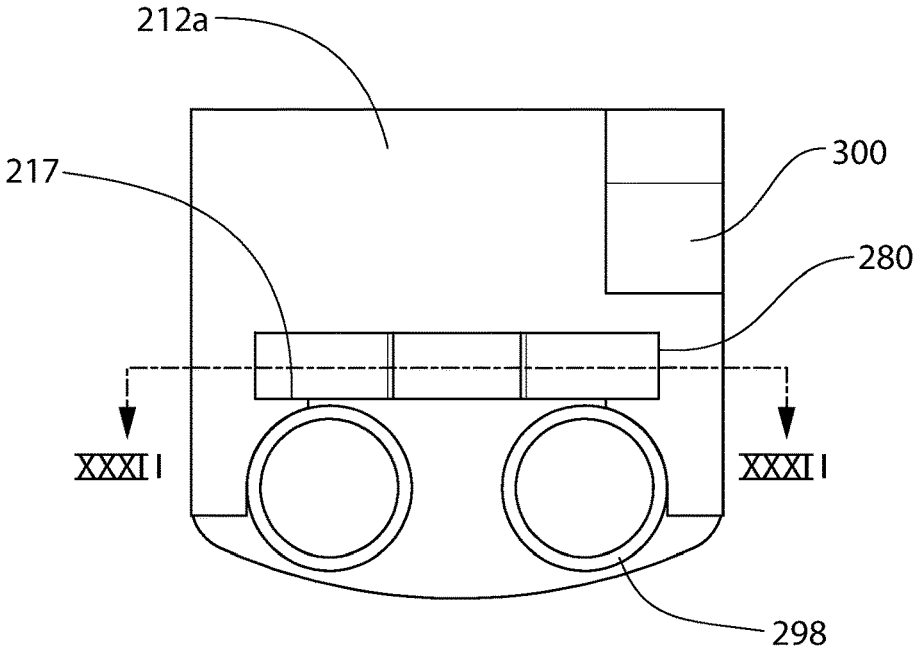
Figure 31F:
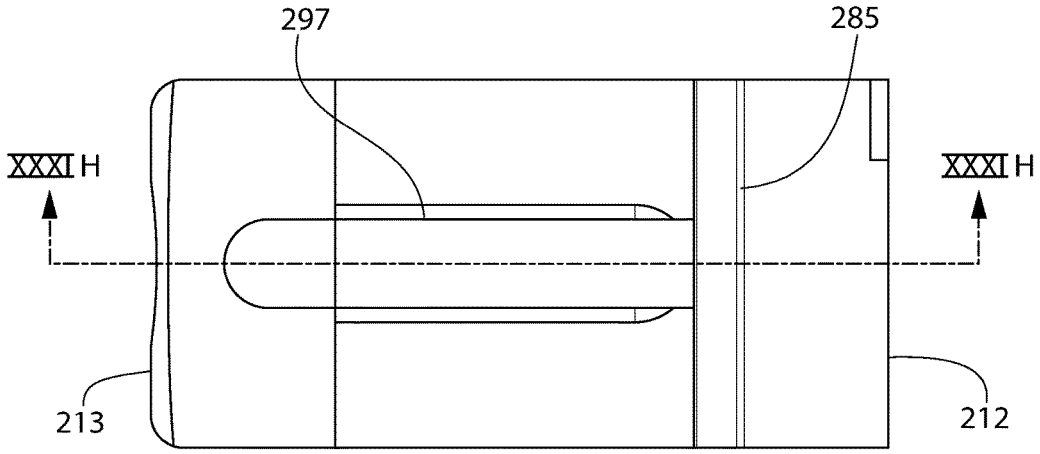
Figure 31G:
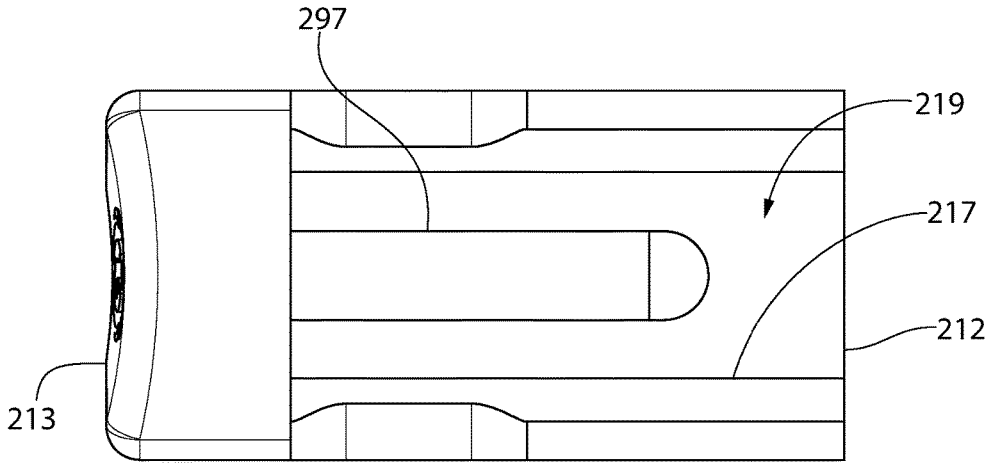
Figure 31H:
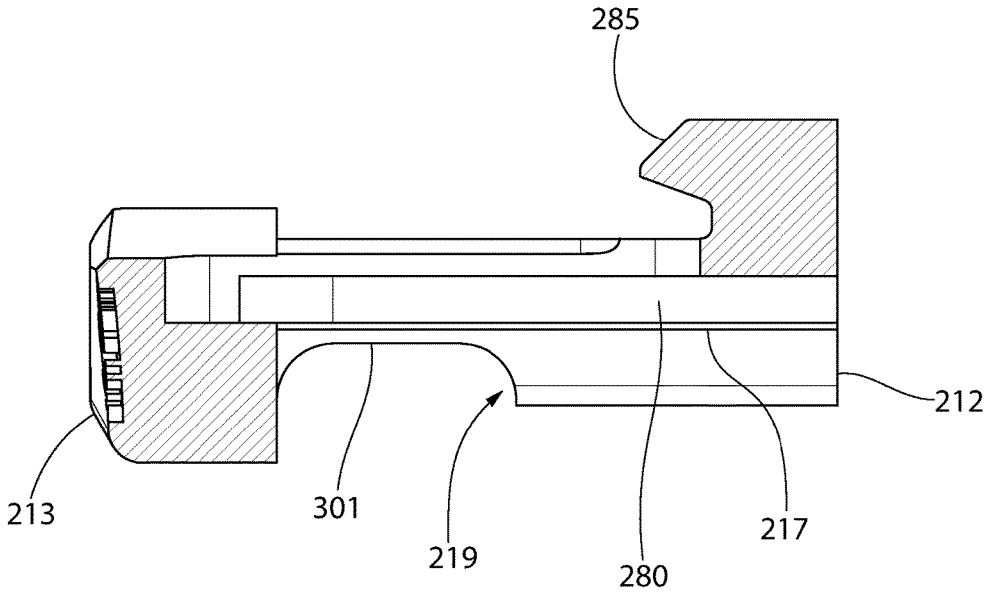
Figure 31I:
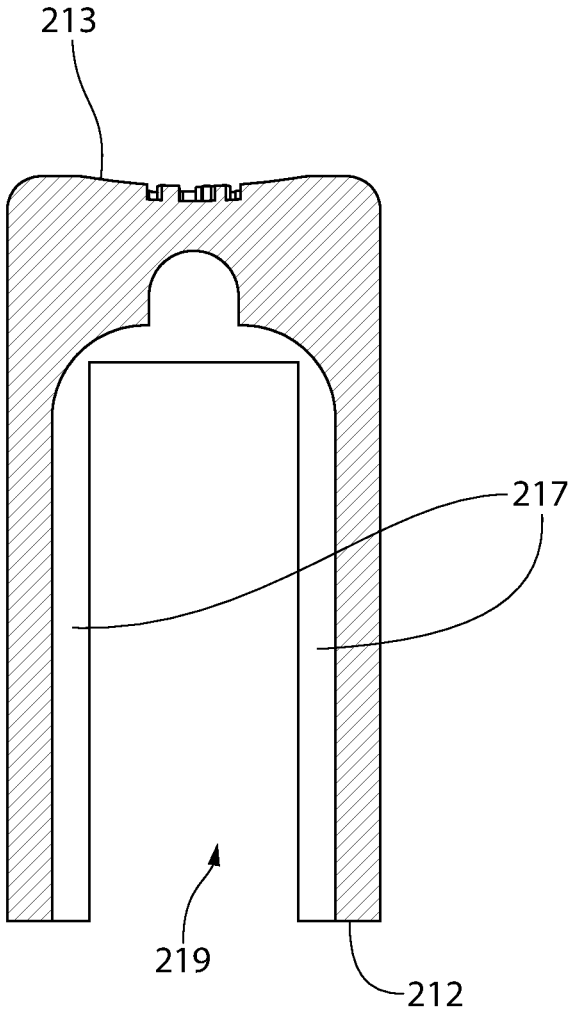
Figure 32:
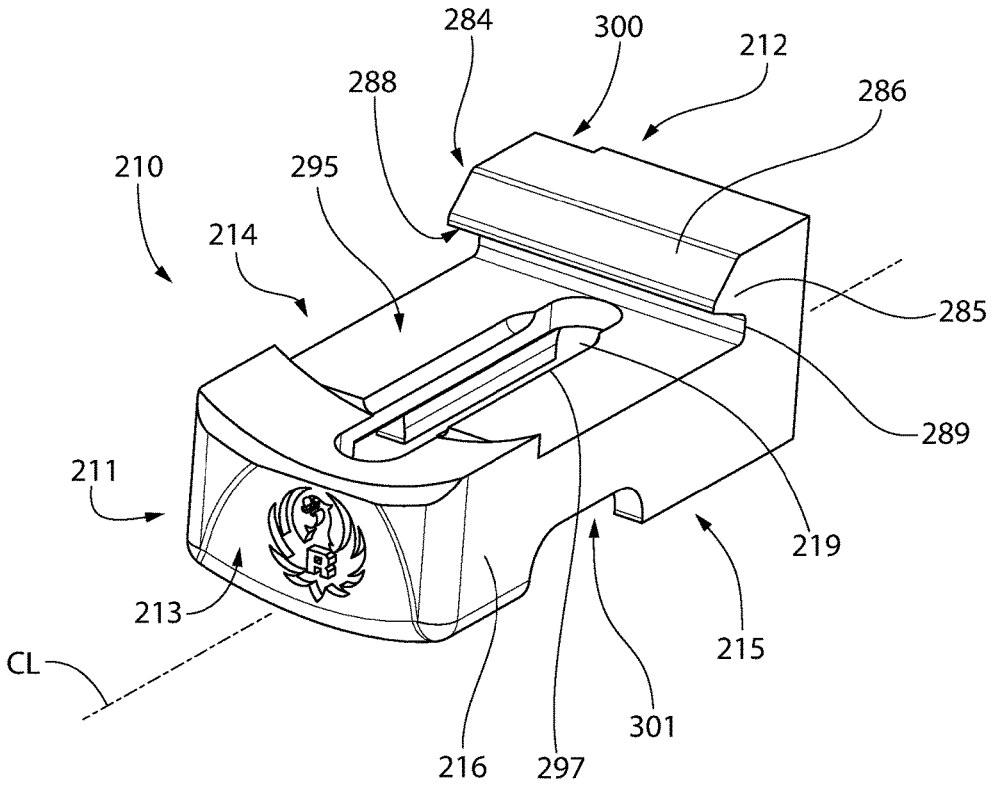
FIGS. 32-34 show various perspective views thereof.

FIG. 28 is an exploded view of a portion of pistol 10 with the latching system and related firearm components. Pistol 10 is shown with grip frame 12, barrel-receiver assembly 20/30, reciprocating bolt 50 slideably disposed in the barrel-receiver assembly, and lateral pivot pin 60 which engages a transverse mounting hole 61 in barrel-receiver assembly 20/30 to rotationally couple the barrel-receiver assembly to the frame (see also FIGS. 1, 2, 5, and 6), as already described above. In one configuration, pivot pin 60 may be received through a pair of holes 21 formed on laterally spaced and upwardly extending barrel-receiver assembly mounting protrusions 26 disposed proximate to the front end 17 of frame 12. Protrusions 26 may be received in complementary configured recesses 27 formed on opposite lateral sides of barrel-receiver assembly 20/30 adjacent to each hole 21. This provides clearance for barrel-receiver assembly 20/30 to freely pivot without interference. In one embodiment, the upward facing top surfaces of protrusions 26 and mating downward facing bottom surfaces of recesses 27 may be arcuately shaped or curved to facilitate smooth pivotably motion (see also FIGS. 35A-B).

Pistol 10 further includes bolt stop pin 80, bolt stop cross pin 82 for mounting the bolt stop to the frame, and the main spring assembly comprising main spring housing 201 and main spring housing tube 203 configured for guiding the action or motion (i.e. compression/expansion) of the main spring 42 already described herein. Bolt stop pin 80 may be configured similarly to the pin shown in FIG. 15; however, the latch slot 81 may be omitted which is not needed for the alternative embodiment of the latching mechanism presently being described. Bolt stop pin 80 may be fixed to grip frame 12 via lateral mounting pin 82 inserted through opposing holes 84 formed in the sides of the frame 12, as previously describe herein. Hammer strut 41 and spring 42 may be slideably disposed inside and guided within the housing tube 203 in one embodiment (see, e.g. FIGS. 5 and 6).

FIG. 30 illustrates main spring housing 201 in further detail. Referring to FIGS. 28, 30, and 46-47, main spring housing 201 has an elongated angled body including an enlarged front portion 201*a* and enlarged rear portion 201*b* connected by a narrower central portion 201*c*. Front portion 201*a* may be obliquely angled with respect to rear portion 201*b*. Front portion 201*a* includes an internally threaded socket 205 configured to detachably engage externally threaded upper end 206 of main spring housing tube 203 to secure the tube to the housing 201. Rear portion 201*b* may be bifurcated or divided in one configuration and includes a centrally located and rearwardly open slot 207 elongated in the axial (longitudinal) direction to insertably receive a downward projecting tab 85 on the lower end of bolt stop pin 80. Tab 85 includes laterally open mounting hole 83 which become concentrically aligned with a pair of laterally projecting mounting holes 204 in main spring housing 201 and lateral holes 84 in grip frame 12. Accordingly, bolt stop cross pin 82 is laterally inserted through holes 83, 84, and 204 to simultaneously secure the main spring housing and bolt stop pin to frame 12. A substantially flat upward facing top surface 208 is defined on rear portion 201*b* which is penetrated by slot 207. Bolt stop pin 80 in one embodiment may include outwardly projecting opposing flanges 86 which helps locate hole 83 in tab 85 at the proper position with respect to holes 204 in main spring housing 201 and holes 84 in frame 12. Other configurations and arrangements however are possible. In one embodiment, the flanges 86 are arranged to engage bottom surface 296 formed on the underside of bottom protrusion 291 on the barrel-receiver assembly 20/30 (see, e.g. FIGS. 46 and 47). This provides metal-to-metal engagement of the barrel-receiver assembly with the bolt stop pin 80 both formed of metal thereby allowing other components such as the frame 12, latch 210, main spring housing 201, etc. which may otherwise engage the underside of the barrel-receiver assembly. Furthermore, the flanges 86 provide a machinable surface which allows small adjustments to be made in the fit between the barrel-receiver assembly 20/30 to frame interface to ensure smooth latching performance.

The latching system 200 for locking and unlocking the tilting barrel-receiver assembly 20/30 to grip frame 12 will now be described in further detail. Latching system 200 includes a manually-operated latch 210 which may be configured to selectively engage and disengage the barrel-receiver assembly 20/30 or an appurtenance thereof to (1) lock the pivoting barrel-receiver assembly 20/30 in the closed position to the grip frame 12 during firing operation of the pistol (see, e.g. FIGS. 1 and 46), and (2) to unlock the barrel-receiver assembly so that the assembly may be pivoted to the tilted open position (see, e.g. FIGS. 2 and 47). In that respect only, latch 210 may function similarly in broad operational principle to latch slide plate 70 presented above (see, e.g. FIG. 20), but is configured and arranged differently. Latch 210 incorporates the locking and actuating features into a single component which may be molded, cast, machined, or otherwise formed.

Latch 210 may be frame-mounted to grip frame 12 in one non-limiting embodiment, in contrast to the latch slide plate 70 previously described herein which instead is mounted to the pivoting barrel-receiver assembly. Latch 210 is slideably and linearly movable on frame 12 parallel to the longitudinal axis LA between a forward unlocked position (see, e.g. FIGS. 43A-B) and a rearward locked position (see, e.g. FIGS. 41A-B and 42A-B). In the locked position, latch 210 is configured and positioned to lockingly engage the barrel-receiver assembly 20/30 thereby preventing its opening.

FIGS. 31-34 shows latch 210 in greater detail. Referring to FIGS. 28 and 31-34, latch 210 includes a longitudinally elongated body comprising a front latching end 212, opposing rear actuating end 211, top 214, bottom 215, and pair of opposed lateral sides 216 extending between the top and bottom. Latching end 212 may be at least partially open and rear actuating end 211 may be substantially closed in one embodiment. The latching end 212 defines a front end surface 212*a* which may be substantially flat in some embodiments. Other arrangements and configurations of the latch are possible.

In one embodiment, latch 210 may be slideably mounted proximate to the rear end 19 of pistol grip frame 12 via opposing pairs of laterally spaced apart longitudinal mounting rails 217 and grooves 218. Latch 210 is axially movable along the longitudinal axis LA between rearward locked and forward unlocked positions, as further described herein.

In one non-limiting implementation shown herein, longitudinal mounting rails 217 may be formed on latch 21 and mating longitudinal mounting grooves 218 may be formed on main spring housing 201 (see also FIG. 30). Alternatively, in another implementation, mounting rails 217 may be formed on frame 12 and grooves 218 may be formed on latch 210 (not shown). Either arrangement may be used.

In the first implementation, mounting rails 217 may extend inwardly from lateral sides 216 of latch 210 into a downwardly open longitudinal recess or channel 219 to slideably engage mating outwardly facing grooves 218 formed on the lateral sides 209 of main spring housing 201. Accordingly, channel 219 provides an inverted U-shaped configuration for latch 210 and slideably receives the upper portion of main spring housing 201 therein. Latch 210 is therefore movably disposed on top of and engages the main spring housing.

Both rails 217 and grooves 218 are axially elongated in the longitudinal direction and parallel to longitudinal axis LA. Each rail 217 and each groove 218 may be arranged parallel to the other rail or groove in one embodiment. In one embodiment, longitudinally extending slots 280 are formed above each rail 217 that slideably receive laterally extending flanges 281 formed near top surface 208 of the main spring housing 201 above each lateral groove 218 (see also FIG. 30). This acts as an additional secondary sliding mechanism for mounting the latch 210 to the main spring housing 201. Slots 280 define an upwardly facing surfaces 282 that slideably engage downwardly facing surfaces 283 formed on the underside of the flanges 281 above each groove 218 when the latch 210 is moved between the forward and rearward positions. When latch 210 is mounted to pistol 10, the lateral sides 216 of the latch are disposed between the main spring housing 201 and respective lateral sides 15 of grip frame 12 so that a majority of the latch and its length are disposed inside the frame except for rear actuating end 211 which remains exposed for access by a user's finger or thumb to unlock the barrel-receiver assembly. FIG. 28 shows an exploded view of the foregoing components.

In other implementations contemplated, longitudinal mounting grooves 218 may be formed on the interior surface of grip frame 12 in lieu of on the main spring housing 201. In such an arrangement, outwardly projecting longitudinal rails 217 may be formed on latch 210 and inwardly facing grooves 218 at the rear end 19 of grip frame 12, or vice-versa.

With continuing reference now to FIGS. 28 and 31-34, front latching end 212 of latch 210 further includes an upwardly extending top protrusion 284 that defines a rearwardly projecting hook 285. In one configuration, protrusion 284 projects upward beyond top 214 of latch 210 and may be taller than other portions of the latch. Hook 285 may have a generally triangular or pyramidal shaped terminal end defined by obliquely angled and intersecting latch and closure surfaces 288, 286 which define an apex 321 therebetween (see, e.g. FIG. 31C). Hook 285 is configured to engage a complementary configured locking recess 287 formed on the underside of barrel-receiver assembly 20/30 (see also FIGS. 35A-B and 45G) to form a locked position. Recess 287 is open forwardly to slideably capture and engage hook 285 extending rearwardly from latch 210 when the latch is locked (see, e.g. FIG. 41A), thereby preventing tilt opening of the barrel-receiver assembly 20/30.

Figure 33:
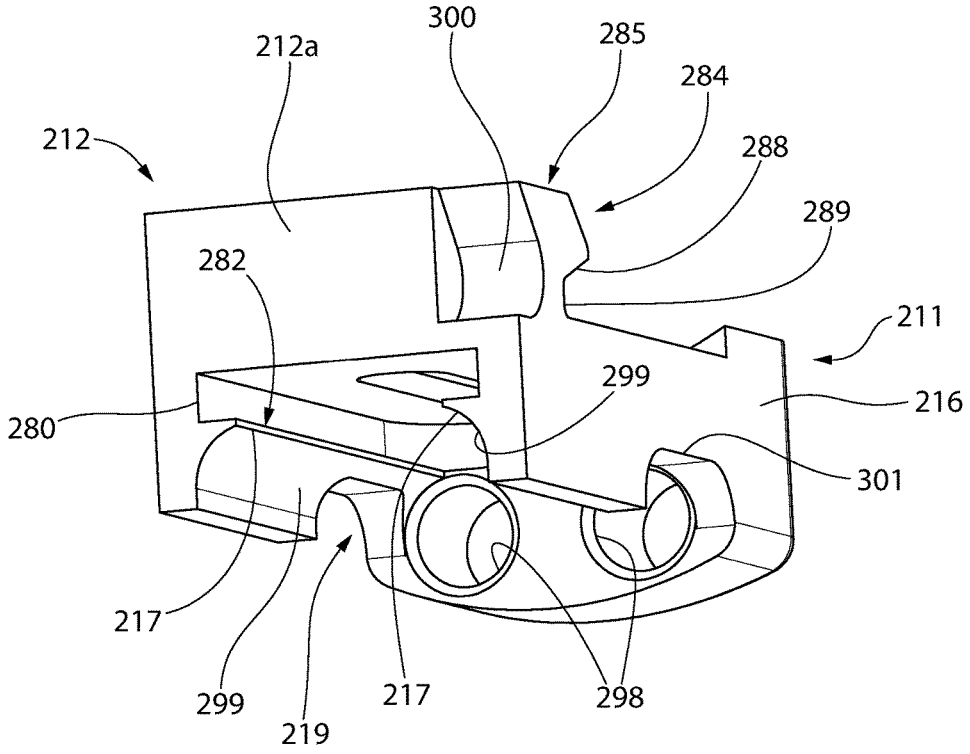
Figure 34:
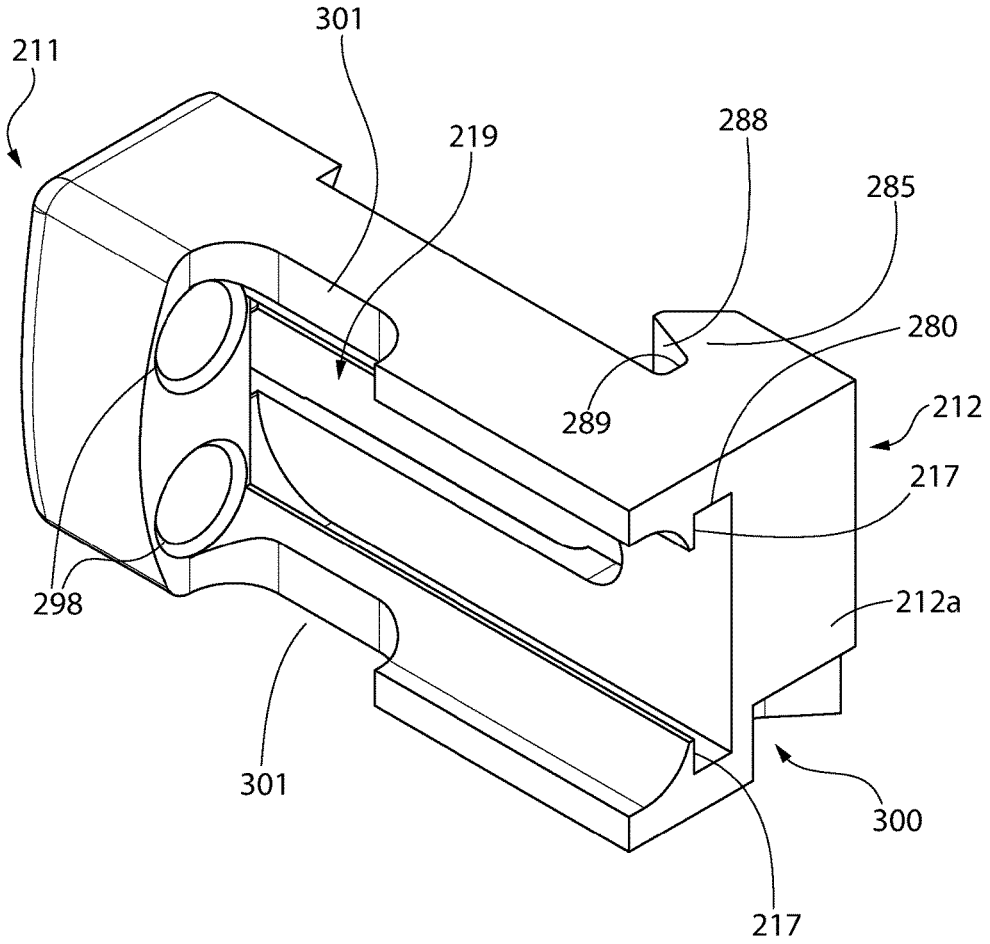
Figure 35A:
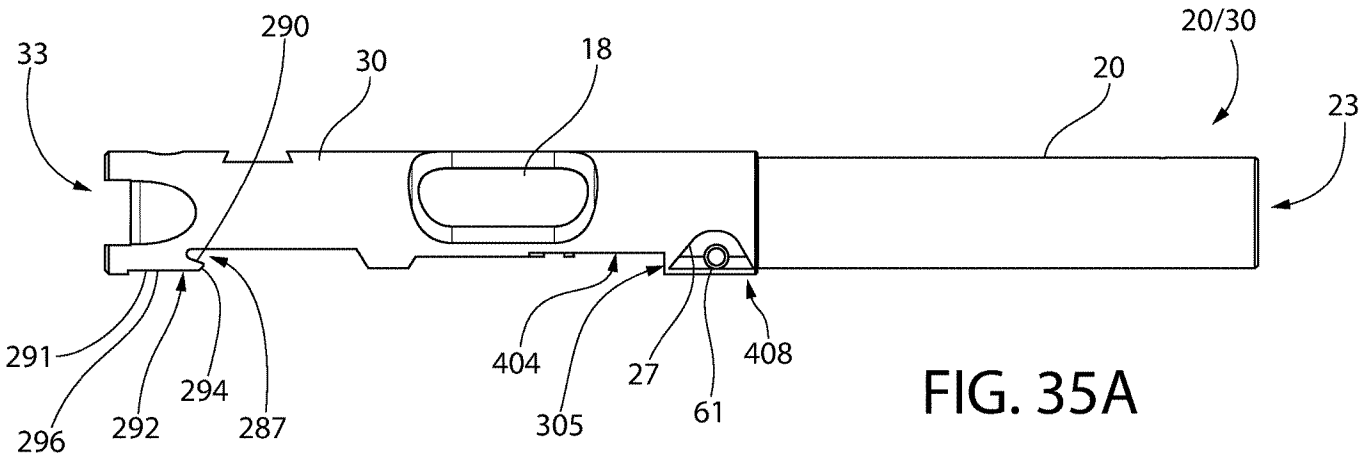
FIGS. 35A-B show various views of the barrel-receiver assembly of FIG. 28.
Figure 35B:
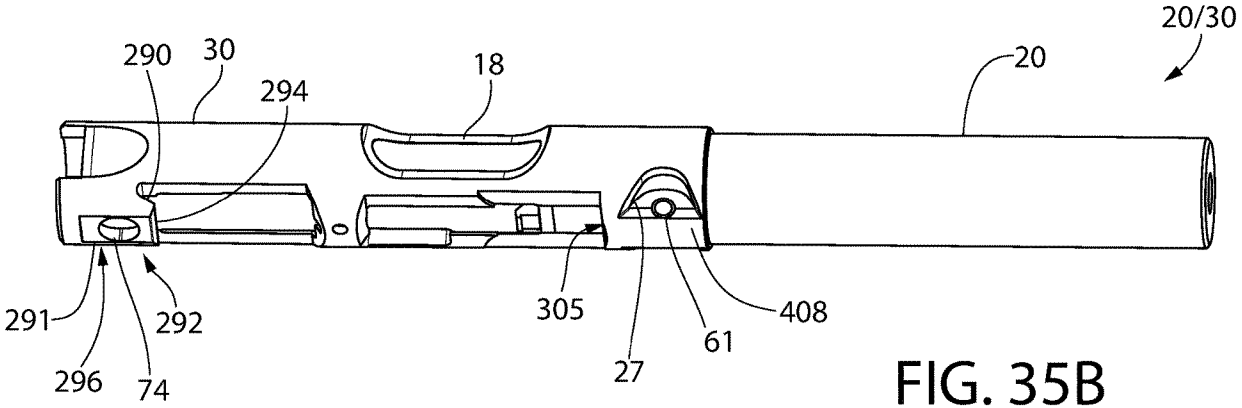

With continuing reference to FIGS. 31-34 and 45G, hook 285 of latch 210 defines a rear and downward facing latch surface 288 which engages a mating forward and upward facing bearing surface 290 on barrel-receiver assembly 20/30 (see also FIGS. 35A-B). In one embodiment, latch and bearing surfaces 288, 290 may be obliquely oriented with respect to longitudinal axis LA and be disposed at substantially the same oblique angle so that at least a portion of the contact between the surfaces is one of flat-to-flat along an oblique plane to the longitudinal axis (see, e.g. FIG. 41A). Bearing surface 290 on barrel-receiver assembly 20/30 in one implementation may be formed on a downward extending bottom protrusion 291 disposed proximate to the rear end of the barrel-receiver assembly 20/30. Protrusion 291 may include a front hook-shaped portion 292 dimensioned for at least partial insertion into recess 289 formed below hook 285 of the latch 210. Bearing surface 290 may be formed on the hook-shaped portion 292. Hook-shaped portion 292 may have a generally triangular or pyramidal shaped terminal end defined by obliquely angled and intersecting bearing surface 290 and a closure surface 294 which define an apex therebetween.

Actuating end 211 of latch 210 is to operate the latch and may comprise a rear facing end surface 213 configured for pressing by a user's finger or thumb. In one embodiment, end surface 213 may be arcuately convexly curved from left to right as shown or alternatively may be flat, arcuately concavely curved, or have some other configuration. Other surface shapes and surface textures (e.g. ribbing, knurling, etc.) may be may be used to facilitate positive engagement by the user. Surface 213 remains exposed when latch 210 is mounted to grip frame 12 making the latch member 210 readily accessible to the user. In one embodiment, actuating end 212 of latch 210 may protrude outwards rearwardly from rear end 19 of grip frame 12 to facilitate access.

Latch spring assembly 230 acts on and biases latch 210 towards the rearward locked position to prevent opening the barrel-receiver assembly 20/30 when pistol 10 is in the ready-to-fire condition. Any suitable type springs may be used. In one embodiment, referring to FIGS. 28 and 29A-D, latch spring assembly 230 comprises double helical compression springs which is comprised of a spaced pair of parallel spring coils 231, 232. The coils are oriented substantially parallel to longitudinal axis LA of pistol 10. One of the coils 231, 232 each is disposed on opposite lateral sides 209 of main spring housing 201 when mounted in the pistol grip frame 12. This ensures uniform and positive sliding motion of and biasing action on the latch 210 by spring assembly 230 for smooth operation of the latch. Other suitable types of springs however may be used.

A separate spring 234 may be provided which is associated and interfaces with lateral mounting pin 82 that retains the main spring housing 201 in the frame. Spring 234 may be generally U-shaped in one embodiment, and includes a pair of laterally spaced and axially extending linear extension legs 233*a* and a transverse segment 233 extending therebetween and arranged generally perpendicular to the extensions. Extension legs 233*a* may be arranged parallel to the compression axis of each coil 231, 232 defined by their respective lengths (see, e.g. FIGS. 29A-D) when mounted in the pistol frame. In one embodiment, the transverse segment 233*a* may be offset from the ends of the linear extension legs 233*a* as depicted and joined to a recurvant segment 233*b* of each leg. A pair of retaining holes 320 in opposite lateral sides of main spring housing 201 receive inwardly turned hooked ends of each leg 233*a* to retain the spring. Each linear extension leg 233*a* is biased against and engages a mating circumferential groove in each end of the pin 82 to lock the pin into the main spring housing 201 (see, e.g. FIG. 39). To remove the pin 82, a punch may be used to push the pin laterally outwards from the main spring housing 201 with sufficient force to overcome the biasing action of spring 234 and disengage the linear extension legs 233*a* from the circumferential pin grooves.

For mounting the latch spring assembly 230 to latch 210, a pair of laterally spaced apart sockets 298 are formed in open channel 219 of the latch as best shown in FIGS. 33 and 34. Sockets 298 open rearwardly and may be disposed in rear actuating end 211 of the latch. The rear ends of latch spring coils 231, 232 each engage a respective socket. To accommodate and guide the spring coils 231, 232 to promote linear expansion/compression, a pair of laterally spaced apart arcuately curved surfaces 299 are formed adjacent to and beneath mounting rails 217. The sockets 298 are spaced laterally apart sufficiently to receive rear portion 201B of main spring housing 201 therebetween when the housing and latch 210 are mounted in pistol grip frame 12.

Latch 210 further includes a substantially planar or flat top surface 295 disposed between the ends 211, 212. When the latch 210 is actuated, surface 295 slideably engages a mating substantially planar or flat bottom surface 296 formed on the underside of bottom protrusion 291 on the barrel-receiver assembly 20/30. This ensures linear and longitudinal motion of the latch 210 to axially align hook 285 with locking recess 287.

Figure 41A:
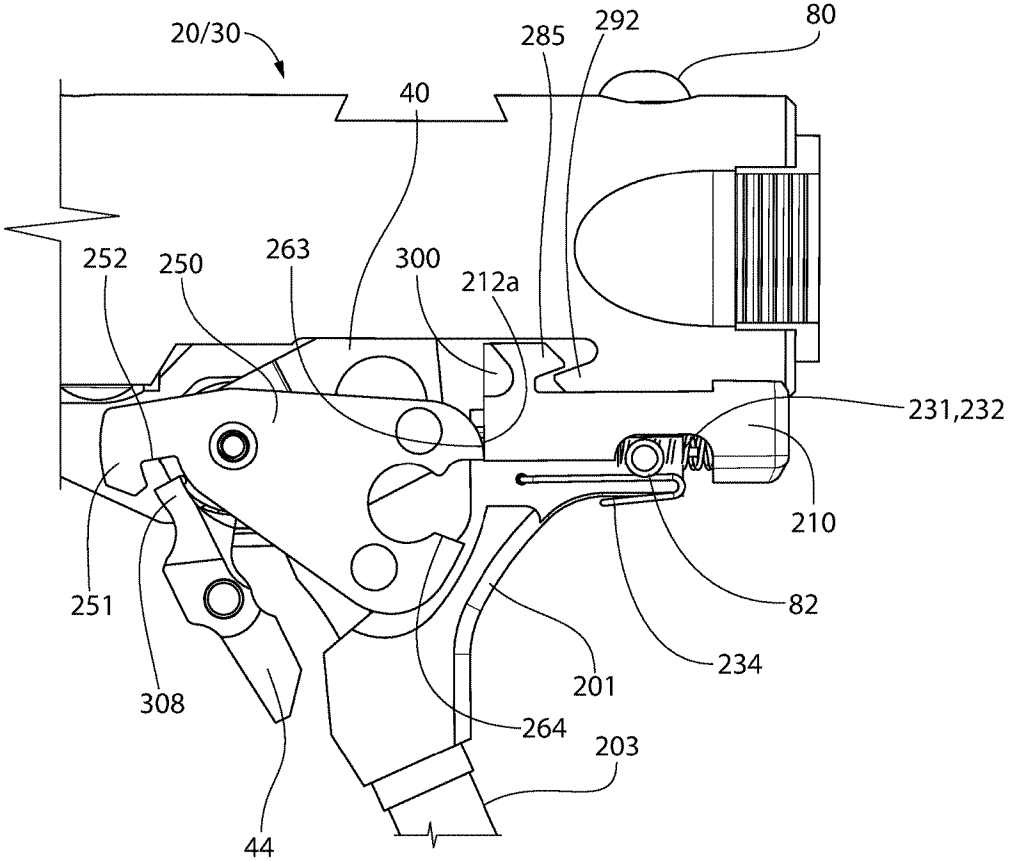
FIGS. 41A-B are side views showing the latching system with latch in the rearward locked position and barrel-receiver assembly latched.
Figure 41B:
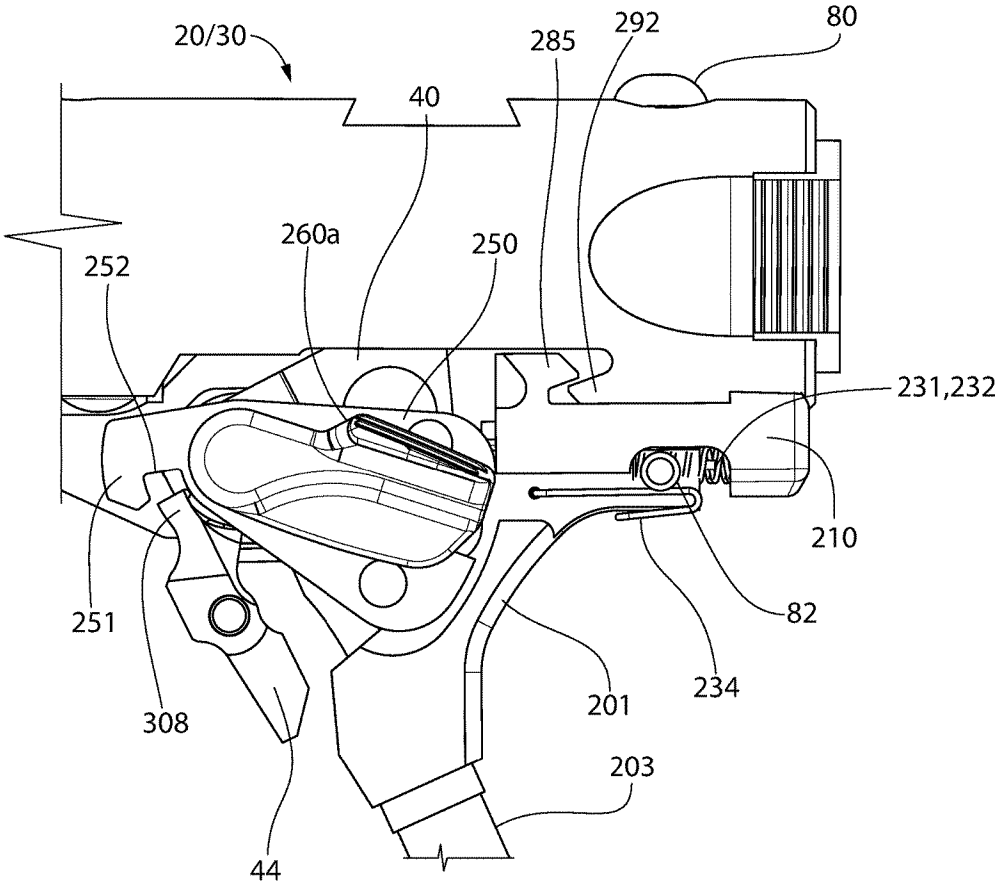
Figure 42A:
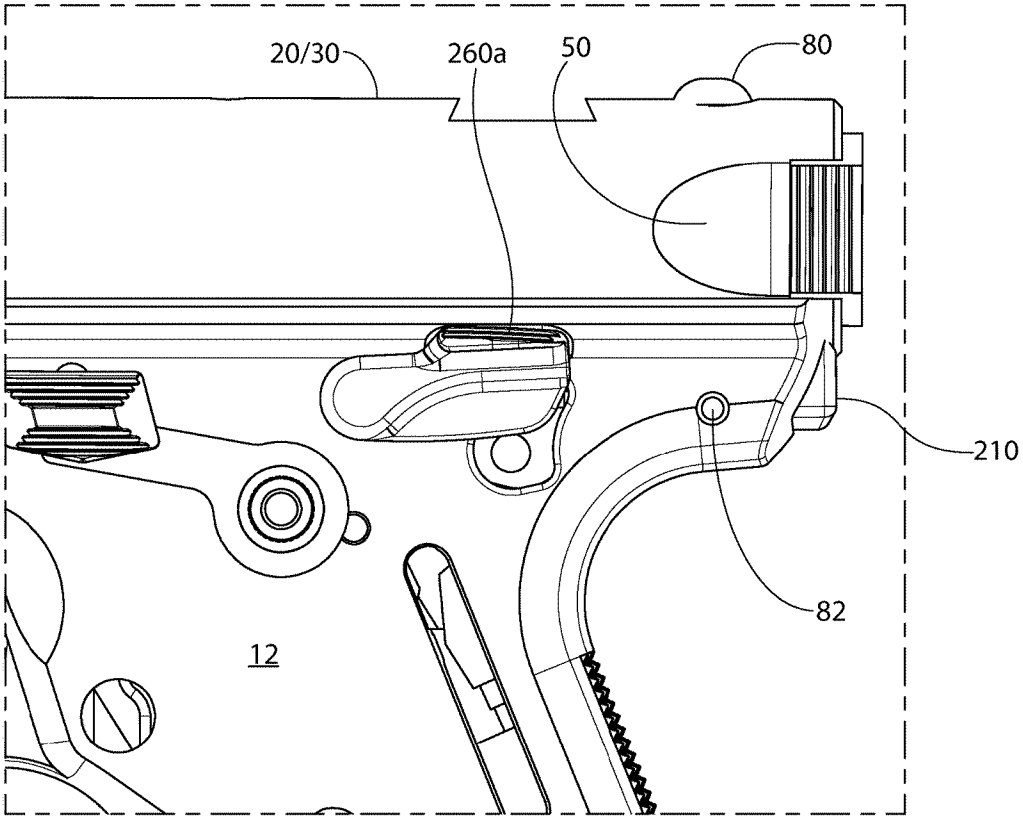
FIGS. 42A-B are side views showing the latch being rearward in the locked position.
Figure 42B:
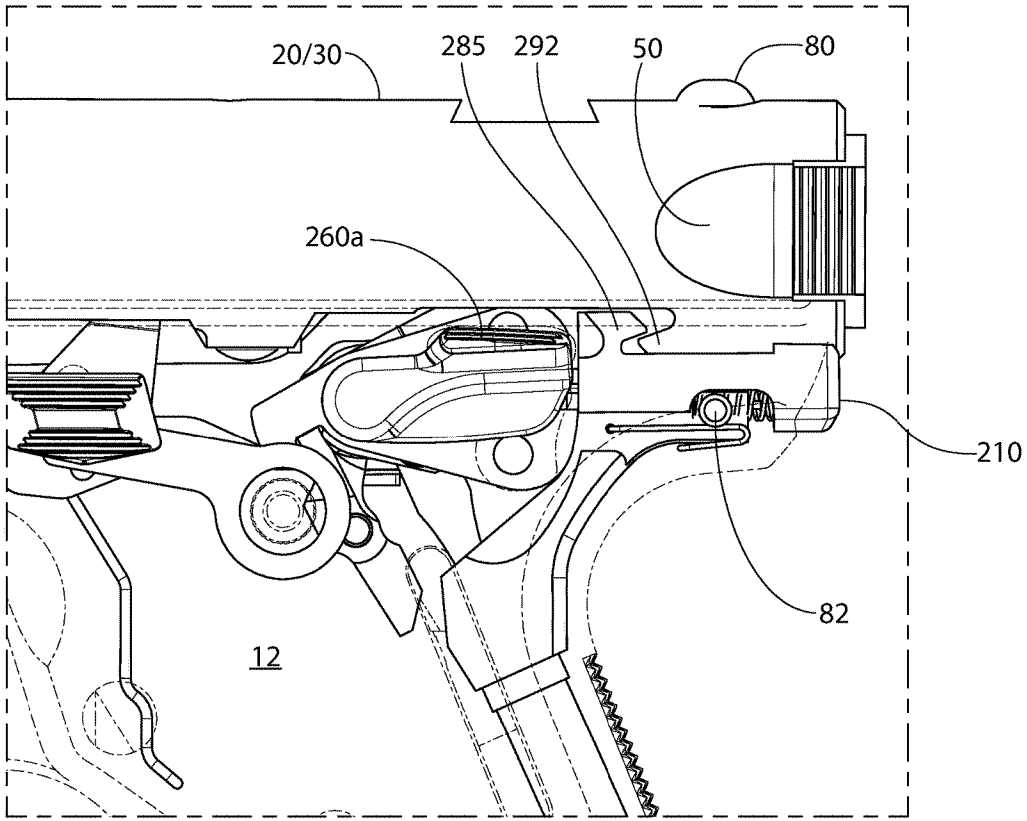

In one embodiment, the pistol 10 is configured to provide an automatic relocking mechanism producing an audible "click" when the barrel-receiver assembly 20/30 is reclosed. This audibly informs the user that the barrel-receiver assembly has been properly relocked. To provide this capability, the hook 285 on latch 210 includes the upward facing obliquely angled closure surface 286 which is operable to engage mating downward facing obliquely angled closure surface 294 formed on the hook-shaped portion 291 of barrel-receiver assembly 20/30 (see, e.g. FIGS. 32, 35A, and 45G). When the rear end of barrel-receiver assembly 20/30 tilted back downward for closing, the mating closure surfaces 286, 294 automatically slightly displaces the rearwardly biased latch 210 forward causing the latch hook 285 to re-engage barrel-receiver assembly recess 287 once the mating surfaces 286, 294 are cleared producing the audible noise. The latch 210 is relocked as shown in FIGS. 41A-B.

In one embodiment with reference to FIGS. 31-34, the latch 210 further includes a downwardly open elongated axial slot 301 configured to receive lateral mounting pin 82 at least partially therein. Slot 301 defines a rearward facing end surface 303 and forward facing end surface 304. Slot 301 has a sufficient axial length to allow the latch 210 to move between the rearward locked position and forward unlocked position as shown in FIGS. 41A-B and 43A-B, respectively. The rearward facing end surface 303 within the slot 301 may act as a rearward travel limit stop for latch 210 (see, e.g. FIG. 31B). When the latch 210 is released by a user and biased rearward by latch spring assembly 230, lateral mounting pin 82 protruding laterally outwards from each side of main spring housing 201 engages the rearward facing end 303 surface to arrest movement of the latch (see, e.g. FIGS. 41A-B). The maximum forward extent to which the latch 210 may be moved is restricted by the rear surface 302 of the main spring housing 201, which acts as a forward travel limit stop for latch 210 (see, e.g. FIGS. 43A-B).

The interlock mechanism which maintains latch 210 in the locked position during firing operation of pistol 10 will now be described. The interlock generally comprises a movable blocking element operable to prevent movement of latch 210 from the locked position sufficient to unlock the barrel-receiver assembly 20/30 when pistol 10 is in the ready-to-fire condition. The blocking member may be pivotably movable between blocking and non-blocking positions. In one embodiment, without limitation, the pistol safety mechanism may serve a dual purpose as the blocking element and further to disable the firing mechanism of the pistol. Advantageously, this minimizes number of components thereby reducing costs and complexity of the pistol operating mechanism to enhance reliability. In other possible arrangements, it will be appreciated however that a separate blocking element dedicated to solely arresting movement of latch 210 may be provided.

An ambidextrous safety mechanism assembly comprises a manually-operated and pivotably movable safety member 250, left operating lever 260*a*, and right operating lever 260*b* shown in FIG. 28. The mechanism is configured to disable and arrest the firing mechanism, thereby aiding in preventing unintentional or inadvertent discharge of the pistol along with a user employing proper and safe handling of the firearm.

Figure 36A:
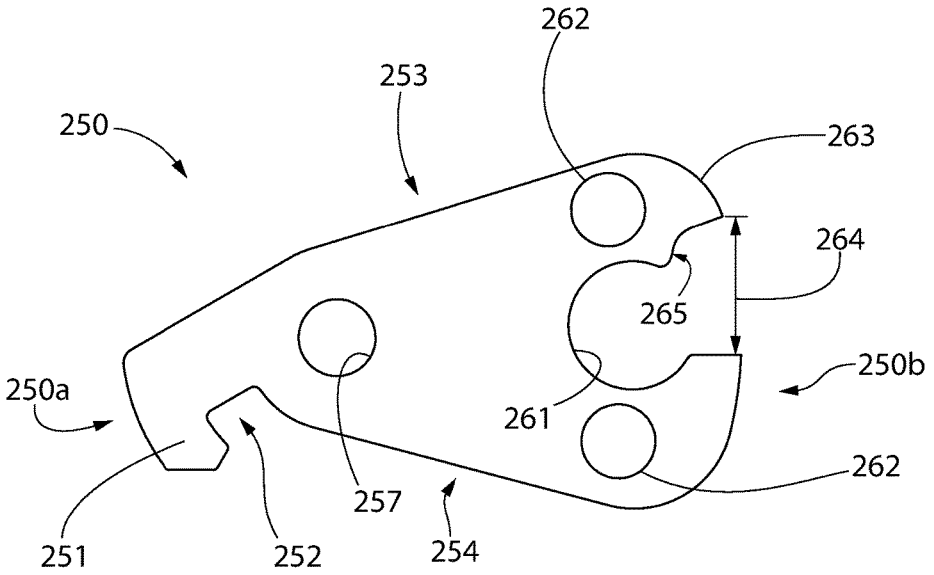
FIGS. 36A-C show various views of the safety of FIG. 28.
Figure 36B:
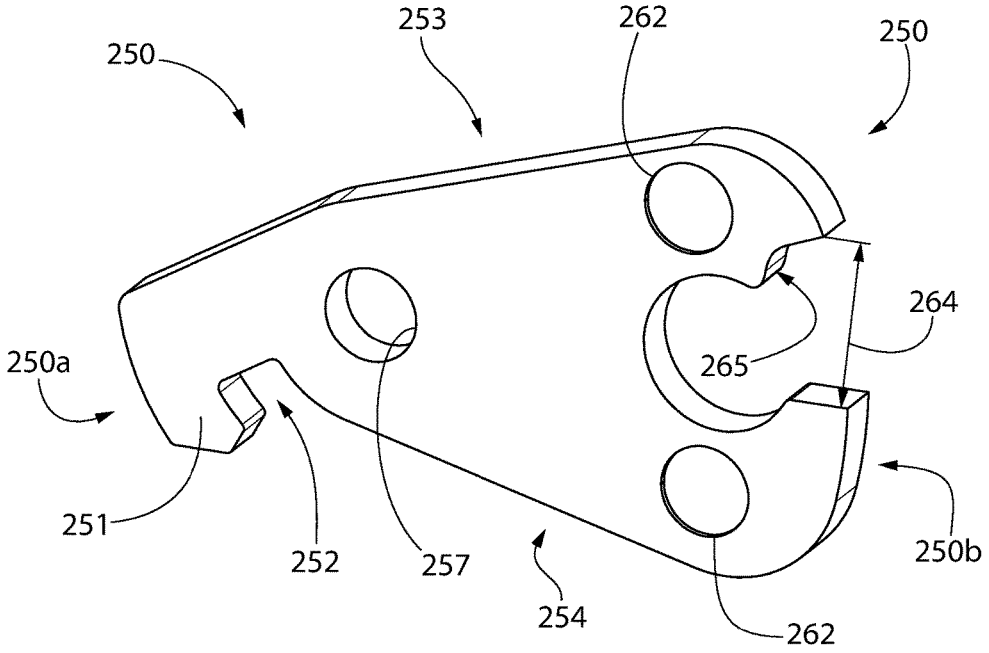
Figure 36C:
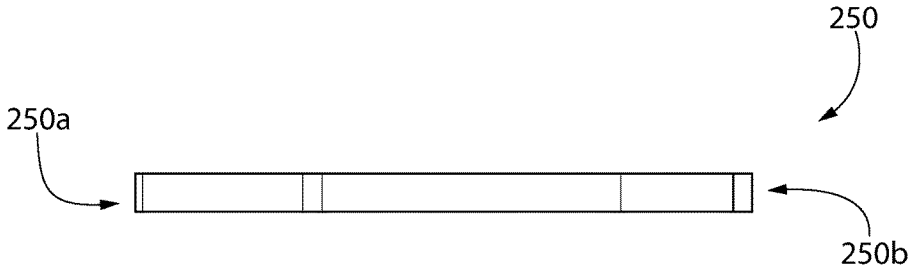
Figure 37A:
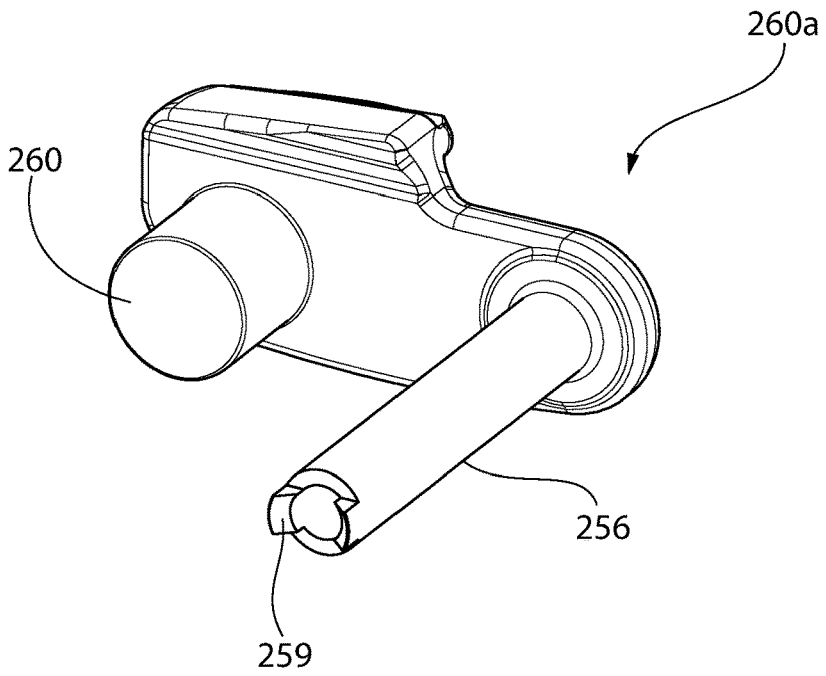
FIGS. 37A-F show various views of the left safety operating lever of FIG. 28.
Figure 37B:
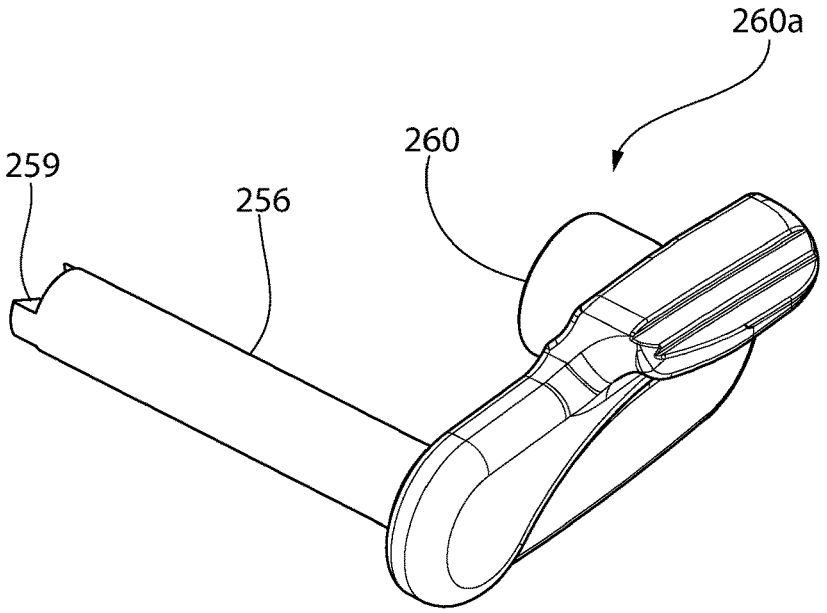
Figure 37C:
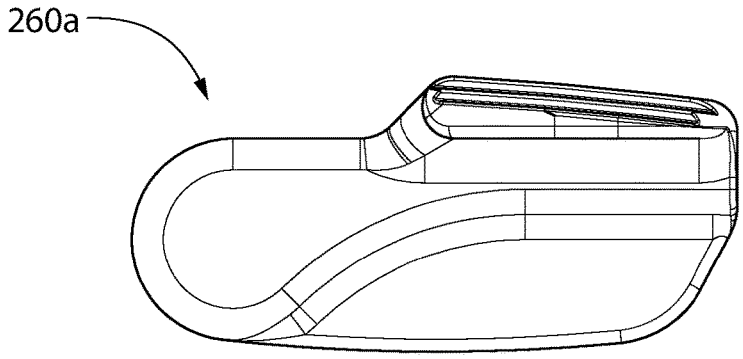
Figure 37D:
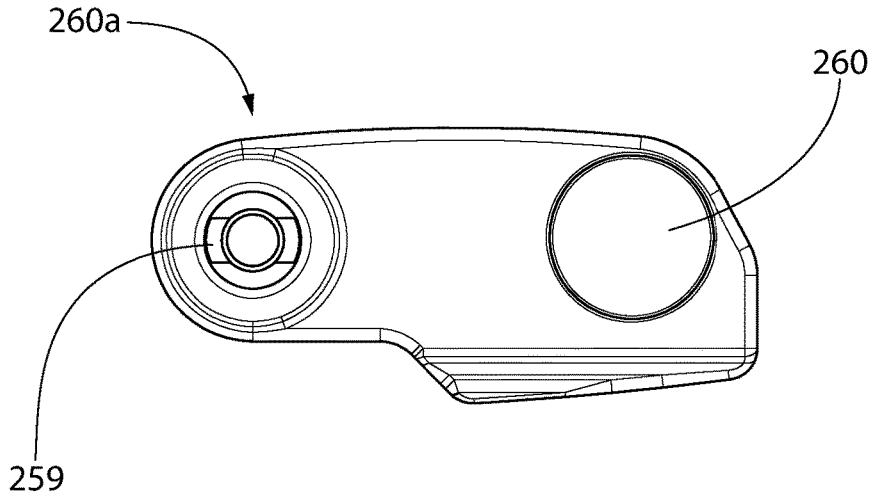
Figure 37E:
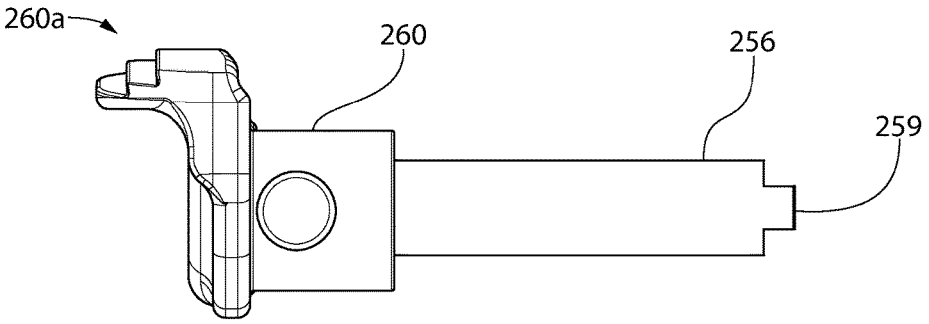
Figure 37F:
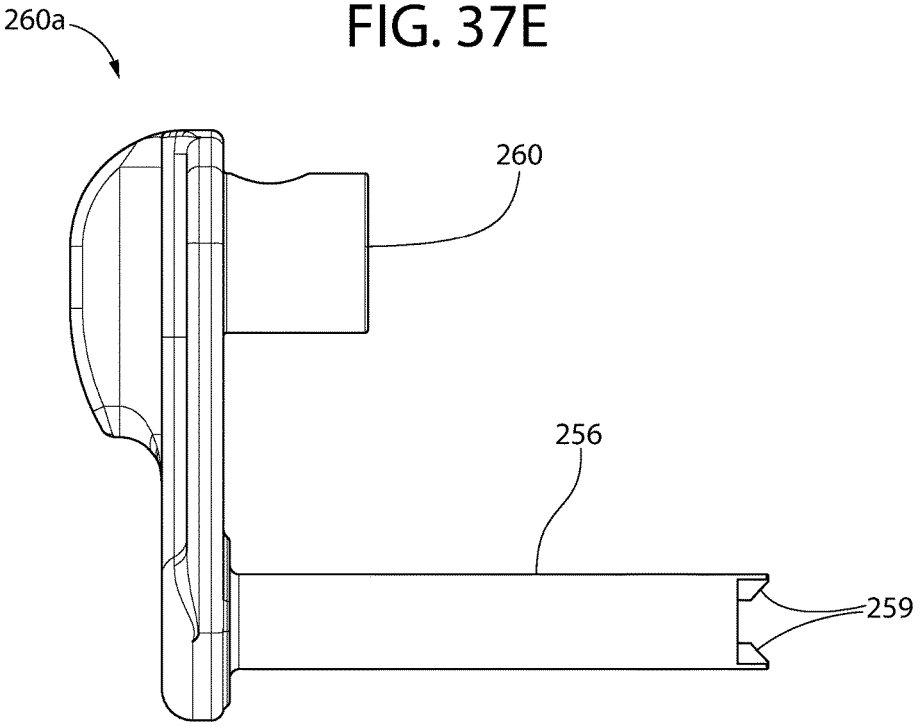
Figure 38A:
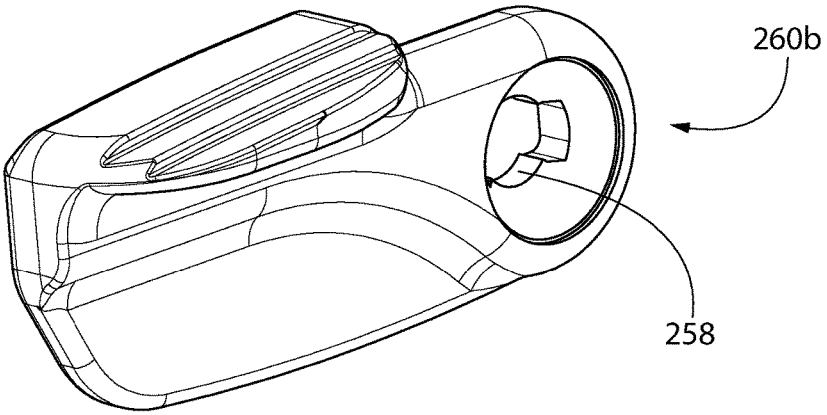
FIG. 38A-F show various views of the right safety operating lever of FIG. 28.
Figure 38B:
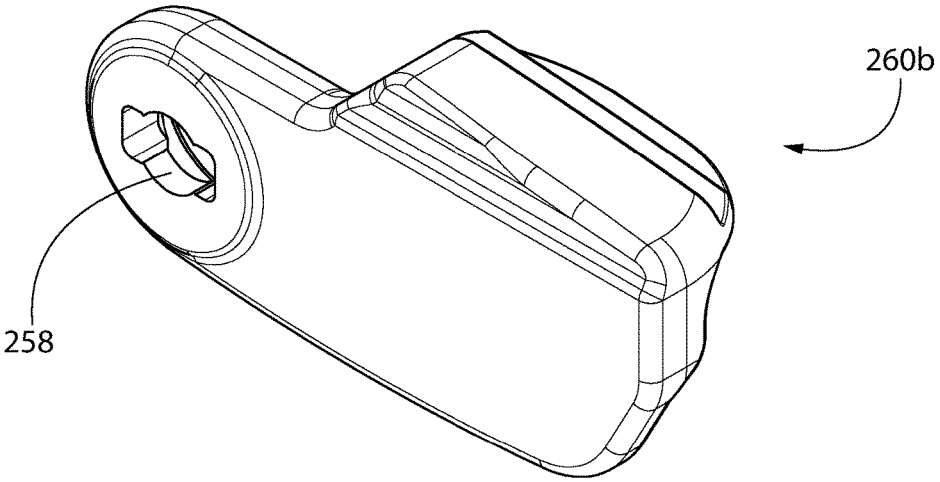
Figure 38C:
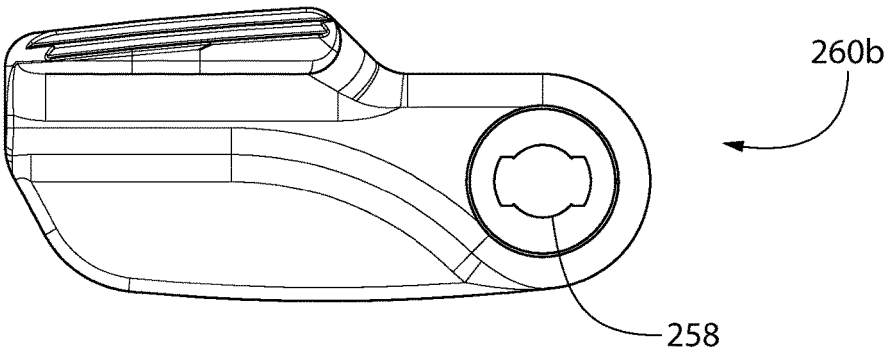
Figure 38D:
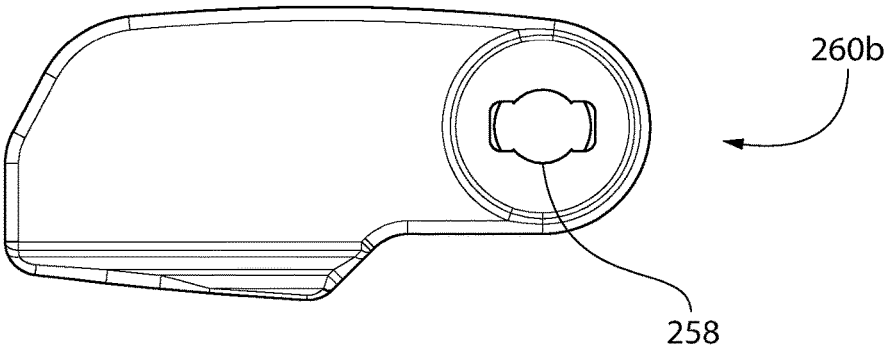
Figure 38F:
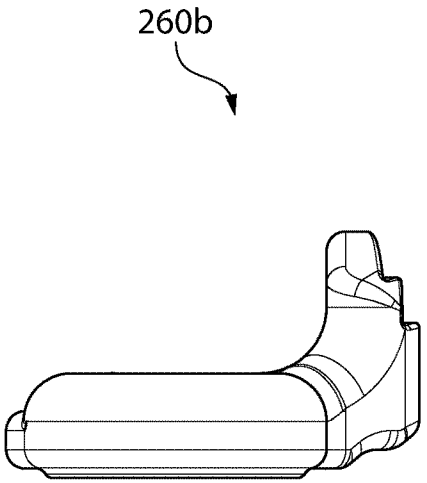
Figure 38E:
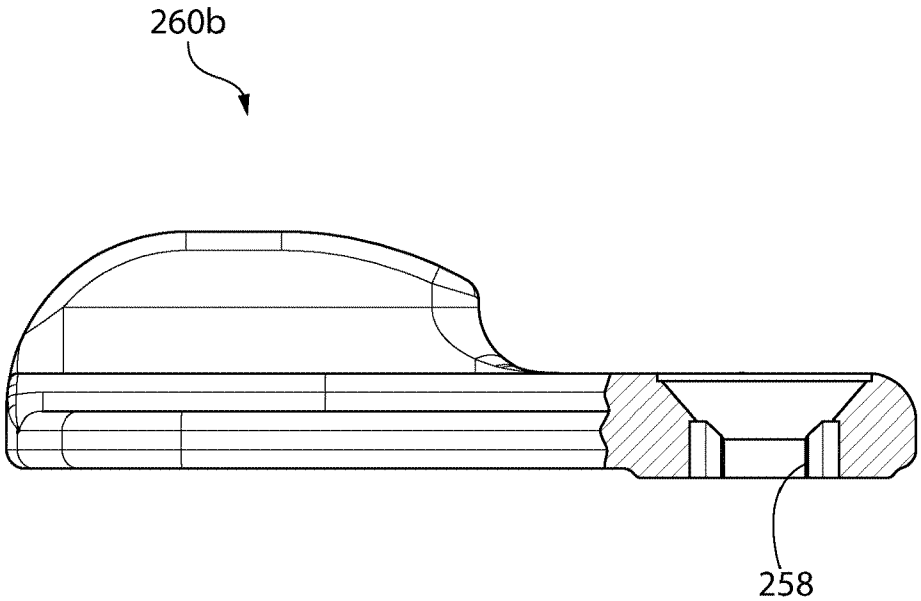

Referring to FIGS. 28 and 36A-B, safety member 250 has a generally flat plate-like body in one embodiment comprising a front portion 250*a* defining a front end, an enlarged rear portion 250*b* defining a rear end, top 253, and bottom 254. Rear portion 250*b* may have a Y-shaped bifurcated structure in one embodiment. Safety member 250 is pivotably mounted to grip frame 12 via a transverse pivot pin 256 which defines a pivot axis. Pin 256 is inserted through a mounting hole 257 formed proximate the front portion 250*a* of safety member 250 and pair of spaced apart holes 255 formed in each lateral side 15 of the frame. With additional reference to FIGS. 37 and 38, the pin 256 may be integrally formed as a unitary structural part of one of the left or right operating levers 260*a*, 260*b*. In other embodiments, the pin 256 may be a separate component coupled to the left and/or right safety levers. In one non-limiting embodiment of a pivot pin 256 integrally formed with the left operating lever 260*a*, the free terminal end 259 of pin 256 is configured to engage a complementary configured socket 258 in right operating lever 260*b* for coupling left and right operating levers together. The opposite arrangement may alternatively be provided in which the pin 256 is integral instead with the right lever 260*b*. The terminal end 259 and socket 258 may have an interlocking configuration such as polygonal or rectilinear in some implementations so that the pivot pin 256 cannot rotate independently of the operating lever. In the depicted embodiment, the terminal end 259 of left operating lever 260*a* comprises a pair of spaced apart protrusions having a rectilinear cross sectional shape which engage mating rectilinear recesses formed in the socket 258 of right operating lever 260*b*. Other interlocking non-rotational configurations may be used.

Left operating lever 260*a* may further include a transverse operating pin 260 configured to engage a lateral hole 261 formed proximate to the rear portion 250*b* of safety member 250. The operating pin functions to pivot the rear portion of safety member 250 about pivot pin 256 between the upward "safe" position (see, e.g. FIGS. 40A-B) and downward "fire" position (see, e.g. FIG. 39) when the safety member is actuated via the left or right operating levers 260*a*, 260*b*.

Figure 39:
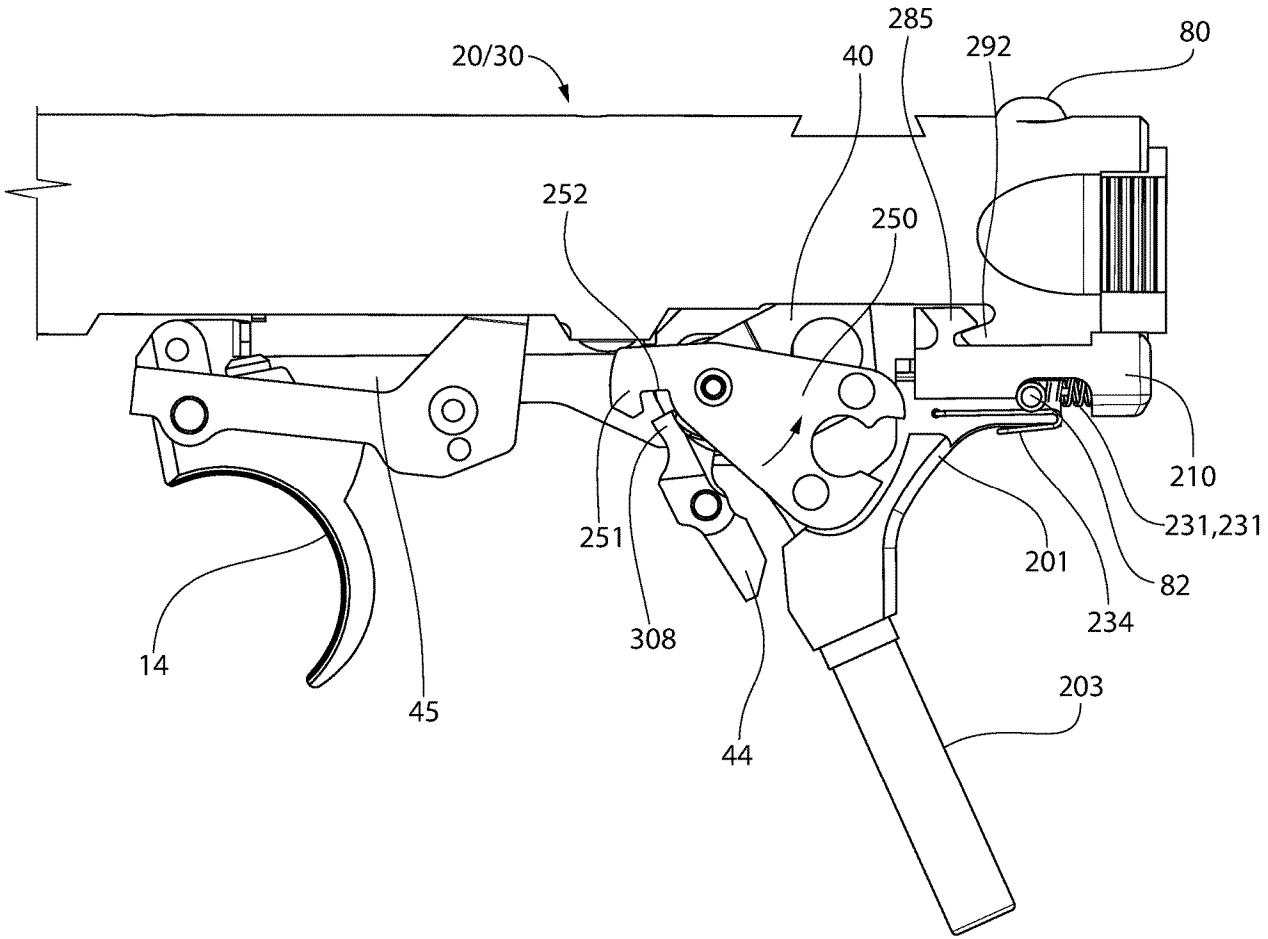
FIG. 39 is a side view showing the firing mechanism of the pistol with safety in the downward active "fire" position and barrel-receiver assembly latched.
Figure 40A:
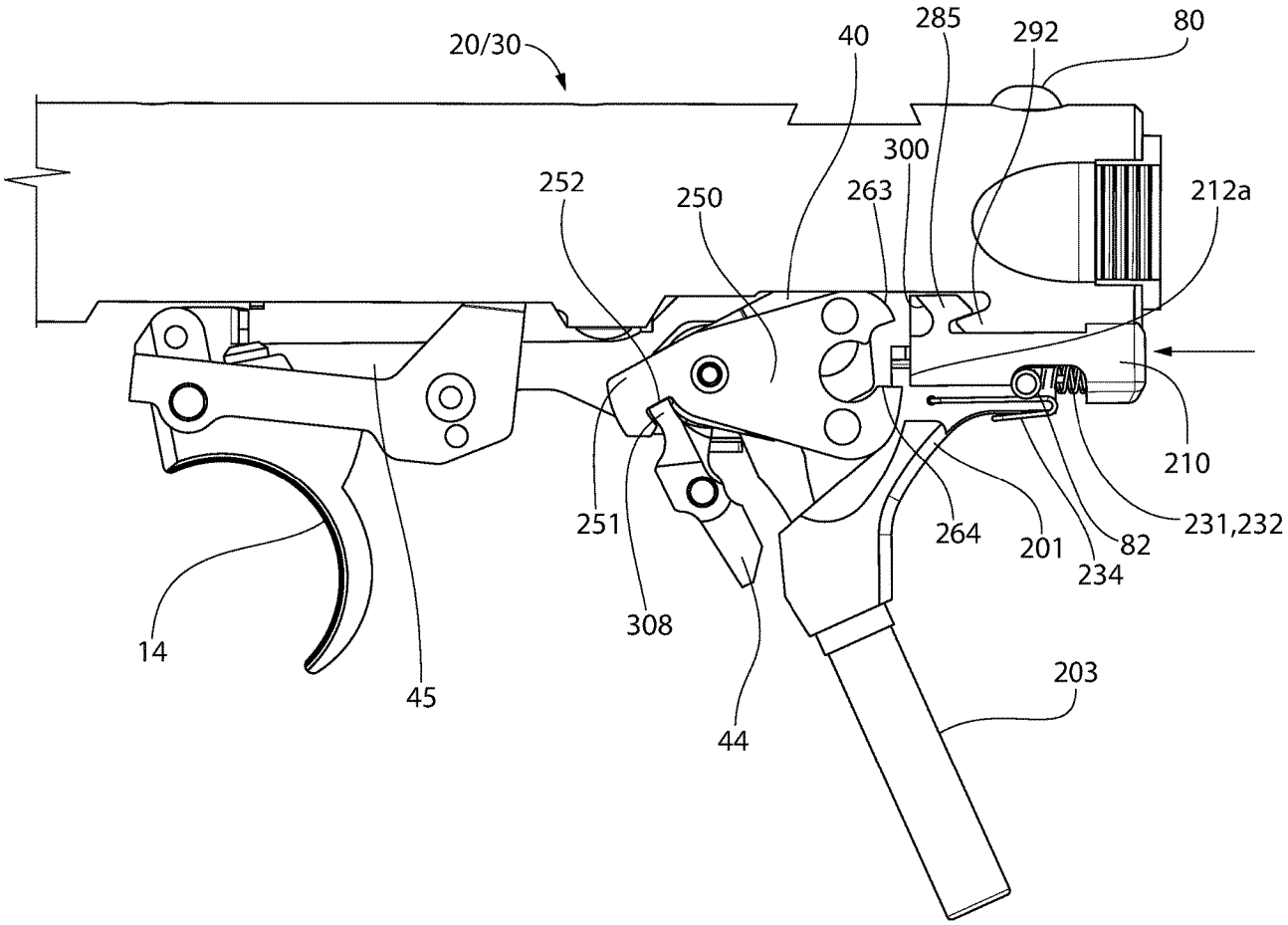
FIGS. 40A and 40B are side views showing the firing mechanism of the pistol with safety in the upward deactivated "safe" position and latch in the locked and unlocked positions, respectively.
Figure 40B:
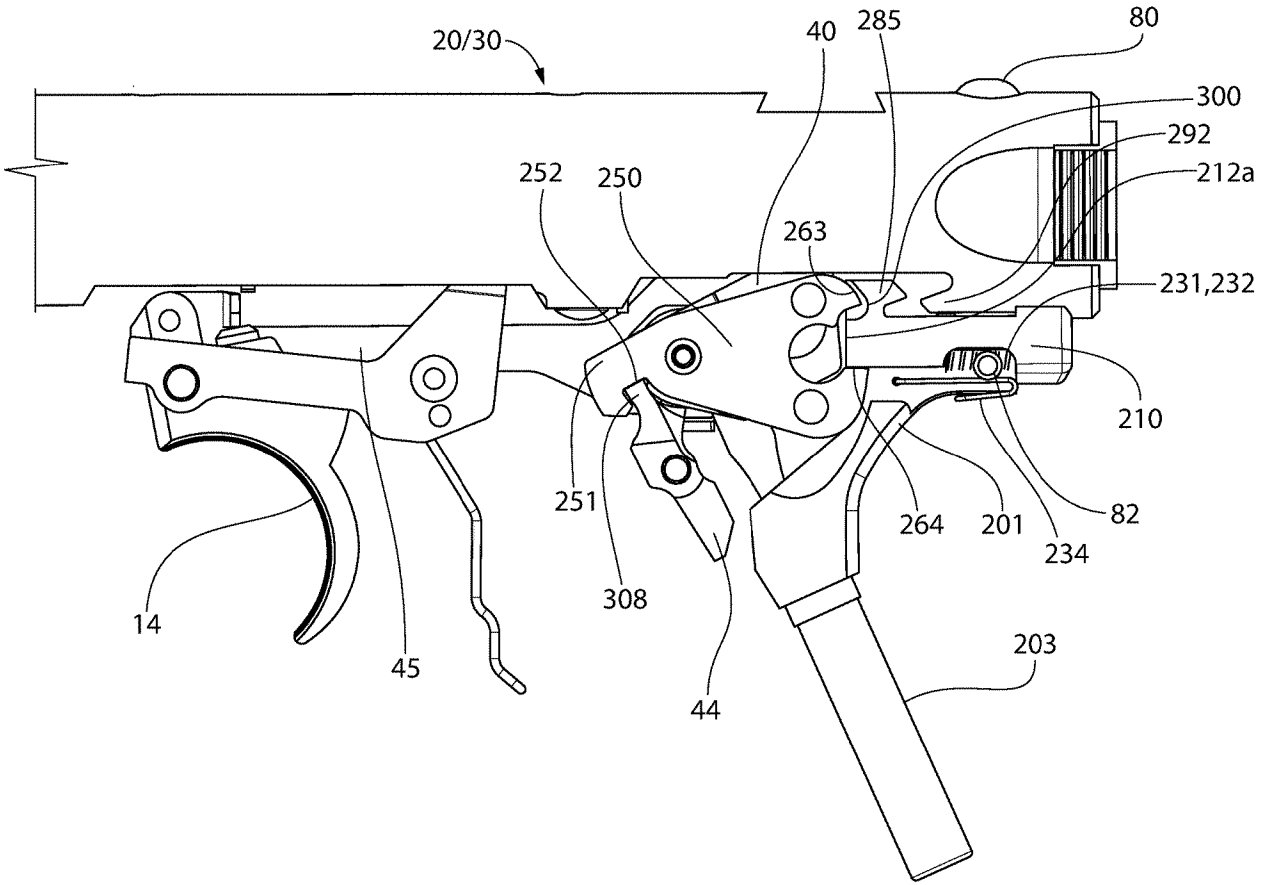

With continuing reference to FIGS. 28 and 36-38, the front portion 250*a* of safety member 250 includes a downwardly extending hook 251 configured and arranged to engage the sear 44 in a "safe" position (see, e.g. FIGS. 40A-B) and to disengage the sear in a "fire" position (see, e.g. FIG. 39). Because the hook 251 is forward of the pivot pin, moving the operating levers 260*a* or 260*b* (and concomitantly rear portion 250*b* of safety member 250) downwards raises the hook, and vice-versa. Accordingly, hook 251 pivots downwards to engage the sear 44 in the "safe" position and upwards to disengage the sear in the "fire" position. In one embodiment, a downwardly open recess is 252 is formed adjacent to and immediately rearward of the hook 251 in the bottom of the safety member 250 to lockingly receive an upward locking extension 308 of the sear 44 therein. This immobilizes the sear 44 to prevent its release and actuation of the firing mechanism via a trigger pull when the safety member 250 is in the "safe" position (FIGS. 40A-B). In configuration, a top portion of locking extension 308 and recess 252 may be rectilinear shaped to create position engagement and locking.

In one embodiment, the rear portion 250*b* of safety member 250 is configured to form the latching system interlock mechanism thereby advantageously eliminating the need for additional parts. Rear portion 250*b* includes a rearward facing blocking surface 263 and adjacent slot 264 which faces and opens rearward (see, e.g. FIGS. 36A-B). In one configuration, slot 264 has a larger height than axial length. Opening 264 may be sized to receive front latching end 212 of latch 210 at least partially therein. An abutment surface 265 may be formed within slot 264 to limit the maximum insertion depth and forward movement of latch 210. Surface 265 may be spaced apart and forward from the blocking surface 263 and rear end of the safety rear portion 250*b*. In one embodiment, opening 264 may communicate with hole 261 as shown.

Blocking surface 263 is positioned to selectively restrict or block the forward linear motion of latch 210, thereby preventing the latch from advancing far enough to uncoupled the barrel-receiver assembly 20/30 from the grip frame 12. The blocking surface 263 may be formed at the rear end of the safety's rear portion 250*b* and have an arcuate convex shape in one embodiment. In other embodiments, blocking surface 263 may have a flat or other shape. Blocking surface 263 is selectively alignable with and insertable into a forwardly open pocket 300 of latch 210. Pocket 300 may be formed in the front end surface 212*a* of the latch's upright protrusion 284 opposite the hook 285 and asymmetrically positioned with respect to the axial centerline CL of the latch (see, e.g. FIGS. 31-34). Pocket 300 may be disposed at a front corner of latch 210 and penetrate both front end surface 212*a* and lateral side 216. In one embodiment, pocket 300 may include arcuately concave surfaces which complement the convexly shaped blocking surface 263 of safety member 250.

A spaced apart pair of indicia 262 may be provided to visually indicate whether the safety is in the "safe" or "fire" positions. Indicia 262 are visible through a lateral window 266 formed in the left lateral side 15 of grip frame 12 (see, e.g. FIG. 28).

Operation of the latch and interlock systems will now be briefly described. FIGS. 41A-B show pistol 10 in the ready-to-fire operating condition. Latch 210 is shown in the rearward locked position holding the barrel-receiver assembly 20/30 in the closed position for firing. The latch hook 285 is engaged with recess 287 of the barrel-receiver assembly.

Safety member 250 is also shown in the pivoted "fire" position with hook 251 raised upward and disengaged from the sear 44. Blocking surface 263 of safety member 250 is shown in the downward blocking position and axially aligned with a part of latch front end portion 212 (i.e. front end surface 212*a*) located below the latch hook 285. In this position, forward movement of latch 210 sufficient to unlock the barrel-receiver assembly 20/30 is prevented wherein the blocking surface 263 will engage the latch.

Figure 43A:
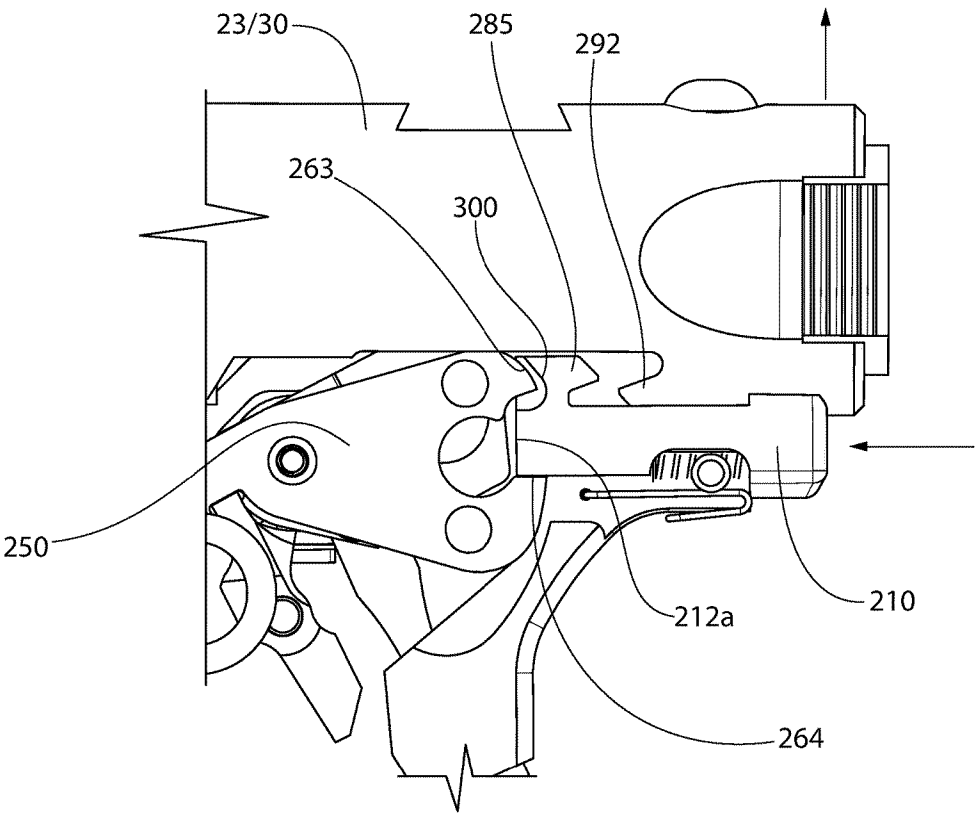
Figure 43B:
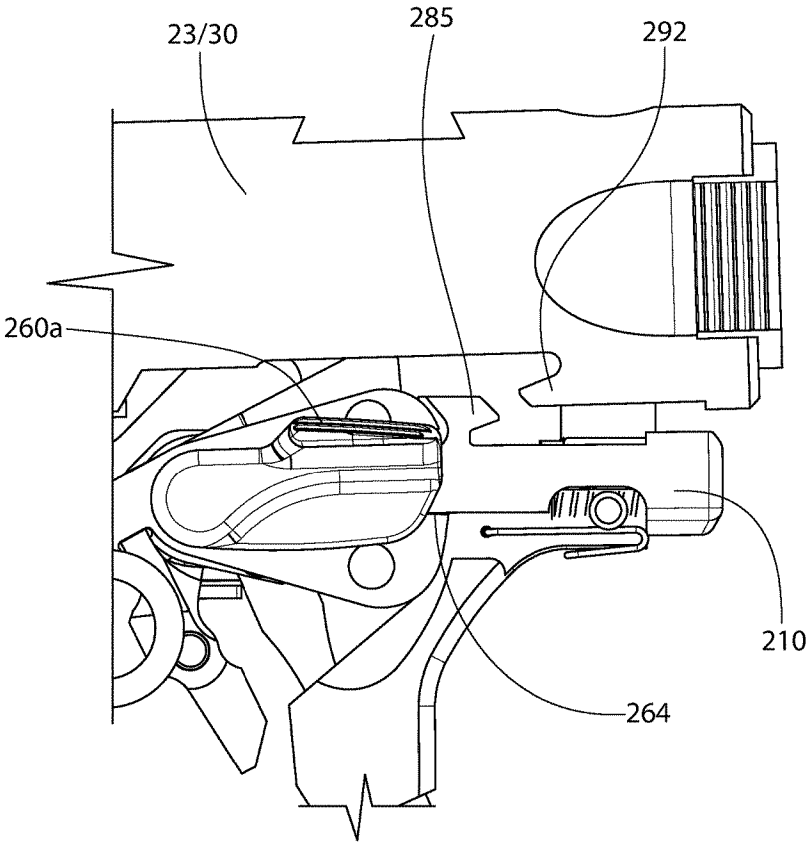

To open the pivotably coupled barrel-receiver assembly 20/30, the safety member 250 is first pivotably moved to the upward "safe position," as shown in FIGS. 43A-B. Hook 251 moves downward to engage and arrest movement of the sear 44, thereby preventing discharge of the pistol. This motion also essentially simultaneously raises the safety rear portion 250*b* upwards to axially align blocking surface 263 with the pocket 300 in the front end surface 212*a* of latch 210. The barrel-receiver assembly 20/30 is now readied for opening.

Referring to FIGS. 42A-B and 43A-B, the latch 210 is then slideably pushed forward to the unlocked position for opening the barrel-receiver assembly 20/30. Blocking surface 263 of safety member 250 enters the frontal pocket 300 of the latch 210 and latch front end portion 212 enters slot 264 of the safety member 250. This allows the latch to move sufficiently forward to disengage the latch hook 285 from recess 287 of barrel-receiver assembly 20/30. Abutment surface 265 on the rear portion 250*b* of the safety limits the forward axial motion of the latch 250. It bears noting that this latch motion also at least partially compresses latch spring assembly 230 which must be manually held against the rearward biasing force of the spring. FIG. 43A shows the barrel-receiver assembly still engaged with latch 210, but unlocked.

Figure 44A:
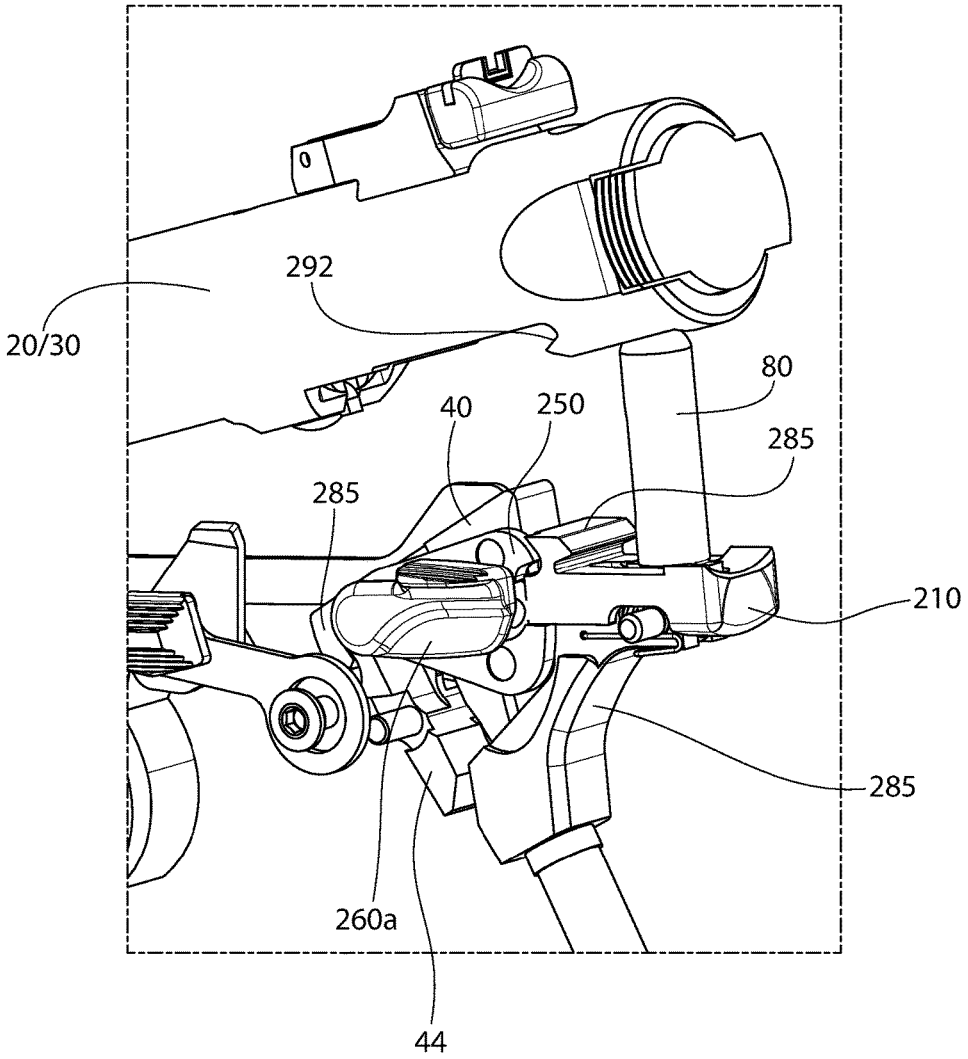
FIGS. 44A-B are side perspective views showing the barrel-receiver assembly in one unlatched and open position with and without the frame visible, respectively.
Figure 44B:
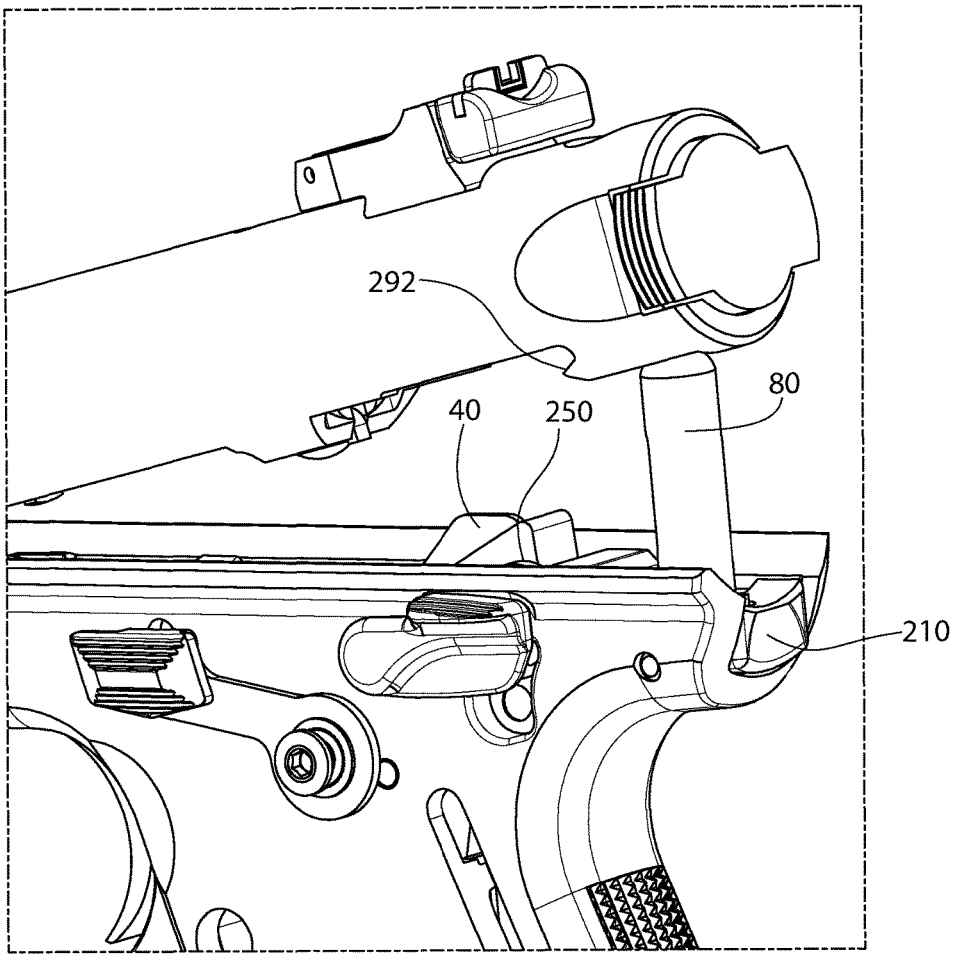

With the latch 210 held in the forward unlocked position, the rear end of the barrel-receiver assembly 20/30 is pivotably raised upwards to open the pistol 10. FIG. 43B shows the barrel-receiver assembly 20/30 in the process of initial separation from the grip frame 12 in which the barrel-receiver assembly is now disengaged from latch 210. The barrel-receiver assembly may now be more fully opened as shown in FIG. 44A-B for inspection and/or maintenance. In one embodiment, the barrel-receiver assembly may be opened than shown until the bolt stop pin 80 fully disengages the assembly as shown in FIG. 5. It should be noted that once the barrel-receiver assembly is uncoupled from the rear end of the grip frame 12, the latch 210 may be released and will automatically return to its rearward position under the biasing action of latch spring assembly 230.

To reclose the pistol and relock the barrel-receiver assembly 20/30, the rear end of the assembly is pivoted back downward towards the grip frame 12. With the latch 210 in the biased rearward position, the mating obliquely angled closure surfaces 286 and 294 of the latch and barrel-receiver assembly respectively mutually engage each other to slightly displace the latch forward as already described herein. When surface 294 passes below and disengages surface 286, latch spring assembly 230 will automatically return the latch to the rearward position, thereby engaging the latch hook 285 with the barrel-receiver assembly recess 287 to lock the barrel-receiver assembly without the user having to manually push the latch forward. An audible "click" may be produced to advise the user that the pistol has properly relocked and the latch returned to the rearward locked position (see, e.g. FIGS. 41A-B).

Components of the alternative latching and safety systems described above may be made of any suitable material including without limitation metallic materials (e.g. steel including stainless steel, titanium, aluminum, etc.) or non-metallic materials (e.g. unfilled or glass reinforced polymers, composites, etc.). In some embodiments, some or all of these components or portions thereof may be made of a combination of metallic and non-metallic materials.

Removable Barrel-Receiver Assembly

FIGS. 45-55 illustrate an alternative embodiment of a barrel-receiver assembly mounting system. In this embodiment, the barrel-receiver assembly 20/30 is specially configured in a unique manner for complete removal from the firearm grip frame 12 to permit unobstructed access to the firing mechanism of the pistol 10 while the pivot pin 60 remains in the frame. This contrasts to the prior embodiment shown in FIGS. 5, 6, 8, 9, and 28 described above in which the barrel-receiver assembly always remains attached to the grip frame 12 even in the tilted open position. The completely removable barrel-receiver assembly may be used with either of the two latch system embodiments disclosed herein, and therefore is not limited to the type of latch employed to lock and unlock the barrel-receiver assembly from the frame 12.

Figure 45A:
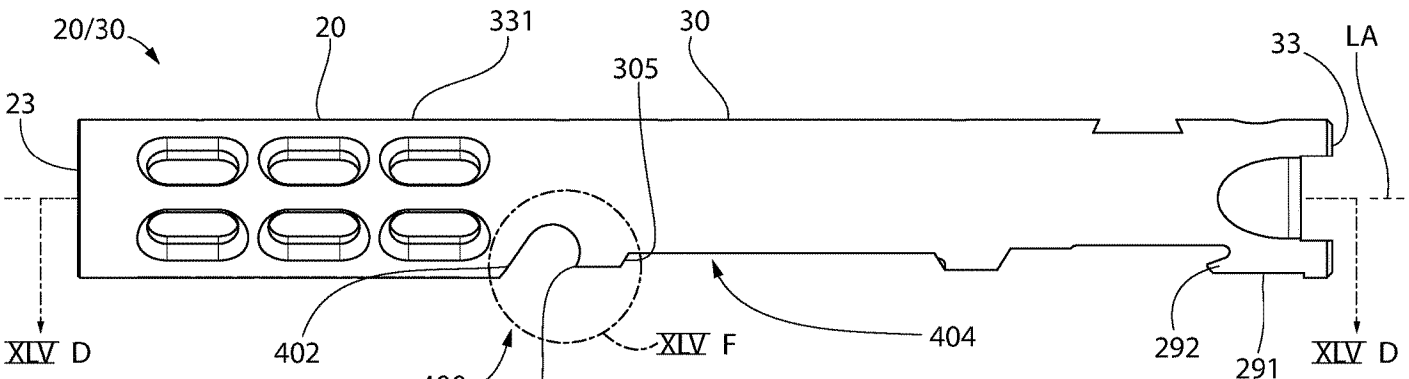
FIGS. 45A-H show various views of an embodiment of a pistol having a completely removable barrel-receiver assembly with a hooked lug.
Figure 45B:
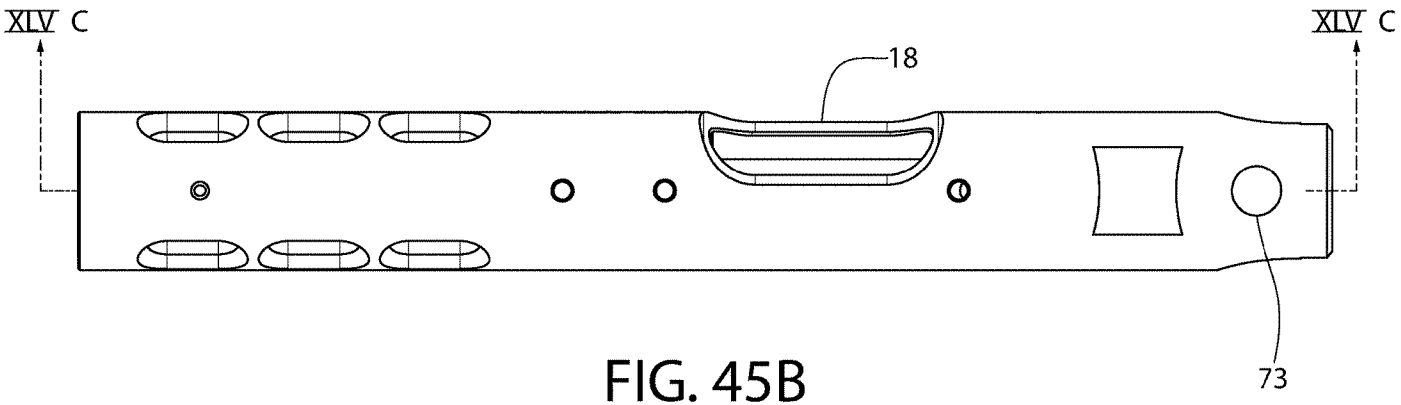
Figure 45C:
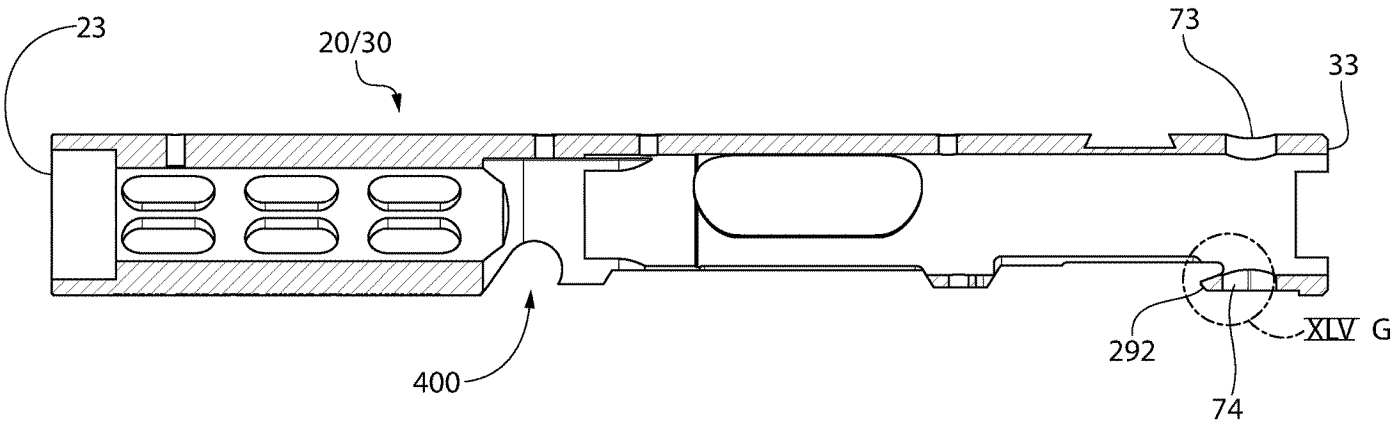
Figure 45D:
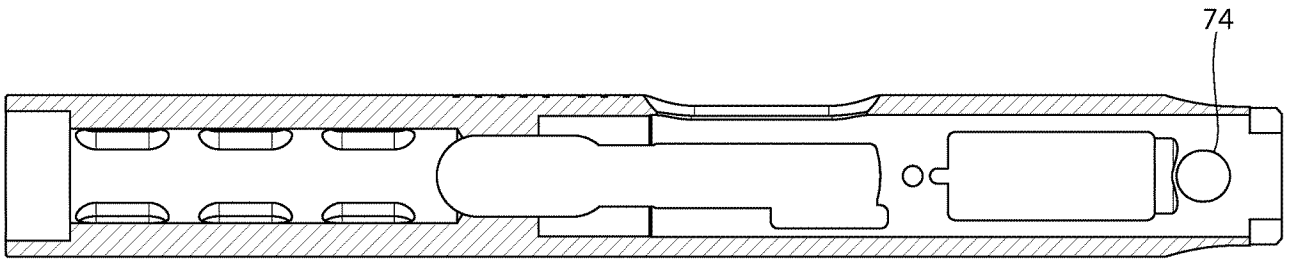
Figure 45E:
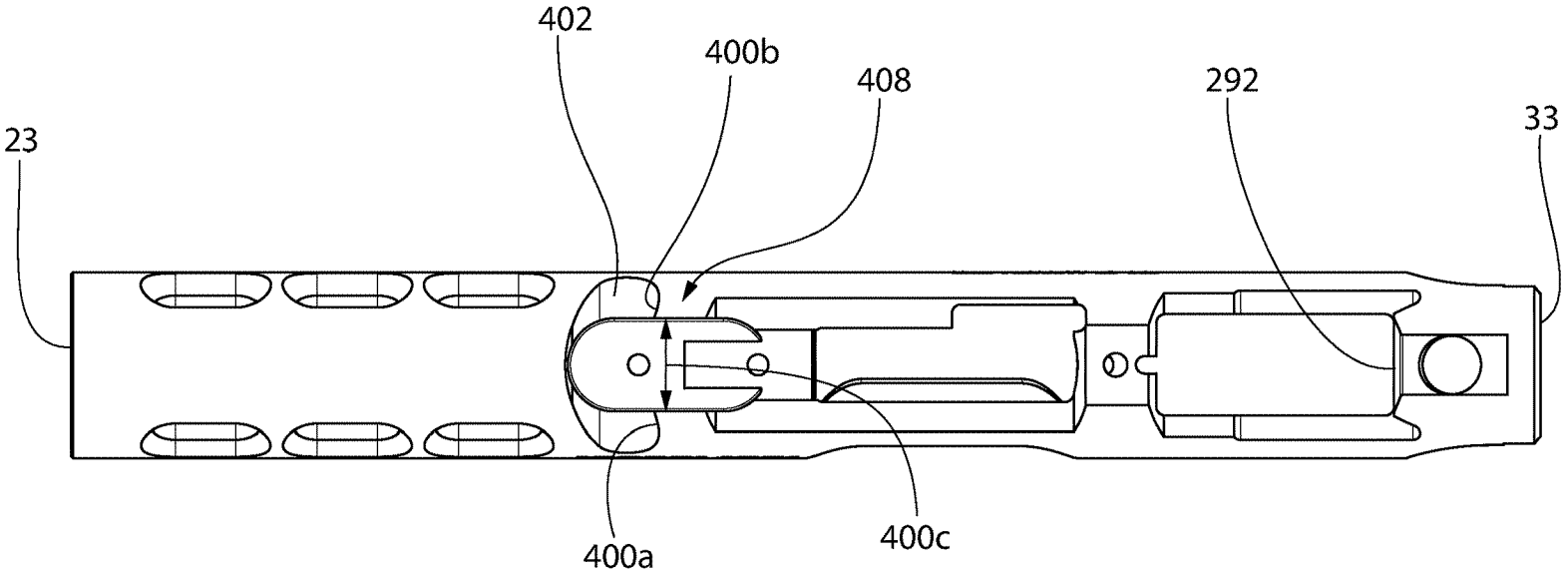

Referring to FIGS. 45A-H, the barrel-receiver assembly 20/30 includes a downwardly and forwardly projecting hooked lug 400 configured to detachably engage transversely oriented pivot pin 60 which is mounted to front end 17 of grip frame 12, as already described herein (see, e.g. FIG. 28). In one embodiment, hooked lug 400 may be formed on a downwardly extending mounting protrusion 408 of the barrel-receiver assembly. The leading front edge of hooked lug 400 may form a relatively pointed linear edge which extends laterally between the sides of the barrel-receiver assembly 20/30. In one embodiment, the lug 400 may have a bifurcated structure of right and left hooked lugs 400*a*, 400*b*. Lugs 400*a* and 400*b* are laterally spaced apart and separated by an axially extending slot 400*c*, as best shown in FIGS. 45E & H. In other possible configurations, hooked lug 400 may be comprised of a single hooked lug.

Hooked lug 400 may be formed as an integral structural part of the barrel-receiver assembly 20/30, or alternatively may be formed at least in part by a separate component or appendage attached to the barrel-receiver assembly. In one implementation, hooked lug 400 extends in a substantially horizontal axial direction parallel to longitudinal axis LA such that the lug portion does not extend downwards beyond the bottom surface 404 of the barrel-receiver assembly at protrusion 408 (see also FIGS. 46-47).

A stepped shoulder is formed between the rear of the mounting protrusion 408 and bottom surface 404 of the barrel-receiver assembly in the receiver 30 portion which defines a substantially vertical rear facing thrust surface 305. When the barrel-receiver assembly is in the closed position, thrust surface 305 is positioned to abuttingly engage a mating substantially vertical front facing thrust surface 306 formed in the grip frame 12 (see, e.g. FIGS. 46-47 and 54-55). Because discharging the pistol produces recoil forces which act to thrust the barrel-receiver assembly 20/30 in a rearward axial direction, mutual engagement of thrust surfaces 305 and 306 both distributes the forces to the frame 12 to arrest the barrel-receiver assembly and further keeps the pivot pin 60 positively engaged within a downwardly open mounting slot 402 formed adjacently forward of and above the hooked lug 400 described below.

Notably, the thrust surfaces 305, 306 and obliquely oriented angled slot 402 in the barrel-receiver assembly 20/30 are cooperatively configured and arranged so that the barrel-receiver assembly cannot be vertically lifted off the frame 12 when in the horizontal position. Referring to FIGS. 46, 47, 51, 54, and 55, the downward extending mounting protrusion 408 of the barrel-receiver assembly is captured in an upwardly open mounting receptacle 454 formed between the pivot surface on pin 60 (or pivot insert 450 shown in FIGS. 52-55) and front facing thrust surface 306 of the frame when the barrel-receiver assembly is in the closed position (see, e.g. FIG. 51). The hooked lug 400 of the barrel-receiver assembly is engaged partially under the pivot surface of the pin or insert if provided instead causing an interference between the hook and pivot surface which prevents vertically lifting the horizontal barrel-receiver assembly off of the frame.

In order to remove the barrel-receiver assembly, the assembly must first be tilted upwards about the pivot surface to disengage the hooked lug 400 from the pivot surface by a sufficient amount to allow the barrel-receiver assembly to be lifted vertically off frame 12 in a tilted angular position with respect to the frame. In this removal position, the mounting slot 402 in barrel-receiver assembly mounting protrusion 408 is substantially vertical with respect to the top longitudinal edges 15*a* of the frame 12. The bottom surface 404 of the barrel-receiver assembly is obliquely angled to the top longitudinal edges 15*a*.

Hooked lug 400 may be defined in one embodiment by the mounting protrusion 408 of the barrel-receiver assembly and adjacent mounting slot 402 located forward of the lug. Mounting slot 402 is elongated and may be straight or arcuately curved in some embodiments. In one implementation, slot 402 may be located at the forward part of the receiver 30 at the interface between the barrel 20 and receiver as shown. The location of the slot 402 may be varied in other embodiments and may be formed in the barrel or receiver. The curved mounting slot 402 has a compound shape, as further described below. In one non-limiting construction, slot 402 may be formed as an integral structural part of the monolithic barrel-receiver assembly 20/30, or alternatively may be formed at least in part by a separate component or appendage attached to the barrel-receiver assembly. In other embodiments contemplated, the hooked lug 400 and slot 402 may be have different configurations than shown herein.

Mounting slot 402 includes a closed top end 403 defined by a wall of the mounting protrusion 408 and a downwardly open bottom end 401 which penetrates the bottom surface 404 of barrel-receiver assembly 20/30. The frame 12 and slot closed end 403 are mutually configured and orientated to capture the pivot pin 60 in a manner so that the barrel-receiver assembly cannot be vertically lifted straight off of the frame without first unlocking and then tilting the barrel-receiver assembly forward and downward to the open position. Closed end 403 may be arcuately concavely curved in one embodiment to match the curvature of arcuately curved pivot pin 60 so that the pin is securely nested therein when the barrel-receiver assembly 20/30 is mounted to grip frame 12. The open end 401 of the slot 402 defines an entranceway configured and dimensioned to slideably receive the pivot pin 60 therein and therethrough.

Figure 46:
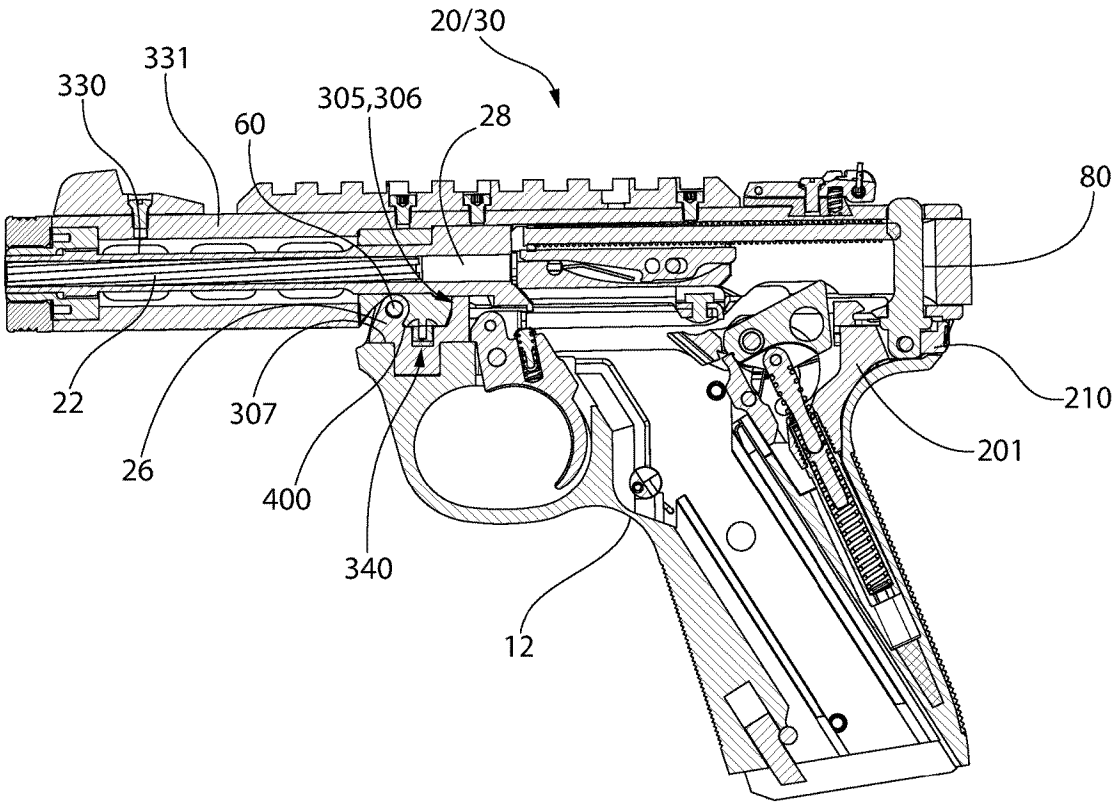
FIG. 46 is a side cross-sectional view of the pistol showing the barrel-receiver assembly in a closed and latched position.

In one embodiment, the entranceway to slot 402 may be formed by a pair of substantially parallel spaced apart front and rear angled entranceway walls 405 arranged obliquely to the longitudinal axis LA of pistol 10 and a horizontal portion of bottom surface 404 of the receiver 30 adjacent the walls which is parallel to axis LA. Entranceway walls 405 of mounting slot 402 are each contiguous with and parallel to a pair of substantially parallel front and rear upper angled walls 406 which extend upwards from the entranceway walls to closed end 403 of the slot 402. Walls 405 and 406 are arranged obliquely to a vertical slot axis VA defined by slot 402. Vertical axis VA is defined as a transverse axis perpendicular to longitudinal axis LA of pistol 10. In one embodiment, angled walls 405 and 406 may be disposed at an angle Av between 0 and 90 degrees to the slot vertical axis VA, and more preferably between 0 and 45 degrees. In one non-limiting embodiment, the angle Av may be about 35 degrees. The foregoing arrangement and combination of surfaces 405, 406 with their respective orientations helps insert and retain the pivot pin 60 in the closed end 403 of the slot when the barrel-receiver assembly 20/30 is mounted to the grip frame 12 and in the closed position (i.e. un-tilted) as shown in FIG. 46.

Referring to FIGS. 45A-E and 46-48, the barrel portion 20 of the barrel-receiver assembly 20/30 in one embodiment may be a two-piece component comprising an outer jacket or sleeve 331 which contains therein an inner detachable tubular barrel insert 330. Barrel insert 330 may be at least partially cylindrical in shape and defines the axially extending bore 22 for passing a projectile and rear chamber 28 for holding the ammunition cartridge. The cartridge feed ramp is disposed at the rear of the chamber on the insert 330. Such barrel inserts are disclosed for example in U.S. Pat. No. 8,701,326, which is incorporated herein by reference in its entirety. In other embodiments, the barrel 20 may be a standard one-piece component (see, e.g. FIGS. 5 and 6).

In lieu of the barrel-receiver assembly bottom slot 402 and adjoining hooked lug 400 directly engaging the pivot pin 60 alone, an alternative embodiment of the arrangement used to pivotably mount the completely removable barrel-receiver assembly 20/30 to the grip frame 12 is shown in FIGS. 46, 47, and 51-55. To provide a structurally robust and smooth operating pivot mechanism resistant to possible vibrational noise or rattling induced by firing the pistol, the slot 402 and hooked lug 400 instead pivotably engages the frame 12, and in one embodiment a separate frame pivot insert 450 removably mounted in the frame.

Figure 54:
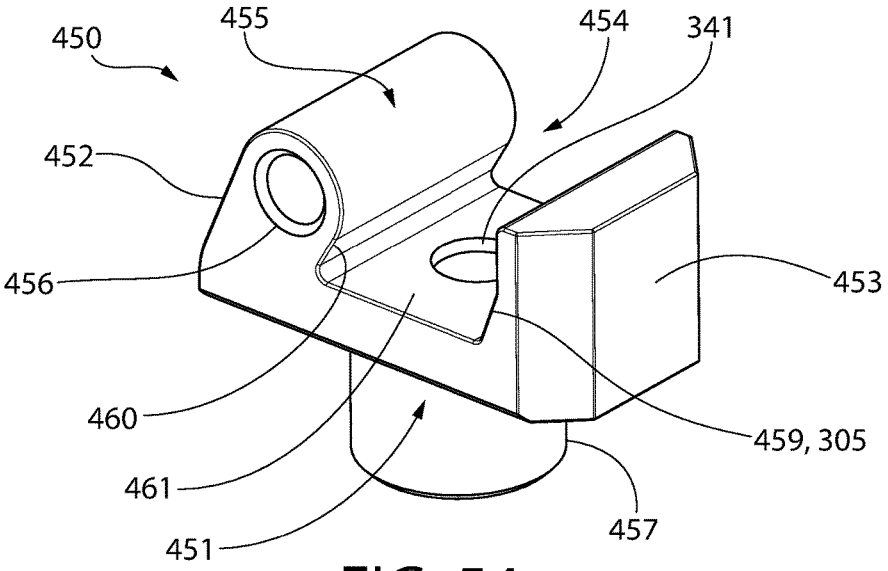
FIG. 54 is a perspective view of the frame pivot insert.
Figure 55:
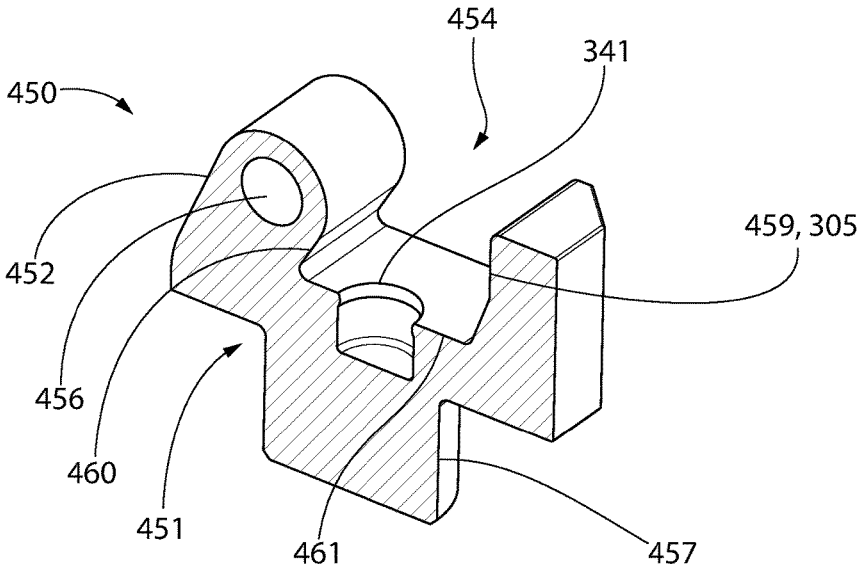
FIG. 55 is a cross sectional view thereof.

Pivot insert 450 generally comprises a main body 451, a front pivot protuberance 452 extending upwards from the body, a rear portion 453 extending upwards from the body and longitudinally spaced apart from the pivot protuberance, and a mounting stem 457 extending downwards from the body. The space between the pivot protuberance and rear portion defines an upwardly open receptacle 454 having a complementary configuration to the downwardly extending mounting protrusion 408 of the barrel-receiver assembly on which the hooked lug 400 is formed. Receptacle 454 in this embodiment comprises a rear wall 459 (defined by rear portion 453 of insert 450), a front wall 460 (defined by pivot protuberance 452), and a flat horizontal bottom wall 461 extending therebetween. Rear wall 459 may substantially vertical, and in one embodiment may comprise a straight vertical upper section and obliquely angled bottom section (with respect to bottom wall 461) between the main body 451 and upper section to complement the shape of the rear portion of barrel-receiver assembly protrusion 408 (see, e.g. FIG. 45A). The angled section facilitates smooth insertion and removal of the barrel-receiver assembly mounting protrusion 408 when the assembly is opened and closed. Rear wall 459 may be completely straight in other embodiments. It bears noting that rear wall 459 of the insert 450 defines the front facing thrust surface 306 of the frame as indicated in FIGS. 54 and 55. Front wall 460 may have an angled shape (with respect to bottom wall 461) to complement the angled shape of the hooked lug 400 on the front portion of barrel-receiver assembly protrusion 408. In some embodiments, pivot protuberance 452 may be obliquely angled to bottom wall 461 and longitudinal axis LA (when the insert 450 is mounted in the frame 12) providing a complementary angle to the front portion of the mounting protrusion 408 which defines the hooked lug.

Figure 45F:
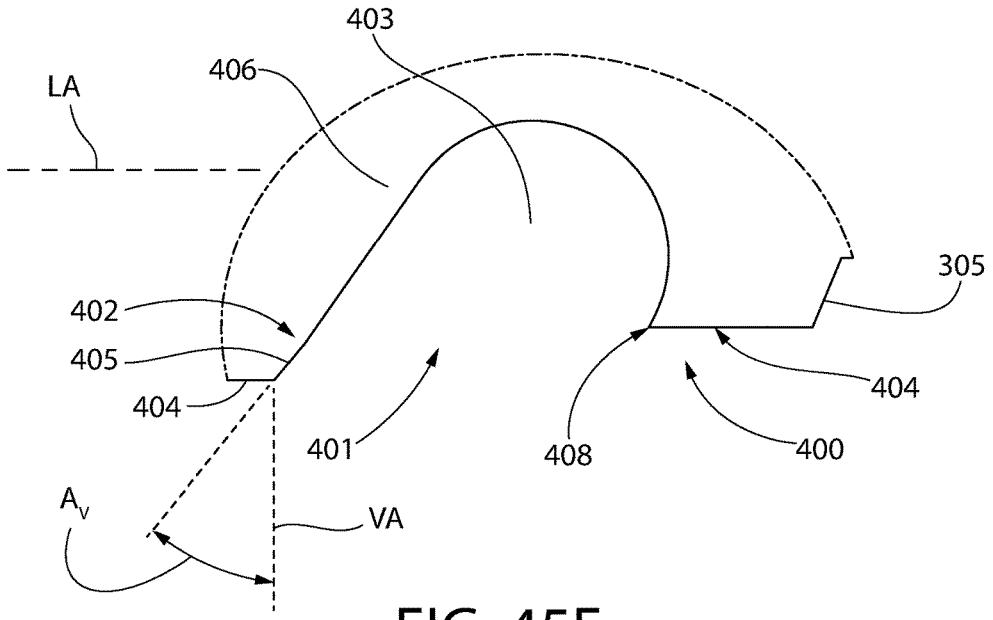
Figure 45G:
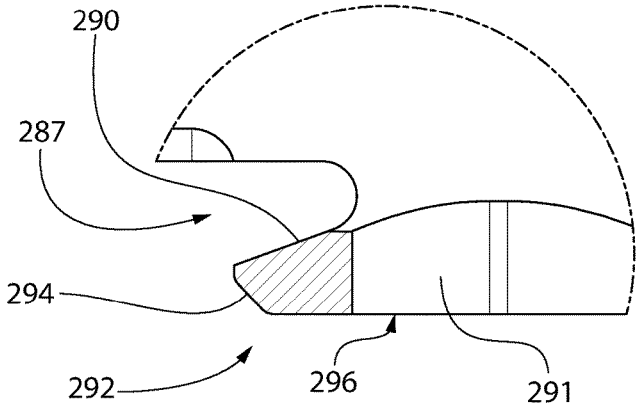
Figure 45H:
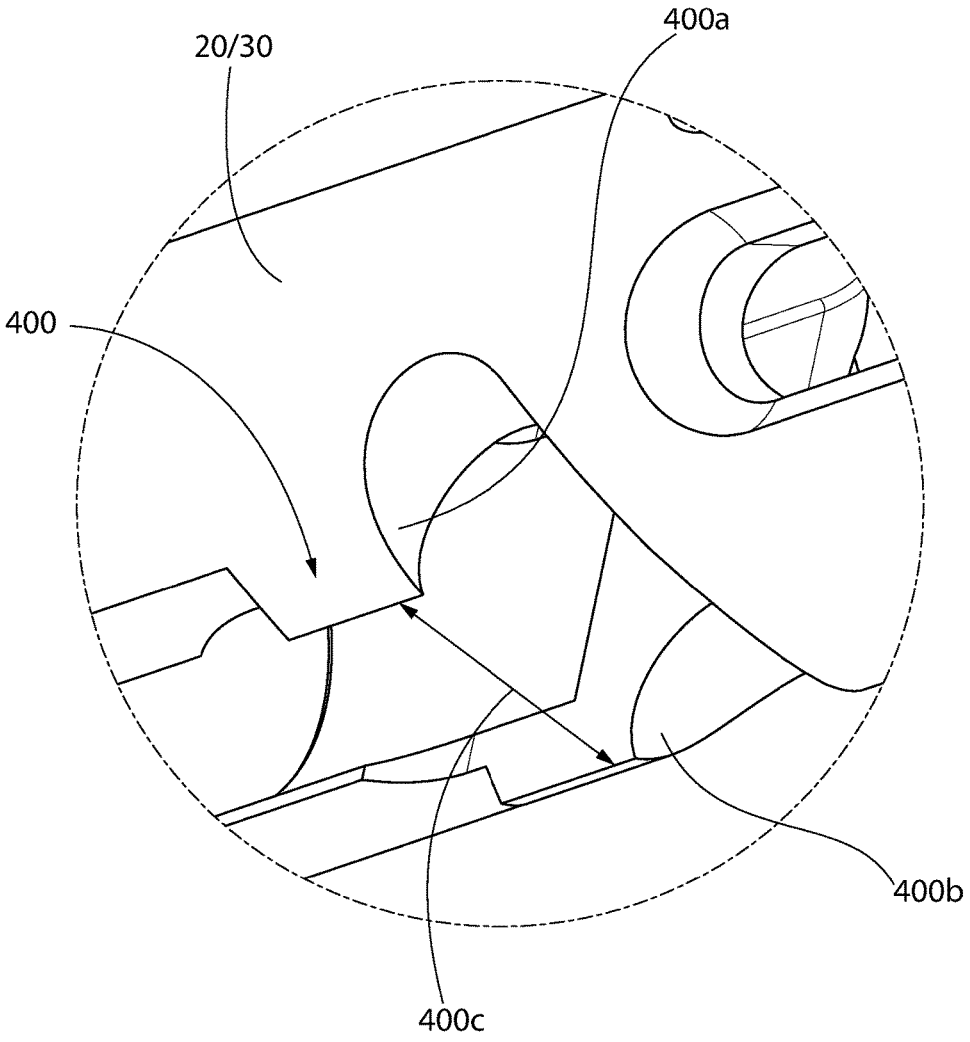

In the present embodiment being described, the pivot protuberance 452 of the frame pivot insert 450 may be barrel-shaped having has a convexly curved configuration which defines a transversely elongated arcuate pivot surface 455 that engages the complementary concavely curved closed top end 403 of barrel-receiver assembly mounting slot 402 defined by a wall of the barrel-receiver assembly mounting protrusion 408 (see, e.g. FIG. 45F). The mutually engaged curved surfaces of the protrusion 408 in slot 402 and pivot protuberance 452 provide smooth titling action of the barrel-receiver assembly 20/30 on frame 12. It bears noting that in embodiments described above in which the hooked lug 400 directly engages a pivot pin 60, the arcuately curved pivot surface is instead defined by the pin instead of the pivot protuberance.

To mount the frame pivot insert 450, the mounting stem 457 of the insert is inserted into an upwardly open hole 460 in frame 12. The pivot protuberance 452 includes a laterally open through hole 456 which is concentrically aligned with holes 21 in the frame mounting protrusions 26. A lock pin 461 is inserted through holes 21 and 456 to complete securement of the pivot insert 450 in the frame. It bears noting that the hooked lug 400 of the barrel-receiver assembly 20/30 engages the pivot protuberance 452, and not the lock pin 461 which only serves to retain the pivot insert 450 in frame 12. In embodiments of the barrel-receiver assembly having a hooked lug 400 with the bifurcated structure described above, the right and left hooked lugs 400*a*, 400*b* each engage the pivot protuberance 452 and function in the same manner as a single hooked lug 400. Insert 450 may be made of any suitable metallic or non-metallic material.

In alternative embodiments, the features of the frame pivot insert 450 including pivot protuberance 452 with pivot surface 455 and receptacle 454 may instead be formed as a monolithic unitary structural part of the frame in lieu of a detachable pivot insert.

In some embodiments, a resiliently compressible rubber or elastomeric bumper 340 may be provided to produce a snug or tight connection between the hooked lug 400 of barrel-receiver assembly 20/30 and frame 12 when the assembly is in the closed position. Referring to FIGS. 28, 46, 47, and 51 (detail from FIG. 47), the bumper 340 may comprise a bulbous head at top and a diametrically smaller stem extending downwards from the top. The head may be convex and semi-circular in shape in one embodiment. The stem is inserted in an upwardly open vertical bore 341 formed in the front of the frame 12 between the barrel-receiver assembly mounting protrusions 26 which mounts the bumper 340 to the frame. In embodiments of the barrel-receiver assembly having a frame pivot insert 450 described above, the vertical bore 341 may alternatively be formed in the insert (see, e.g. FIGS. 51-55). When the barrel-receiver assembly 20/30 is pivoted from the open position shown in FIG. 47 to the closed position shown in FIG. 46, the bottom surface on the underside of the downwardly extending protrusion 408 of the barrel on which the hooked lug 400 is formed presses downwards against and compresses the bumper 340. The bumper 340 in response exerts an upward spring-like force acting against the underside of the barrel protrusion 408 which maintains a snug and tight connection when the barrel-receiver assembly is closed and latched. Bumper 340 may be made of any suitable resilient material having an elastic memory. In other embodiments contemplated, such as rubber, urethane, or other materials.

Figure 47:
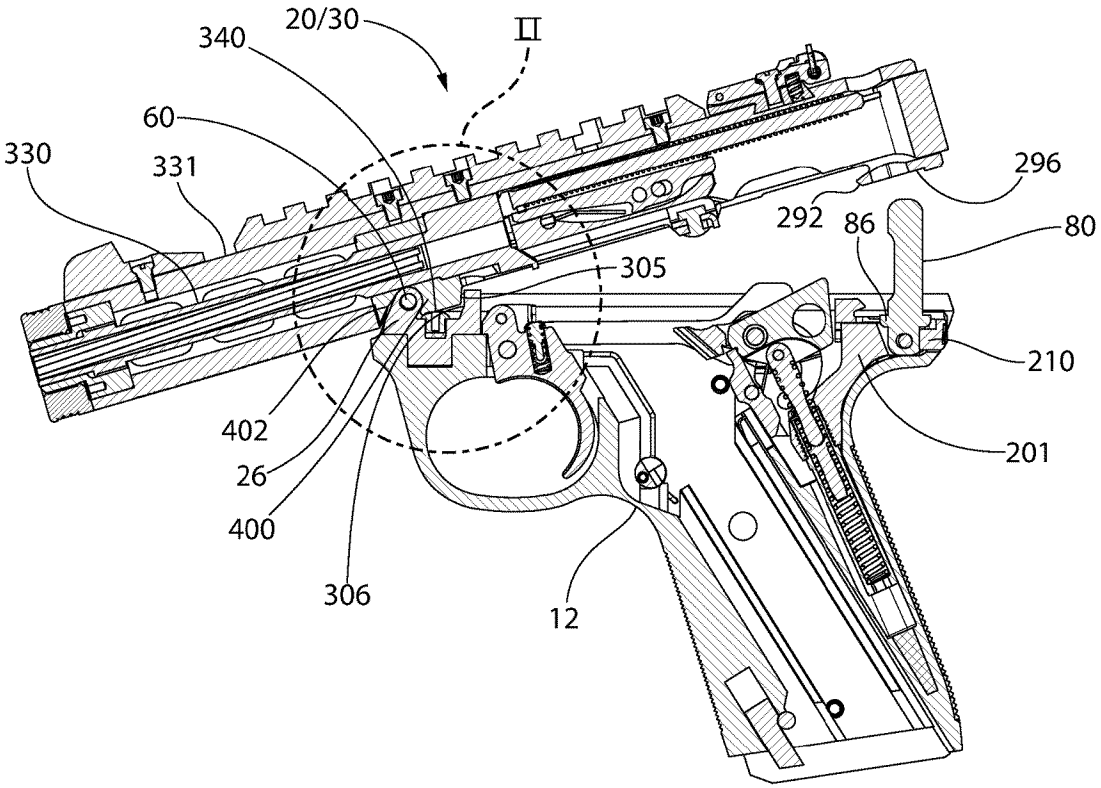
FIG. 47 is a side cross-sectional view of the pistol showing the barrel-receiver assembly in a tilted open and unlatched position.
Figure 48:
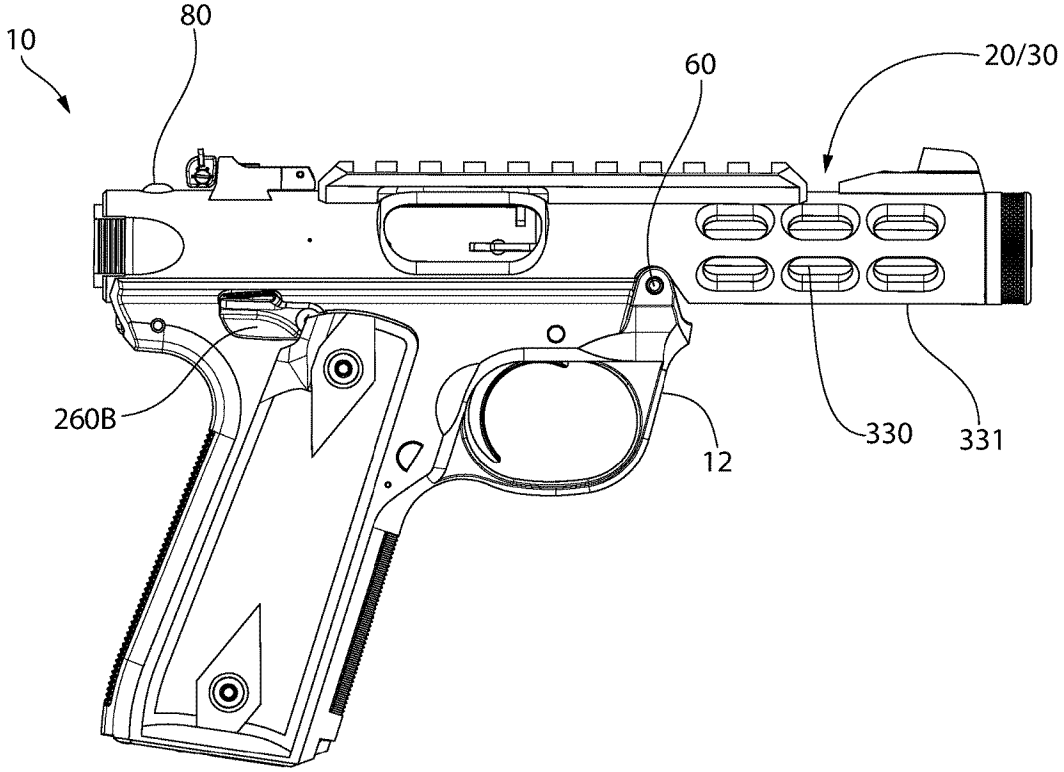
FIG. 48 is a side view showing the pistol with barrel-receiver assembly in a fully closed position.
Figure 49:
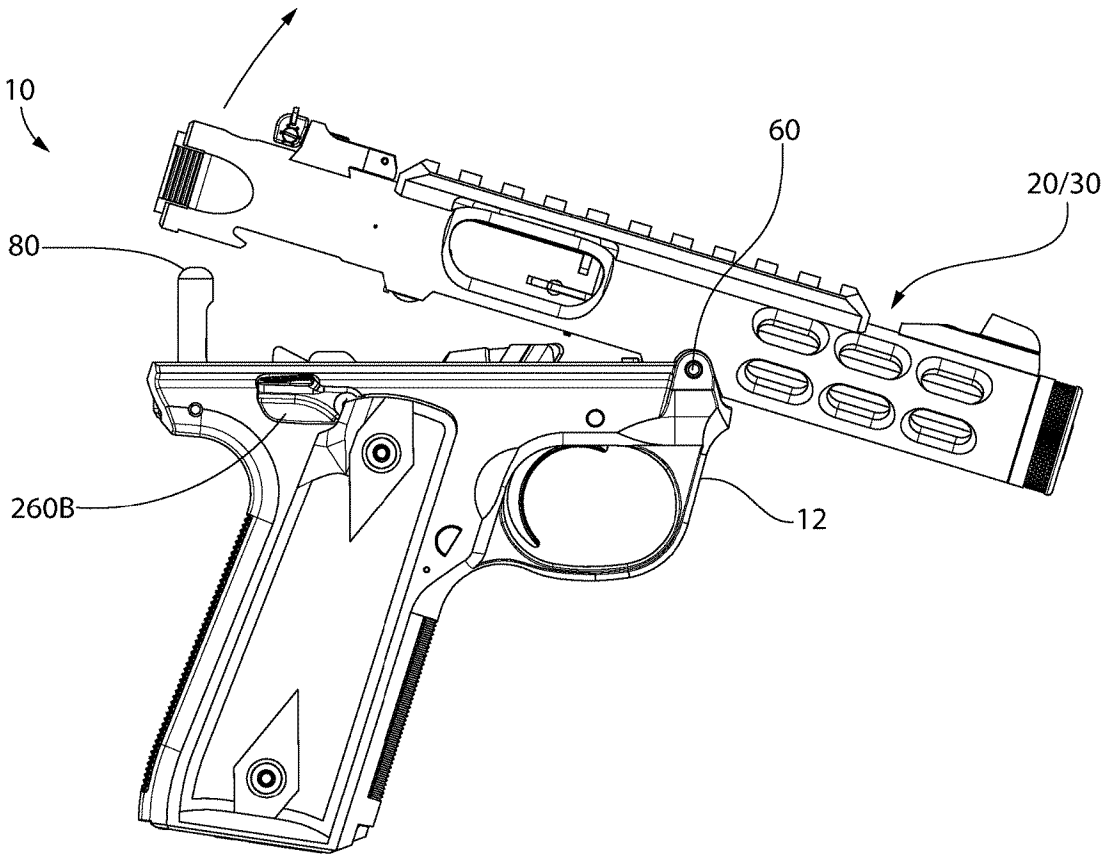
FIG. 49 is a side view showing the barrel-receiver assembly in a tilted open position.
Figure 50:
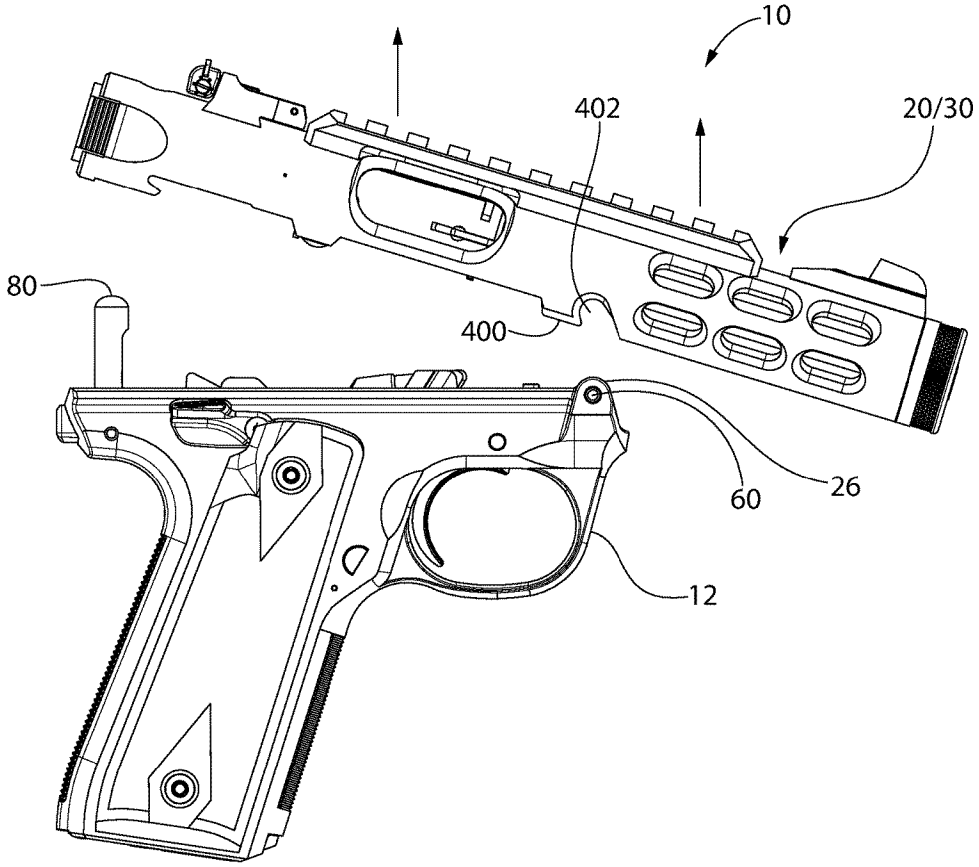
FIG. 50 shows the barrel-receiver assembly completed dismounted from the pistol with the pivot pin still in place.
Figure 51:
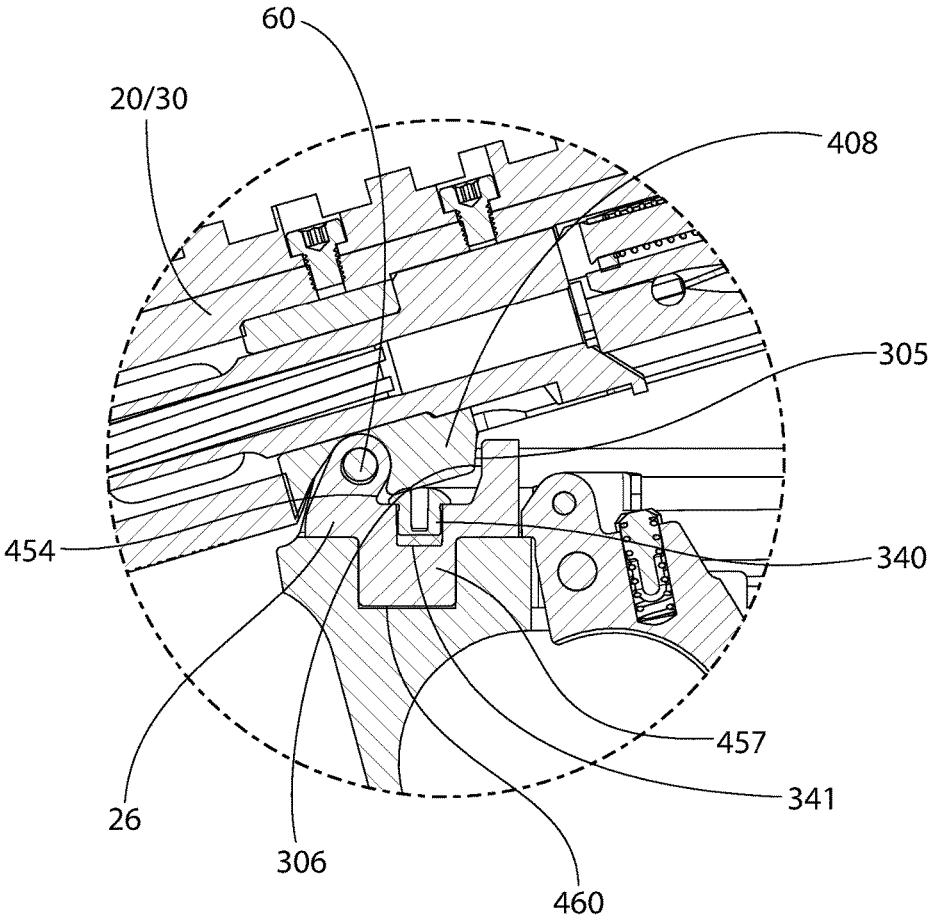
FIG. 51 is an enlarged detail taken from FIG. 47.
Figure 52:
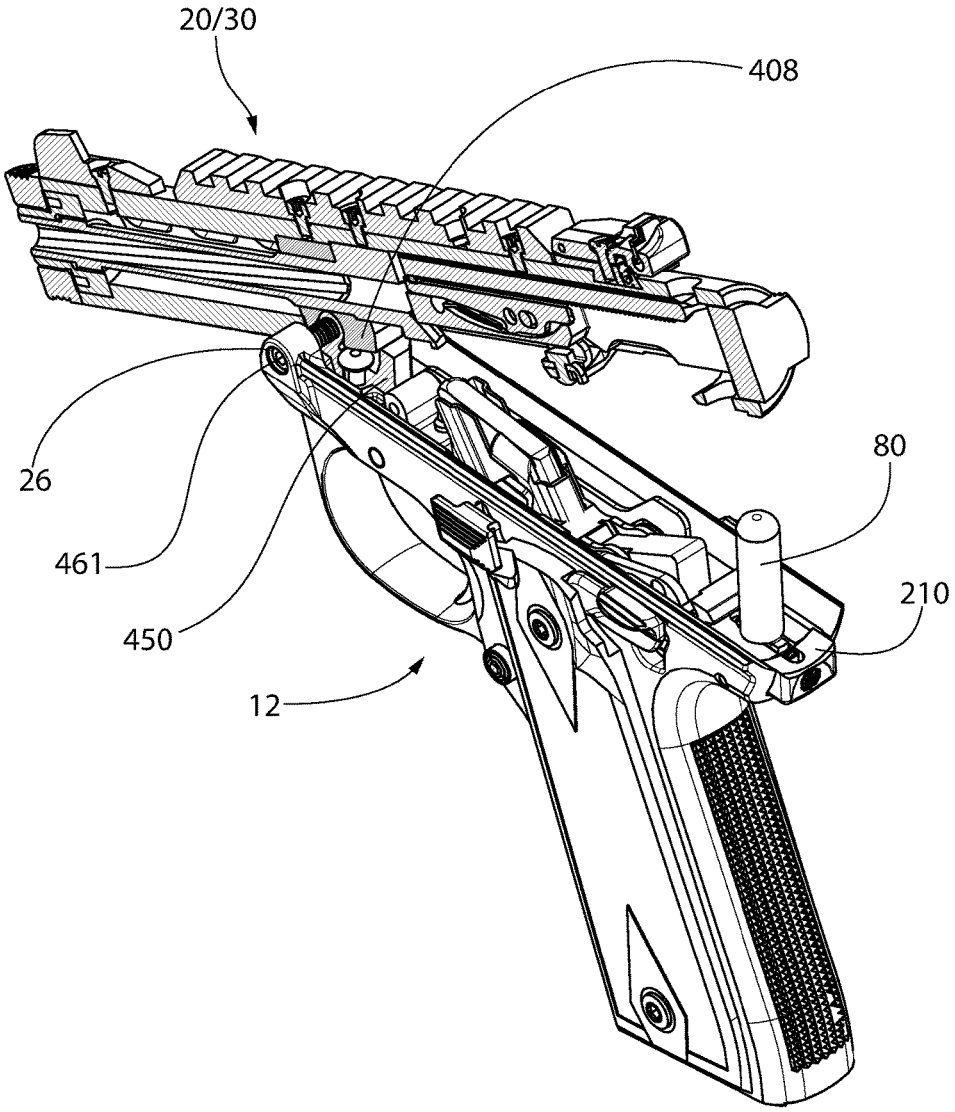
FIG. 52 is a perspective view of the pistol with frame having a detachable a pivot insert, the pistol shown in the titled open position with the barrel-receiver assembly partially removed from the frame.
Figure 53:
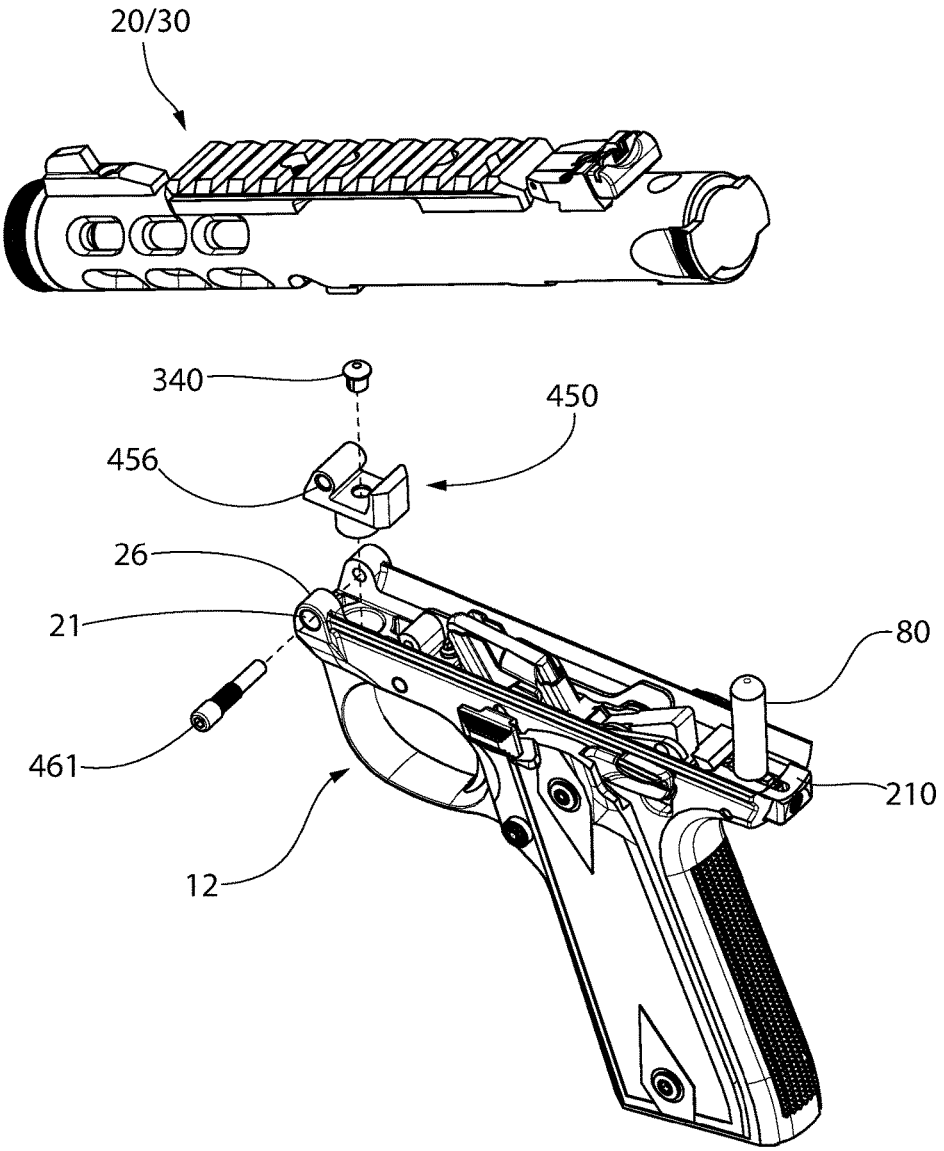
FIG. 53 is an exploded view thereof.

FIGS. 46-50 show the process for completely dismounting the barrel-receiver assembly 20/30 from the pistol grip frame 12 without removing the pivot pin 60 or other components of the frame 12 and without tools. FIGS. 46 and 47 are cross-sectional left side views of the pistol 10. FIGS. 48-50 are right side views showing the exterior of the pistol. The process will be described for convenience for a pistol having a frame pivot insert 450 shown in the referenced figures; however, the same process applies to implementations of the pistol without an insert in which the hooked lug 400 of the barrel-receiver assembly 20/30 directly engages a pivot pin 60.

FIGS. 46 and 48 depict pistol 10 with the barrel-receiver assembly in the ready-to-fire horizontal closed position and latch 210 in the rearward locked position (FIGS. 41A-B). The bottom surface 404 of the barrel-receiver assembly 20/30 is substantially parallel to the opposing pair of longitudinal top edges 15*a* defined by the lateral sides 15 of the frame 12 (identified in FIG. 28). Pivot protuberance 452 on the frame pivot insert 450 is fully engaged in slot 402 and with hooked lug 400 of the barrel-receiver assembly 20/30 as seen in FIG. 46. Initially, the latch 210 is in the rearward locked position shown in FIG. 42B. Next, latch 210 is pushed in a longitudinal axial direction to the forward unlocked position (FIGS. 43A-B). This unlocks the barrel-receiver assembly from the frame 12 and allows the assembly to be pivotably tilted forward and downward thereby raising the rear end upwards to the tilted open position as shown in FIGS. 47 and 49. The hooked lug 400 of barrel-receiver assembly 20/30 is still engaged with pivot pin 60 in the frame 12 in the tilted open position.

To fully remove the barrel-receiver assembly 20/30 from pistol frame 12, the barrel-receiver assembly is next lifted in an upward motion off the frame to disengage the pivot protuberance 452 from the hooked lug 400. During this motion, the pivot protuberance 452 slides forwards and downwards in slot 402 on the barrel-receiver assembly 20/30 from the closed top end 403 outwards through the open bottom end 401 of the slot. The barrel-receiver assembly may now be raised upwards and lifted off of the frame as shown in FIG. 50. The mounting protrusion 408 of the barrel-receiver assembly is removed from the receptacle 454 in frame 12 and pivot protuberance 452 is fully disengaged from the hooked lug 400 and slot 402, thereby allowing for complete of the barrel-receiver assembly from the frame (see, e.g. FIG. 50). Notably, the barrel-receiver assembly 20/30 removal is completed without tools (e.g. pivot pin punch, hammer, etc.) while the pivot protuberance 452 remains attached to frame 12 during the entire process, thereby advantageously simplifying maintenance and inspection of the firing mechanism. Particularly when field stripping the pistol for maintenance, there are no removed mounting hardware parts to get lost that would prevent the pistol from being reassembled to the ready-to-fire condition. In embodiments of the pistol having a pivot pin 60 in lieu of pivot insert 450 with a pivot protuberance 452, the same considerations apply.

The barrel-receiver assembly 20/30 may be re-mounted to grip frame 12 by reversing the foregoing steps. After the slot 402 and hooked lug 400 are reinserted and re-engaged with the pivot protuberance 452 in the frame 12 at the forward end of the barrel-receiver assembly 20/30 (with the assembly in a tilted position), the rear end of the assembly is lowered back down towards the frame with a pivotable motion. The barrel-receiver assembly is re-locked with the latch mechanism and frame. During this process, it bears noting that the user need not manually move the latch to re-lock the barrel-receiver assembly. The upward facing obliquely angled closure surface 286 on the latch 210 engages mating downward facing obliquely angled closure surface 294 formed on the hook-shaped portion 291 of barrel-receiver assembly 20/30 (see, e.g. FIGS. 32 and 35A). This mutual engagement slightly displaces the latch 210 rearward against the spring biasing force until the latch mechanism is fully re-engaged with the hook-shaped portion 291 of the barrel-receiver assembly.

It should be noted that the foregoing dismounting process may also be used with latching mechanism 100 having slide plate 70 described above or other configurations of latches so long as a barrel-receiver assembly with hooked lug 400 and slot 402 are used.

In other possible embodiments, operation of the latch 210 may be reversed so that pulling the latch rearward unlocks the barrel-receiver assembly 20/30 instead of pushing the latch forward as described above. To accomplish this, the latch the latch 210 may be essentially reversed in frame 12 so that the latch hook 285 projects forward from the latch body instead of rearward as illustrated. The hook-shaped portion 292 on the barrel-receiver assembly 20/30 may concomitantly be reversed so that it projects rearward instead of forward as illustrated to engage the hook 285. The springs 231, 232 would act to bias the latch forward towards a locked position in which the hook 285 is engaged with the hook-shaped portion 292 of the barrel-receiver assembly. To unlock the barrel-receiver assembly from the frame, the latch 210 is pulled rearward against the forward biasing action of the springs. While the foregoing description and drawings represent exemplary embodiments of the present disclosure, it will be understood that various additions, modifications and substitutions may be made therein without departing from the spirit and scope and range of equivalents of the accompanying claims. In particular, it will be clear to those skilled in the art that the present invention may be embodied in other forms, structures, arrangements, proportions, sizes, and with other elements, materials, and components, without departing from the spirit or essential characteristics thereof. In addition, numerous variations in the methods/processes. One skilled in the art will further appreciate that the embodiments may be used with many modifications of structure, arrangement, proportions, sizes, materials, and components and otherwise, used in the practice of the disclosure, which are particularly adapted to specific environments and operative requirements without departing from the principles described herein. The presently disclosed embodiments are therefore to be considered in all respects as illustrative and not restrictive. The appended claims should be construed broadly, to include other variants and embodiments of the disclosure, which may be made by those skilled in the art without departing from the scope and range of equivalents.

What is claimed is:

1. A firearm with tilting barrel-receiver assembly, the firearm comprising:

a longitudinal axis;

a frame;

a barrel-receiver assembly pivotably mounted to a front end of the frame, the barrel-receiver assembly angularly movable between a tilted open position and a closed position;

a safety pivotably mounted to the frame, the safety selectively movable between safe and firing positions;

a latching mechanism disposed in the frame and including a latch having a latch hook configured and operable to selectively engage or disengage the barrel-receiver assembly, the latch slideably movable between a locked position in which the barrel-receiver assembly is retained in the closed position, and an unlocked position in which the barrel-receiver assembly is movable to the open position;

wherein when the safety is in the firing position, the latch is prevented from moving to the unlocked position by the safety.

2. The firearm according to claim 1, wherein the safety includes a rear blocking surface which engages a front latching end of the latch when the safety is in the firing position that prevents the latch from moving forward to the unlocked position.

3. The firearm according to claim 2, wherein when the safety is in the safe position, the rear blocking surface disengages the front latching end of the latch allowing the latch to move to the unlocked position.

4. The firearm according to claim 3, wherein the rear blocking surface enters a pocket formed in the front latching end of the latch when the safety is in the safe position and the latch is in the unlocked position.

5. The firearm according to claim 4, further comprising a rearwardly open slot formed in the safety which receives the front latching end of the latch when the safety is in the safe position.

6. The firearm according to claim 5, wherein the rearwardly open slot defines a Y-shaped bifurcated rear portion of the safety that includes the rear blocking surface.

7. The firearm according to claim 2, wherein the safety includes a front portion having a downwardly extending hook configured and operable to engage a firing mechanism component of the firearm when the safety is in the safe position to prevent discharging the firearm, and to disengage the firing mechanism component when the safety is in the firing position to allow discharging the firearm.

8. The firearm according to claim 7, wherein the firing mechanism component is a rotatable sear operably coupled to a trigger and a cockable hammer held and released by the sear to discharge the firearm.

9. The firearm according to claim 1, wherein the barrel-receiver assembly includes a forwardly open locking recess which engages the latch hook when the latch is in the locked position, the latch hook projecting in a rearwards direction on the latch.

10. The firearm according to claim 1, wherein the safety comprises a generally flat plate-like body.

11. The firearm according to claim 1, further comprising a downwardly open slot on a bottom surface of the barrel-receiver assembly that defines a hooked lug, the hooked lug detachably engaging a pivot surface disposed on the frame which is received in the slot, wherein the barrel-receiver assembly is completely removable from the frame without use of tools.

12. A firearm with tilting barrel-receiver assembly, the firearm comprising:

a longitudinal axis;

a frame;

a barrel-receiver assembly pivotably mounted to a front end of the frame, the barrel-receiver assembly angularly movable between a tilted open position and a closed position;

a latching mechanism disposed in the frame and including a latch having a hook configured and operable to selectively engage or disengage the barrel-receiver assembly, the latch slideably movable between a locked position in which the barrel-receiver assembly is retained in the closed position, and an unlocked position in which the barrel-receiver assembly is movable to the open position;

a trigger-actuated firing mechanism movably operable to discharge the firearm via a trigger pull;

a safety pivotably mounted to the frame, the safety selectively movable between safe and firing positions;

wherein when the safety is in the safe position, the safety engages the firing mechanism to prevent discharge of the firearm;

wherein when the safety is in the firing position, the safety disengages the firing mechanism to allow discharge of the firearm; and wherein when the safety is in the firing position, the latch is prevented from moving to the unlocked position by the safety.

13. The firearm according to claim 12, wherein the safety includes a rear blocking surface which engages a front latching end of the latch when the safety is in the firing position that prevents the latch from moving forward to the unlocked position.

14. The firearm according to claim 13, wherein when the safety is in the safe position, the rear blocking surface disengages the front latching end of the latch allowing the latch to move to the unlocked position.

15. The firearm according to claim 14, wherein the safety includes a rearwardly open slot which receives the front latching end of the latch when the safety is in the safe position that allows the latch to move to the unlocked position.

16. The firearm according to claim 13, wherein the safety includes a rear portion that defines the rear blocking surface and a front portion configured to engage the firing mechanism.

17. The firearm according to claim 16, wherein the front portion of the safety includes downwardly extending hook that engages the firing mechanism.

18. The firearm according to claim 12, wherein the firing mechanism includes a rotatable sear cooperating with the trigger and a movable hammer or striker operable for discharging the firearm, the safety configured to selectively engage and arrest movement of the sear which prevents discharging the firearm.

19. The firearm according to claim 12, wherein the safety includes an operating lever for moving the safety between the locked and unlocked positions.

20. The firearm according to claim 12, wherein the barrel-receiver assembly includes a forwardly open locking recess which engages the latch hook when the latch is in the locked position, the latch hook projecting in a rearwards direction on the latch.

21. A method for operating a firearm with a tilting barrel-receiver assembly, the method comprising:

providing a firearm including a frame, a barrel-receiver assembly pivotably movable on the frame between a horizontal closed position and a tilted open position, a latch slideably movable between a locked position and an unlocked position, and a movable safety selectively engageable with latch;

placing the barrel-receiver assembly in the closed position on the frame;

moving the latch to the locked position engaging and retaining the barrel-receiver assembly in the closed position;

moving the safety to a locked position blocking movement of the latch to unlocked position;

moving the safety to an unlocked position allowing movement of the latch to the unlocked position;

moving the latch to the unlocked position disengaging the barrel-receiver assembly; and pivoting the barrel-receiver assembly to the open position.

22. The method according to claim 21, wherein the step of moving the safety to the unlocked position comprises inserting a portion of the latch into an open slot in the safety which allows movement of the latch to the unlocked position, and wherein the step of moving the safety to the locked position comprises moving a blocking on the safety into engagement with the latch which prevents movement of the latch to the unlocked position.

23. The method according to claim 21, wherein the step of moving the safety to the unlocked position includes correspondingly engaging the safety with a firing component of a mechanism of the firearm to prevent discharging the firearm when the safety is in the unlocked position.

24. The method according to claim 21, wherein the pivoting step includes raising a rear end of the barrel-receiver assembly upwards off the frame and pivoting a front end of the barrel-receiver assembly downwards about a pivot surface disposed on a front end of the frame.

* * * * *